US005288600A

United States Patent [19]

Yamanouchi et al.

[11] Patent Number: 5,288,600

[45] Date of Patent: Feb. 22, 1994

[54] SILVER HALIDE PHOTOGRAPHIC MATERIAL CONTAINING AN OIL-SOLUBLE DYE DISPERSION

[75] Inventors: Junichi Yamanouchi; Yoshihiro Jimbo; Toshiyuki Watanabe; Koji Tamoto; Yukio Karino; Kei Sakanoue, all of Kanagawa, Japan

[73] Assignee: Fuji Photo Film Co., Ltd., Kanagawa, Japan

[21] Appl. No.: 932,986

[22] Filed: Aug. 20, 1992

[30] Foreign Application Priority Data

Aug. 21, 1991 [JP] Japan ..... 3-232436
Dec. 3, 1991 [JP] Japan ..... 3-344129

[51] Int. Cl.[5] ..... G03C 1/06

[52] U.S. Cl. ..... 430/522; 430/510; 430/517; 430/531

[58] Field of Search ..... 430/510, 517, 522, 531, 430/569, 570

[56] References Cited

U.S. PATENT DOCUMENTS 4,716,099 12/1987 Simone ..... 430/510
5,155,015 10/1992 Jimbo ..... 430/517

FOREIGN PATENT DOCUMENTS 0353714 2/1990 European Pat. Off. .
0383354 8/1990 European Pat. Off. .
0423693 4/1991 European Pat. Off. .
0434026 6/1991 European Pat. Off. .

OTHER PUBLICATIONS

Angewandte Chemie. International Edition vol. 17, No. 8, Aug. 1978, Weinheim DE pp. 609-610.
C. Wentrup et al. 'A General and Facile Synthesis of Aryl-and heteroarylacetylens' p. 609.

*Primary Examiner*—Jack P. Brammer
*Attorney, Agent, or Firm*—Sughrue, Mion, Zinn, Macpeak & Seas

[57] ABSTRACT

A silver halide photographic material having at least one hydrophilic colloid layer containing a dispersion obtained by emulsifying and dispersing a mixed solution containing at least one oil-soluble dye and at least one water-insoluble, organic solvent-soluble polymer.

11 Claims, No Drawings

SILVER HALIDE PHOTOGRAPHIC MATERIAL CONTAINING AN OIL-SOLUBLE DYE DISPERSION

FIELD OF THE INVENTION

This invention relates to a silver halide photographic material having a dyed layer, and more particularly to a silver halide photographic material having a hydrophilic colloid layer containing a dye which is photochemically inert and is readily decolorized and/or eluted from the photographic material upon photographic processing.

BACKGROUND OF THE INVENTION

Photographic emulsion layers or other hydrophilic colloid layers of silver halide photographic materials are often colored to absorb light in a specific wavelength region.

When the spectral composition of light incident upon a photographic emulsion layer must be controlled, a colored layer is usually provided on a side which is farther away from the support than the photographic emulsion layer. Such a colored layer is called a filter layer. When two or more emulsion layers are provided, a filter layer is sometimes provided therebetween.

On other hand, a colored layer called an antihalation layer is provided between the support and the photographic emulsion layer or on the side of the support opposite to the photographic emulsion layer to prevent blurring of an image, namely, to prevent halation caused by light scattering during or after the passage of light through the photographic emulsion layer. Particularly, light is reflected at the interface between the emulsion layer and the support or at the surface side of the support opposite the emulsion layer of the light-sensitive material, to again enter the photographic emulsion layer. When two or more photographic emulsion layers are provided, the antihalation layer is sometimes interposed therebetween.

Furthermore, the photographic emulsion layer is often colored to prevent reduced sharpness of the image due to scattering of light in the photographic emulsion layer. This phenomenon is generally called irradiation.

Generally, dyes are contained in the hydrophilic colloid layers to be colored. The dyes necessarily meet the following requirements.

(1) The dyes have an appropriate spectral absorption depending on the intended use.

(2) The dyes are photochemically inert. Namely, the dyes do not adversely effect the performance of silver halide photographic emulsion layers in a chemical sense. For example, the dyes do not cause a reduction in sensitivity, latent image fading or fogging.

(3) The dyes are decolorized during the course of photographic processing or (dissolved out) eluted in processing solutions or rinsing water so that any harmful coloration does not remain in the photographic materials after processing.

(4) The dyes do not diffuse from dyed layers into other layers.

(5) The dyes have excellent stability in solution or when introduced into a photographic material, and are neither discolored nor faded upon storage.

When the colored layer is a filter layer or when the colored layer is an antihalation layer provided on the photographic emulsion layer side of the support, the layer is often required to be selectively colored so that other layers are substantially not affected by the coloration. Otherwise, such coloration has an adverse spectral effect on adjacent layers, while the effect of the colored layer as the filter layer or the antihalation layer is reduced. However, when the dye-containing layer and another hydrophilic colloid layer in a wet state are brought into contact with each other, a portion of the dye is often diffused from the former into the latter. Many investigators have hitherto sought to develop techniques to prevent the dye from diffusing into an adjacent layer.

For example, U.S. Pat. Nos. 2,548,564 and 3,625,694 propose a method wherein a hydrophilic polymer having a charge opposite to that of a dissociated anionic dye as a mordant is present with the dye in the same layer, and the dye is localized in a specific layer by interaction with the mordant.

In the dye fixing-decolorizing method using such a mordant, however, a large amount of the mordant must be used in comparison with the amount of the anionic dye. As a result, the thickness of the colored layer is inevitably increased. For example, when the colored layer is used as a filter layer for photographing materials, an increase in the thickness of the layer deteriorates the sharpness of the resulting image. Further, in a system using the mordant, the mordant necessarily does not interfere with the decolorization of sensitizing dyes used in the silver halide emulsions, in addition to the fixation-decolorization of the colored dye. However, the decolorizing performance thereof does not always reach a level which satisfies recent demands for higher image quality and rapid processing of the photographic materials.

Methods for dyeing a specific layer using a water-insoluble dye solid are disclosed in JP-A-56-12639 (the term "JP-A" as used herein means an "unexamined published Japanese patent application"), JP-A-55-155350, JP-A-55-155351, JP-A-63-27838, JP-A-63-197943, European Patents 15,601, 274,723, 276,566 and 299,436, U.S. Pat. No. 4,803,150 and WO 88/04794.

Furthermore, methods for dyeing a specific layer by using fine metal salt particles having a dye adsorbed thereon are disclosed in U.S. Pat. Nos. 2,719,088, 2,496,841 and 2,496,843 and JP-A-60-45237.

Such dyeing methods as described above provide excellent fixation and decolorization capability, but the absorption range thereof is generally broad. The broad absorption range is undesirable when the dyes are used as filter dyes for light in a specific wavelength region.

Furthermore, methods wherein oil-soluble dyes are dispersed with high-boiling organic solvents are disclosed in JP-A-61-204630, JP-A-61-205934, JP-A-62-32460, JP-A-62-56958, JP-A-62-92949, JP-A-62-222248, JP-A-63-40143, JP-A-63-184749 and JP-A-63-316852.

However, when such high-boiling organic solvents are used, the colored layer is softened and the mechanical strength of the layer is lowered. Hence, a larger amount of gelatin must be used, and the use of the high-boiling organic solvents adversely increases the thickness of the layer.

JP-B-51-39853 (the term "JP-B" as used herein means an "examined Japanese patent publication"), JP-A-51-59943, JP-A-53-137131, JP-A-54-32552, JP-A-54-107941, JP-A-56-126830, JP-A-58-149038, U.S. Pat. Nos. 4,199,363, 4,203,716 and 4,990,435 disclose a method wherein a solution of a hydrophobic material such as a dye in an organic solvent is added to an aqueous dispersion of a polymer (polymer latex) to thereby impregnate the polymer latex with the hydrophobic material, thus forming a hydrophobic material-filled polymer latex. The method avoids the problems caused by the above noted high-boiling organic solvents, but the polymer latex particles are unstable during impregnation and tend to become agglomerated. The method is disadvantageous in that a large amount of the polymer must be used to sufficiently impregnate the polymer with the hydrophobic material, removal of a water-soluble organic co-solvent used for impregnation requires much time, and the entire process is lengthy and complicated.

SUMMARY OF THE INVENTION

Accordingly, an object of the present invention is to provide a silver halide photographic material having excellent manufacturability, and which allows a specific layer to be selectively dyed without adversely effecting the absorption characteristics of a dye to be used and the mechanical strength of the layer. Furthermore, the photographic material contains a novel dispersion of a dye having excellent decolorizability or ability to be eluted (dissolved out) from the photographic material during processing.

The above-described object of the present invention have been achieved by providing a silver halide photographic material defined by the following items (1), (2), (3), (4) and (5).

(1) A silver halide photographic material comprising a support having thereon one or more hydrophilic colloid layers, at least one layer of which is a light-sensitive silver halide emulsion layer, at least one hydrophilic colloid layer containing a dispersion obtained by emulsifying and dispersing a mixed solution containing at least one oil-soluble dye and at least one water-insoluble, organic solvent-soluble polymer.

(2) A silver halide photographic material as in (1) above, wherein the water-insoluble, organic solvent-soluble polymer is a polymer having a repeating unit derived from a monomer having an anionic functional group.

(3) A silver halide photographic material as in (2) above, wherein the polymer having a repeating unit derived from a monomer having an anionic functional group is a compound represented by the following formula (I)

$$\left(A\right)_x \left(B\right)_y \qquad \text{(I)}$$

wherein A represents a repeating unit derived from an ethylenically unsaturated monomer (a) having at least one acid group (i.e., anionic functional group), and which monomer is insoluble in water at pH≦6, but is soluble in water at pH≧10; B represents a repeating unit derived from other ethylenically unsaturated monomer than the ethylenically unsaturated monomer (a); and x and y each represents the percentage by weight of each component, x is 1 to 100, y is 0 to 99, and x+y is 100.

(4) A silver halide photographic material as in (1) above, wherein the oil-soluble dye is a compound represented by the following formula (II):

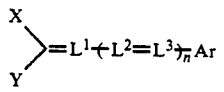

(II)

wherein X and Y each represents an electron attractive group, or X and Y may be combined together to form an acid nucleus; Ar represents a phenyl group or a heterocyclic group; $L^1$, $L^2$ and $L^3$ each represents a methine group; n represents 0, 1 or 2.

(5) A silver halide photographic material as in (4) above, wherein the oil-soluble dye is a compound represented by the following formula (III):

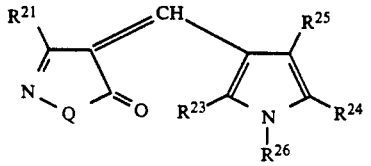

(III)

wherein $R^{21}$ represents a hydrogen atom, an alkyl group, an aryl group, $-COOR^{27}$, $-COR^{27}$, $-CONR^{27}R^{28}$, $-CN$, $-OR^{27}$, $-NR^{27}R^{28}$ or $-N(R^{27})COR^{28}$; Q represents an oxygen atom or $N-R^{22}$; $R^{22}$ represents hydrogen atom, an alkyl aryl group or a heterocyclic group; $R^{23}$, $R^{24}$ and $R^{25}$ each represents a hydrogen atom, an alkyl group or an aryl group, or $R^{24}$ and $R^{25}$ may be combined together to form a six-membered ring; $R^{26}$ represents a hydrogen atom, an alkyl group, an aryl group or an amino group; and $R^{27}$ and $R^{28}$ each represents hydrogen atom, an alkyl group or an aryl group.

DETAILED DESCRIPTION OF THE INVENTION

The present invention is illustrated in greater detail below.

The polymer for dispersion of the dye for use in the present invention comprises at least one type of repeating unit and is insoluble in water, but soluble in organic solvents.

Examples of the water-insoluble, organic solvent-soluble polymer used in the present invention are, for example, those having a solubility of 5 or more (g/ml)% in ethyl acetate at 40° C. and a solubility of 1 or less (g/ml)% in distilled water at 40° C., that is, the polymers of which 5 g or more can be dissolved in 100 ml of ethyl acetate and only 1 g or less can be dissolved in 100 ml of distilled water at 40° C.

Examples of the polymer for use in the present invention include, but are not limited to, the following polymers.

(A) Vinyl Polymers

Examples of monomers for preparation of the vinyl polymers of the present invention include acrylic esters such as methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (moles of addition: n=9), 1-bromo-2-methoxyethyl acrylate and 1,1-dichloro-2-ethoxyethyl acrylate.

Examples of other monomers for preparation of the vinyl polymers for use in the present invention include methacrylic esters such as methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2ethoxyethoxy)ethyl methacrylate, 2-(2-butoxyethoxy)ethyl methacrylate, ω-methoxypolyethylene glycol methacrylate (moles of addition: n=9), allyl methacrylate and dimethylaminoethyl methylchloride methacrylate; vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate; acrylamides such as acrylamide, methyl acrylamide, ethyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, N-(2-acetacetoxyethyl) acrylamide, and diacetone acrylamide; methacrylamides such as methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide and N-(2-acetacetoxyethyl) methacrylamide; olefins such as dicyclopentadiene, ethylene, propylene, 1-butene, 1-pentene, vinyl chloride, vinylidene chloride, isoprene, chloroprene, butadiene and 2,3-dimethylbutadiene; styrenes such as styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinylbenzoate; and vinyl ethers such as methyl vinyl ether, butyl vinyl ether, hexyl vinyl ether, methoxyethyl vinyl ether and dimethylaminoethyl vinyl ether.

Other examples of monomers for preparation of the vinyl polymers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylnitrile, methylenemalonitrile and vinylidene monomers.

Copolymers derived from monomers having an anionic functional group are preferred with respect to decolorization and/or elution from the photographic material upon processing of the emulsified dispersion of the dye.

Examples of the anionic functional group include a carboxyl group, a sulfonic acid group, a mono-substituted sulfuric acid, a mono- or di-substituted phosphoric acid, an active methylene, and disulfonimide. Among them, a sulfonic acid group is preferable and a carboxyl group is more preferable.

Examples of monomers having an anionic functional group include acrylic acid, methacrylic acid, itaconic acid, maleic acid, monoalkyl esters of itaconic acid (e.g., monomethyl itaconate, monoethyl itaconate), monoalkyl esters of maleic acid (e.g., monomethyl maleate, monoethyl maleate), citraconic acid, styrenesulfonic acid, vinylbenzenesulfonic acid, vinylsulfonic acid, acryloyloxyalkylsulfonic acids (e.g., acryloyloxymethylsulfonic acid, acryloyloxyethylsulfonic acid, acryloyloxypropylsulfonic acid), methacryloyloxyalkylsulfonic acids (e.g., methacryloyloxymethylsulfonic acid, methacryloyloxyethylsulfonic acid, methacryloyloxypropylsulfonic acid), acrylamidoalkylsulfonic acids (e.g., 2-acrylamido-2-methylethanesulfonic acid, 2-acrylamido-2-methylpropanesulfonic acid, 2-acrylamido-2-methylbutanesulfonic acid) and methacrylamidoalkylsulfonic acids (e.g., 2-methacrylamido-2-methylethanesulfonic acid, 2-methacrylamido-2-methylpropanesulfonic acid, 2-methacrylamido-2-methylbutanesulfonic acid).

These acids may be in the form of an alkali metal (e.g., Na, K) salt or an ammonium ion salt.

Of the organic solvent-soluble polymers of the present invention, particularly preferred are copolymers of ethylenically unsaturated monomers which have at least one acid group and are insoluble in water at pH≦6, but soluble in water at pH≧10. Preferred examples of the acid group include carboxyl group, phenolic hydroxyl group, sulfonamido group and activated methylene group. Among them, a carboxyl group is particularly preferred.

Examples of the monomers having at least one acid group include the following compounds.

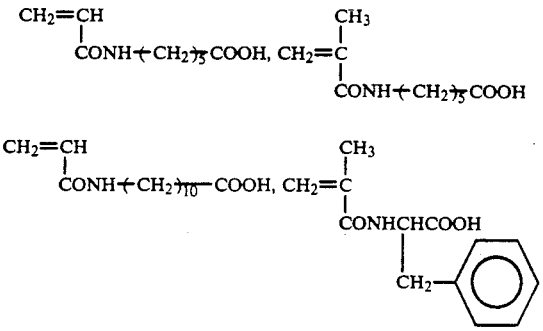

-continued

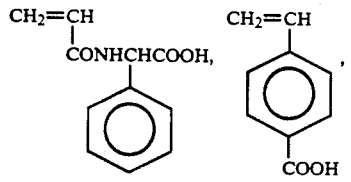

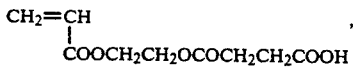

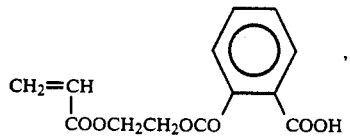

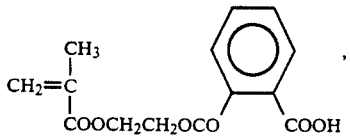

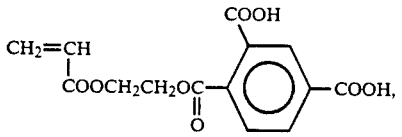

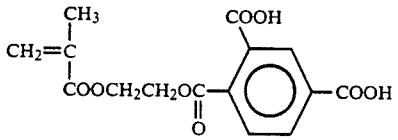

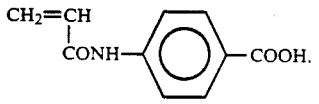

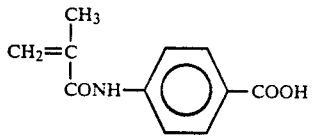

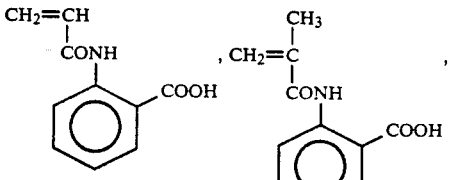

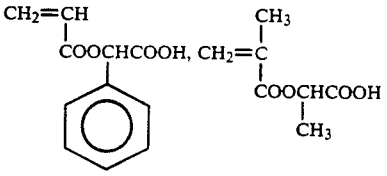

-continued

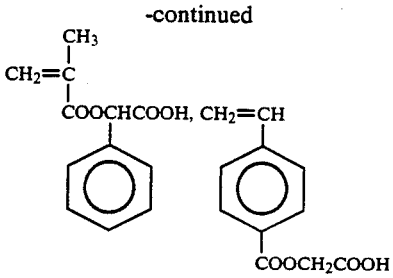

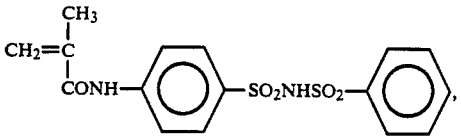

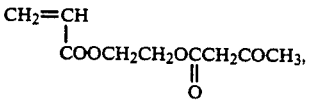

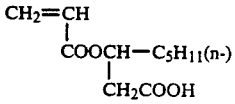

In formula (I), A represents a repeating unit derived from the above described ethylenically unsaturated monomer (a) having at least one acid group, which monomer is insoluble in water at pH≦6, but soluble in water at pH≧10, and B represents a repeating unit derived from other ethylenically unsaturated monomer than the ethylenically unsaturated monomer (a), which may be, for example, an ethylenically unsaturated monomer not having an anionic functional group, and may be selected from the monomers described above for preparation of the vinyl polymers. Examples of the monomer is insoluble in water at pH≦6, but soluble in water at pH≧10 are, for example, those having a solubility of 2 (g/ml)% or less in water having a pH value of 6 and having a solubility of 10 (g/ml)% or more in water having a pH value of 10.

The repeating unit A may be derived from one or more types of ethylenically unsaturated monomers having at least one acid group as described above. The repeating unit B may be derived from one or more types of ethylenically unsaturated monomers not having an acid group as described above.

When hydrophilic monomers (the term "hydrophilic monomer" as used herein refers to a monomer, the homopolymer of which is water-soluble) among the above vinyl monomers and other monomers for use in the present invention, are used as comonomers, there is no particular limitation with regard to the proportion of the hydrophilic monomer in the copolymer, so long as the resulting copolymer is not water-soluble. However, the content of repeating units of the copolymer derived from hydrophilic monomers is preferably not more than 50% by weight, particularly preferably not more than 30% by weight.

The polymer of the present invention may be a homopolymer or a copolymer of two or more monomers. Particularly preferred monomers which form the polymers of the present invention are acrylic esters, methacrylic esters, styrene compounds and monomers which provide water-insoluble homopolymers, such as acrylamide compounds and methacrylamide compounds.

In copolymers derived from monomers having at least one acid group in a preferred embodiment of the present invention, the amount of a monomer having an anionic functional group introduced into the copolymer is restricted in that the resulting copolymer must be water-insoluble and that compatibility of the copolymer with the dye must not be deteriorated. When a monomer having carboxyl group is used, the content of repeating units in the copolymer derived from this monomer is preferably not more than 40 mol%, particularly preferably not more than 30 mol% and the lower limit is preferably 0.5 mol%, and when a monomer having a sulfo group is used, the content of repeating units in the copolymer derived from the monomer is preferably not more than 15 mol%, particularly preferably not more than 10 mol%, and the lower limit is preferably 0.3 mol%.

In formula (I), x and y each represents the percentage by weight of the designated component. In a preferred embodiment of the copolymers of formula (I), x is 1 to 100 and y is 0 to 99. The preferred range of each of x and y varies depending on the molecular weights, hydrophobicity, etc. of the monomers having at least one acid group from which A is derived, but x is preferably 3 to 80, particularly preferably 5 to 70, and y is preferably 20 to 97, particularly preferably 30 to 95.

(B) Polyesters Obtained By Condensing A Polyhydric Alcohol With A Polybasic Acid Polyhydric alcohols which can be effectively used include glycols represented by the formula HO—$R_1$—OH (wherein $R_1$ is a hydrocarbon chain having 2 to about 12 carbon atoms, particularly an aliphatic hydrocarbon chain) and polyalkylene glycols. Polybasic acids which can be effectively used include compounds represented by the formula HOOC—$R_2$—COOH (wherein $R_2$ is a single bond or a hydrocarbon chain having 1 to about 12 carbon atoms).

Specific examples of the polyhydric alcohols include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerin, diglycerin, triglycerin, 1-methylglycerin, erythrite, mannitol and sorbitol.

Specific examples of the polybasic acids include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid tetrachlorophthalic acid, metacholine acid, isopimelic acid, cyclopentadiene-maleic anhydride adduct and rosin-maleic anhydride adduct.

(C) Other Polymers

Examples of other polymers include polyesters obtained by the following ring opening polymerization.

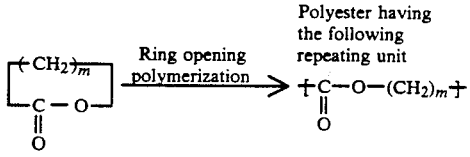

wherein m represents an integer of 4 to 7, and the —$CH_2$— chain may be branched.

Examples of suitable monomers which can be used in the preparation of the polyesters include β-propiolactone, ε-caprolacton and dimethylpropiolactone.

The above-described polymers of the present invention may be used either alone or in a combination of two or more thereof.

The effects of the present invention are substantially unaffected by the molecular weights and degrees of polymerization of the polymers used in the present invention. However, as the molecular weights of the polymers are increased, the time required for dissolving the polymers in co-solvents tends to increase. Furthermore, as the viscosity of the polymer solutions is increased, the emulsifying dispersion thereof with the oil-soluble dye becomes more difficult. As a result, coarse particles are formed, and the absorption characteristics of the dyes are deteriorated or coatability becomes poor. When the viscosity of the solution is lowered by using a larger amount of the co-solvent to alleviate the above problems, other problems occur in the manufacturing process. From this point of view, the viscosity at 40° C. of the polymer solution is preferably not higher than 5,000 cps, more preferably not higher than 2,000 cps when 30 g of the polymer is dissolved in 100 cc of the co-solvent. The number-average molecular weight of the polymers for use in the present invention is preferably not more than 300,000, particularly preferably not more than 100,000.

The ratio of polymer to co-solvent varies depending on the types of the polymers to be used and widely varies depending on the solubility of the polymers in the co-solvents, the degree of polymerization and the solubility of the dyes. Usually, a co-solvent is used in an amount required for providing a sufficiently low viscosity such that a solution of at least both the dye and the polymer dissolved in the co-solvent is easily dispersed in an aqueous solution of a hydrophilic colloid. The viscosity of the solution is increased with an increase in the degree of polymerization of the polymer. Accordingly, the ratio of polymer to co-solvent is difficult to define independent of the type of polymer selected. Generally the ratio of polymer to co-solvent is preferably in the range of from about 1:1 to 1:50 by weight, and the ratio of polymer to dye is preferably in the range of from 1:20 to 20:1, more preferably 1:10 to 10:1 by weight.

Examples of polymers for use in the present invention include, but are not limited to, the following polymers.

| Specific examples | Type of the polymer (Parenthesized numerals represent molar ratio) |
|---|---|
| P-1~5 | Methyl methacrylate-acrylic acid copolymer<br>P-1 (97:3)<br>P-2 (95:5)<br>P-3 (90:10)<br>P-4 (80:20)<br>P-5 (70:30) |

-continued

| Specific examples | Type of the polymer (Parenthesized numerals represent molar ratio) |
|---|---|
| P-6 | Methyl acrylate-acrylic acid copolymer (90:10) |
| P-7 | n-Butyl acrylate-acrylic acid copolymer (93:7) |
| P-8, 9 | Methyl methacrylate-methacrylic acid copolymer<br>P-8 (90:10)<br>P-9 (85:15) |
| P-10 | n-Butyl methacrylate-methacrylic acid copolymer (95:5) |
| P-11 | Methyl methacrylate-ethyl methacrylate-methacrylic acid copolymer (50:42:8) |
| P-12 | Methyl methacrylate-benzyl methacrylate-methacrylic acid copolymer (20:70:10) |
| P-13 | N-tert-butyl acrylamide-n-butyl acrylate-acrylic acid copolymer (44:50:6) |
| P-14~16 | Methyl methacrylate-2-acrylamido-2-methylpropane-sulfonic acid (sodium salt) copolymer<br>P-14 (99:1)<br>P-15 (97:3)<br>P-16 (95:5) |
| P-17 | Methyl methacrylate-methacrylic acid-2-acrylamido-2-methyl-propanesulfonic acid (sodium salt) copolymer (90:7:3) |
| P-18 | n-Butyl methacrylate-3-acryloxybutane-1-sulfonic acid (sodium salt) copolymer (97:3) |
| P-19 | Polyvinyl acetate |
| P-20 | Polyvinyl propionate |
| P-21 | Polymethyl methacrylate |
| P-22 | Polyethyl methacrylate |
| P-23 | Polyethyl acrylate |
| P-24 | Vinyl acetate-vinyl alcohol copolymer (95:5) |
| P-25 | Poly-n-butyl acrylate |
| P-26 | Poly-n-butyl methacrylate |
| P-27 | Polyisobutyl methacrylate |
| P-28 | Polyisopropyl methacrylate |
| P-29 | Polydecyl methacrylate |
| P-30 | n-Butyl acrylate-acrylamide copolymer (95:5) |
| P-31 | Poly(2-tert-butylphenyl acetate) |
| P-32 | Poly(4-tert-butylphenyl acrylate) |
| P-33 | n-Butyl methacrylate-N-vinyl-2-pyrrolidone copolymer (90:10) |
| P-34 | Methyl methacrylate-vinyl chloride copolymer (70:30) |
| P-35 | Methyl methacrylate-styrene copolymer (90:10) |
| P-36 | Methyl methacrylate-ethyl acrylate copolymer (50:50) |
| P-37 | n-Butyl methacrylate-methyl methacrylate-styrene copolymer (50:30:20) |
| P-38 | Vinyl acetate-acrylamide copolymer (85:15) |
| P-39 | Methyl methacrylate-acrylonitrile copolymer (65:35) |
| P-40 | Diacetone acrylmide-methyl methacrylate copolymer (50:50) |
| P-41 | Methyl methacrylate-cyclohexyl methacrylate copolymer (50:50) |
| P-42 | Methyl methacrylate-phenyl vinyl ketone copolymer (70:30) |
| P-43 | n-Butyl acrylate-methyl methacrylate-n-butyl methacrylate copolymer (35:35:30) |
| P-44 | n-Butyl methacrylate-methyl methacrylate-vinyl chloride copolymer (37:36:27) |
| P-45 | n-Butyl methacrylate-styrene copolymer (90:10) |
| P-46 | Methyl methacrylate-N-vinyl-2-pyrrolidone copolymer (90:10) |
| P-47 | n-Butyl methacrylate-styrene copolymer (70:30) |
| P-48 | Poly(N-sec-butyl acrylamide) |
| P-49 | Poly(N-tert-butyl acrylamide) |
| P-50 | Diacetone acrylamide-methyl methacrylate copolymer (62:38) |
| P-51 | Polycyclohexyl methacrylate-methyl methacrylate copolymer (60:40) |
| P-52 | N-tert-butyl acrylamide-methyl methacrylate copolymer (40:60) |
| P-53 | Poly(N-n-butyl acrylamide) |
| P-54 | Poly(tert-butyl methacrylate)-N-tert-butyl acrylamide copolymer (50:50) |
| P-55 | tert-Butyl methacrylate-methyl methacrylate copolymer (70:30) |
| P-56 | Poly(N-tert-butyl methacrylamide) |
| P-57 | N-tert-Butyl acrylmide-methyl methacrylate copolymer (60:40) |
| P-58 | Methyl methacrylate-styrene copolymer (75:25) |

-continued

| Specific examples | Type of the polymer (Parenthesized numerals represent molar ratio) |
|---|---|
| P-59 | Methyl methacrylate-hexyl methacrylate copolymer (70:30) |
| P-60 | Poly(benzyl acrylate) |
| P-61 | Poly(4-biphenyl acrylate) |
| P-62 | Poly(4-butoxycarbonylphenyl acrylate) |
| P-63 | Poly(sec-butyl acrylate) |
| P-64 | Poly(tert-butyl acrylate) |
| P-65 | Poly[3-chloro-2,2-bis(chloromethyl)propyl acrylate] |
| P-66 | Poly(2-chlorophenyl acrylate) |
| P-67 | Poly(4-chorophenyl acrylate) |
| P-68 | Poly(pentachlorophenyl acrylate) |
| P-69 | Poly(4-cyanobenzyl acrylate) |
| P-70 | Poly(cyanoethyl acrylate) |
| P-71 | Poly(4-cyanophenyl acrylate) |
| P-72 | Poly(4-cyano-3-thiabutyl acrylate) |
| P-73 | Poly(cyclohexyl acrylate) |
| P-74 | Poly(2-ethoxycarbonylphenyl acrylate) |
| P-75 | Poly(3-ethoxycarbonylphenyl acrylate) |
| P-76 | Poly(4-ethocycarbonylphenyl acrylate) |
| P-77 | Poly(heptyl acrylate) |
| P-78 | Poly(hexadecyl acrylate) |
| P-79 | Poly(hexyl acrylate) |
| P-80 | Poly(isobutyl acrylate) |
| P-81 | Poly(isopropyl acrylate) |
| P-82 | Poly(3-methoxybutyl acrylate) |
| P-83 | Poly(2-methoxycarbonylphenyl acrylate) |
| P-84 | Poly(3-methoxycarbonylphenyl acrylate) |
| P-85 | Poly(4-methoxycarbonylphenyl acrylate) |
| P-86 | Poly(2-methoxyethyl acrylate) |
| P-87 | Poly(4-methoxyphenyl acrylate) |
| P-88 | Poly(3-methoxypropyl acrylate) |
| P-89 | Poly(3,5-dimethyladamantyl acrylate) |
| P-90 | Poly(3-dimethylaminophenyl acrylate) |
| P-91 | Polyvinyl-tert-butyrate |
| P-92 | Poly(2-methylbutyl acrylate) |
| P-93 | Poly(3-methylbutyl acrylate) |
| P-94 | Poly(1,3-dimethylbutyl acrylate) |
| P-95 | Poly(2-methylpentyl acrylate) |
| P-96 | Poly(2-naphthyl acrylate) |
| P-97 | Poly(phenyl acrylate) |
| P-98 | Poly(propyl acrylate) |
| P-99 | Poly(m-tolyl acrylate) |
| P-100 | Poly(o-tolyl acrylate) |
| P-101 | Poly(p-tolyl acrylate) |
| P-102 | Poly(N,N-dibutyl acrylamide) |
| P-103 | Poly(isohexyl acrylamide) |
| P-104 | Poly(isooctyl acrylamide) |
| P-105 | Poly(N-methyl-N-phenyl acrylamide) |
| P-106 | Poly(adamantyl methacrylate) |
| P-107 | Poly(benzyl methacrylate) |
| P-108 | Poly(2-bromoethyl methacrylate) |
| P-109 | Poly(sec-butyl methacrylate) |
| P-110 | Poly(hexyl methacrylate) |
| P-111 | Poly(2-hydroxypropyl methacrylate) |
| P-112 | Poly(4-methoxycarbonylphenyl methacrylate) |
| P-113 | Poly(3,5-dimethyladamantyl methacrylate) |
| P-114 | Poly(dimethylaminoethyl methacrylate) |
| P-115 | Poly(3,3-dimethylbutyl methacrylate) |
| P-116 | Poly(3,3-dimethyl-2-butyl methacrylate) |
| P-117 | Poly(3,5,5-trimethylhexyl methacrylate) |
| P-118 | Poly(octadecyl methacrylate) |
| P-119 | Poly(tetradecyl methacrylate) |
| P-120 | Poly(4-butoxycarbonylphenyl methacrylamide) |
| P-121 | Poly(tert-butyl methacrylate) |
| P-122 | Poly(2-chloroethyl methacrylate) |
| P-123 | Poly(2-cyanoethyl methacrylate) |
| P-124 | Poly(2-cyanomethylphenyl methacrylate) |
| P-125 | Poly(4-cyanophenyl methacrylate) |
| P-126 | Poly(cyclohexyl methacrylate) |
| P-127 | Poly(dodecyl methacrylate) |
| P-128 | Poly(p-t-butylstyrene) |
| P-129 | n-Butyl methacrylate-methyl methacrylate-benzyl methacrylate copolymer (35:35:30) |
| P-130 | Poly-3-pentyl acrylate |
| P-131 | Cyclohexyl methacrylate-methyl methacrylate-n-propyl methacrylate copolymer (37:29:34) |
| P-132 | Polypentyl methacrylate |
| P-133 | Methyl methacrylate-n-butyl methacrylate copolymer (65:35) |

-continued

| Specific examples | Type of the polymer (Parenthesized numerals represent molar ratio) |
|---|---|
| P-134 | Vinyl acetate-vinyl propionate copolymer (75:25) |
| P-135 | Poly(butyl chloroacrylate) |
| P-136 | Poly(butyl cyanoacrylate) |
| P-137 | Poly(cyclohexyl choloroacrylate) |
| P-138 | Poly(ethyl chloroacrylate) |
| P-139 | Poly(4-carboxyphenyl methacrylamide) |
| P-140 | Poly(4-ethoxycarbonylphenyl methacrylamide) |
| P-141 | Poly(4-methoxycarbonylphenyl methacrylamide) |
| P-142 | 1,4-Butanediol-adipic acid polyester |
| P-143 | Ethylene glycol-sebacic acid polyester |
| P-144 | Polycaprolactone |

More preferred examples of the polymers of formula (I) include the following polymers. In the following formulae, the ratio of each component is expressed as a percentage by weight.

P-145~148

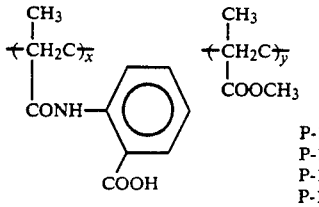

P-145 x/y = 10/90
P-146 x/y = 20/80
P-147 x/y = 30/70
P-148 x/y = 50/50

P-149, 150

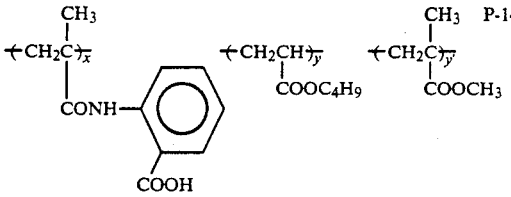

P-149 x/y/y' = 20/50/30
P-150 x/y/y' = 30/50/20

P-151

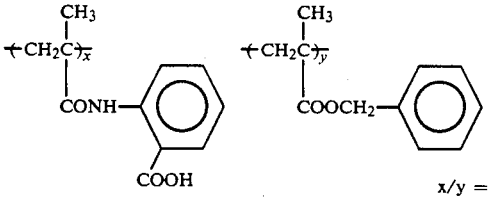

x/y = 35/65

P-152

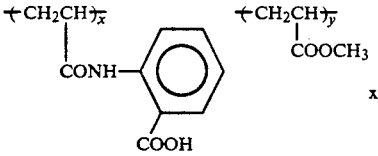

x/y = 30/70

P-153

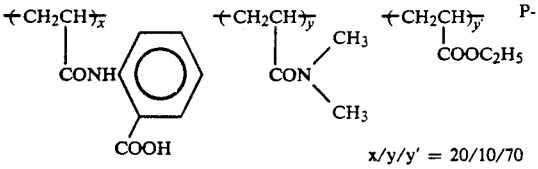

x/y/y' = 20/10/70

P-154

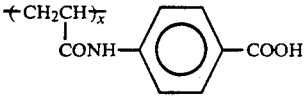

x/y = 20/80

-continued

P-155

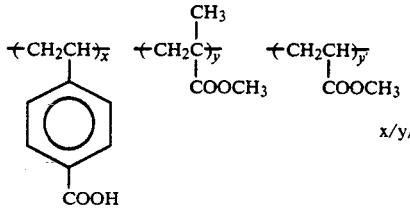

x/y/y' = 25/55/20

P-156

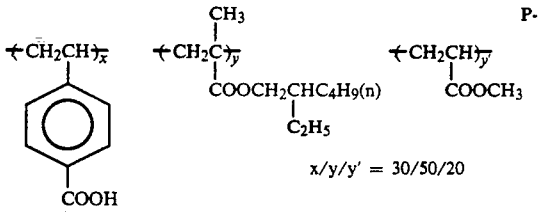

x/y/y' = 30/50/20

P-157, 158

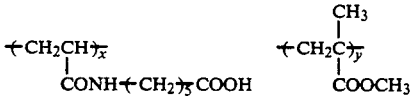

P-157 x/y = 15/85
P-158 x/y = 25/75

P-159

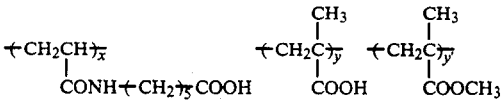

x/y/y' = 15/3/82

P-160, 161

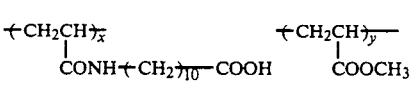

P-160 x/y = 50/50
P-161 x/y = 70/30

P-162, 163

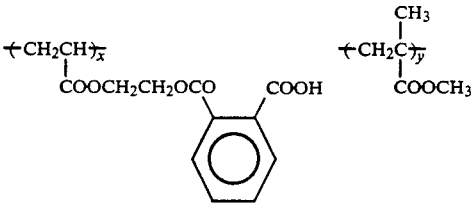

P-162 x/y = 20/80
P-163 x/y = 35/65

P-164

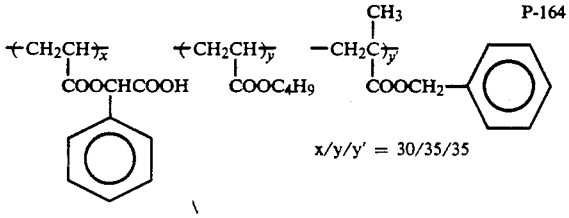

x/y/y' = 30/35/35

The above-described polymers of the present invention may be used either alone or in a combination of two or more thereof.

The dyes for use in the present invention may be conventional dyes. The structures of these dyes include arylidene compounds, heterocyclic arylidene compounds, anthraquinones, triarylmethanes, azomethine dyes, azo dyes, cyanine dyes, merocyanine dyes, oxonol dyes, styryl dyes, phthalocyanine dyes and indigo dyes. The dyes for use in the present invention are preferably water-insoluble and have a solubility of at least 10 g/l in ethyl acetate at 40° C. (i.e., oil-soluble dye). The structures of the chromophoric groups of these dyes are not critical.

The arylidene compounds are those where an acid nucleus and an aryl group are bonded to each other through one or more methine groups.

Examples of the acid nucleus include 2-pyrazoline-5-one, 2-isoxazoline-5-one, barbituric acid, 2-thiobarbituric acid, benzoylacetonitrile, cyanoacetamide, cyanoacetanilide, cyanoacetic esters, malonic esters, malondianilide, dimedone, benzoylacetanilide, pivaloylacetanilide, malononitrile, 1,2-dihydro-6-hydroxypyridine-2-one, pyrazolidine-3,5-dione, pyrazolo[3,4-b]pyridine-3,6-dione, indane-1,3-dione, hydantoin, thiohydantoin and 2,5-dihydrofuran-2-one.

The aryl group includes a phenyl group which is preferably substituted by one or more electron donative groups such as an alkoxy group, hydroxyl group and an amino group.

The heterocyclic arylidene compounds are those where an acid nucleus and a heterocyclic aromatic ring are bonded to each other through one or more methine groups.

Examples of the acid nucleus include those already described above.

Examples of the heterocyclic aromatic ring include pyrrole, indole, furan, thiophene and pyrazole.

The anthraquinones are compounds where anthraquinone is substituted by one or more electron donative groups or electron attractive groups.

The triarylmethanes are compounds where three substituted aryl groups (which may be the same or different) are attached to one methine group. An example thereof is phenolphthalein.

The azomethine dyes are compounds where an acid nucleus and an aryl group are bonded to each other through an unsaturated nitrogen containing bonding group (azomethine group). Examples of the acid nucleus include those known as photographic couplers in addition to those already described above. The indoaniline dyes belong to the azomethine dyes.

The azo dyes are compounds where aryl groups or heterocyclic aromatic ring groups are bonded to each other through an azo group.

The cyanine dyes are compounds where two basic nuclei are bonded to each other through one or more methine groups. Examples of the basic nuclei include quaternary salts of oxazole, benzoxazole, thiazole, benzthiazole, benzimidazole, quinoline, pyridine, indolenine, benzoindolenine, benzoselenazole and imidazoquinoxaline and pyrylium.

The merocyanine dyes are compounds where the basic nucleus and the acid nucleus are bonded to each other through either a double bond or one or more methine groups.

The oxonol dyes are compounds where two acid nuclei as described above are bonded to each other through one methine group or three or more methine groups in odd numbers.

The styryl dyes are compounds where the basic nucleus and the aryl group are bonded to each other through two or four methine groups.

Phthalocyanine may be coordinated with metal or may not be coordinated with a metal.

Indigo may be unsubstituted or substituted and includes thioindigo.

The dyes of the present invention must be decolorized and/or dissolved out (eluted) from the photographic material by photographic processing. Accordingly, the dyes preferably have a dissociable group. Carboxyl group and hydroxyl group are preferred as the dissociable group. Particularly preferred examples of the dissociable group include a sulfonamido group, a sulfamoyl group, an acylsulfamoyl group, a sulfonylcarbamoyl group and a sulfonimido group.

Preferred dyes for use in the present invention are represented by formula (II). The dyes of formula (II) are illustrated in more detail below.

X and Y each represents an electron attractive group. Examples of the electron attractive group include cyano group, nitro group, an alkoxycarbonyl group (e.g., methoxycarbonyl, ethoxycarbonyl, hydroxyethoxycarbonyl, t-amyloxycarbonyl), an aryloxycarbonyl group (e.g., phenoxycarbonyl, 4-methoxycarbonyl), an acyl group (e.g., acetyl, pivaloyl, benzoyl, propionyl, 4-methanesulfonamidobenzoyl, 4-methoxy-3-methanesulfonamidobenzoyl, 1-methylcyclopropylcarbonyl), carbamoyl group (e.g., N-ethylcarbamoyl, N,N-dimethylcarbamoyl, piperidihe-1-ylcarbonyl, N-(3-methanesulfonamidophenyl)carbamoyl) or a sulfonyl group (e.g., benzenesulfonyl, p-toluenesulfonyl). X and Y may be combined together to form an acid nucleus which is preferably a five-membered or six-membered ring. Preferred examples of the five-membered ring include 2-pyrazoline-5-one, 2-isoxazoline-5-one, pyrazolidine-3,5-dione, 2,5-dihydrofuran-2-one and indane-1,3-dione. Preferred examples of the six-membered ring include 1,2-dihydro-6-hydroxypyridine-2-one, barbituric acid and thiobarbituric acid.

The phenyl group represented by Ar is preferably an electron donative group-substituted phenyl group. Preferred examples of the electron donative group include a dialkylamino group (e.g., dimethylamino, di(ethoxycarbonylmethyl)amino, di(butoxycarbonylmethyl)amino, N-ethyl-N-ethoxycarbonylmethylamino, di(cyanoethyl)amino, piperidinyl, pyrrolidinyl, morpholine, N-ethyl-N-β-methanesulfonamidoethylamino, N-ethyl-N-βhydroxyethylamino), hydroxyl group and an alkoxy group (e.g., methoxy, ethoxy, ethoxycarbonylmethoxy).

The heterocyclic group represented by Ar is preferably a five-membered heterocyclic ring. Particularly preferred are pyrrole, indole, furan and thiophene.

The methine group represented by $L^1$, $L^2$ and $L^3$ may be unsubstituted or substituted, but an unsubstituted methine group is preferable.

Particularly preferred dyes for use in the present invention are represented by the following formula (III).

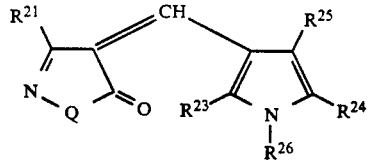

(III)

The dyes of formula (III) are illustrated in detail below.

The alkyl group represented by $R^{21}$ is preferably an alkyl group having 1 to 8 carbon atoms. Examples thereof include methyl, ethyl, propyl, t-butyl, n-butyl, 1-methylcyclopropyl, chloromethyl, trifluoromethyl and ethoxycarbonylmethyl.

The aryl group represented by $R^{21}$ is preferably an aryl group having 6 to 13 carbon atoms. Examples thereof include phenyl, 4-methoxyphenyl, 4-acetylaminophenyl, 4-methanesulfonamidophenyl, 4-benzenesulfon and amidophenyl.

The alkyl group represented by $R^{22}$ is preferably an alkyl group having 1 to 18 carbon atoms. Examples thereof include methyl, 2-cyanoethyl, 2-hydroxyethyl and 2-acetoxyethyl.

The aryl group represented by $R^{22}$ is preferably an aryl group having 6 to 22 carbon atoms. Examples thereof include phenyl, 2-methoxy-5-ethoxycarbonylphenyl, 3,5-di(ethoxycarbonyl)phenyl, 4-di(ethoxycarbonylmethyl)aminocarbonylphenyl, 4-butanesulfonamidocarbonylphenyl, 4-methanesulfonamidocarbonylphenyl, 3-sulfamoylphenyl, 4-methanesulfonamidophenyl, 4-methanesulfonamidosulfonylphenyl, 4-acetylsulfamoylphenyl, 4-propionylsulfamoylphenyl and 4-N-ethylcarbamoylsulfamoylphenyl.

Examples of the heterocyclic group represented by $R^{22}$ include pyridyl, 4-hydroxy-6-methylpyrimidine-2-yl, 4-hydroxy-6-t-butylpyrimidine-2-yl and sulfolane-3-yl.

The alkyl group represented by $R^{23}$, $R^{24}$ and $R^{25}$ is preferably an alkyl group having 1 to 6 carbon atoms. Examples thereof include methyl, ethyl and propyl with methyl being particularly preferred.

The aryl group represented by $R^{23}$, $R^{24}$ and $R^{25}$ is preferably an aryl group having 6 to 13 carbon atoms with phenyl group being particularly preferred.

The six-membered ring formed by $R^{24}$ and $R^{25}$ may be any of a saturated ring, an unsaturated ring and a heterocyclic ring. However, benzene ring is particularly preferred.

The alkyl group represented by $R^{26}$ is preferably an alkyl group having 1 to 18 carbon atoms. Examples thereof include methyl, ethyl, ethoxycarbonylmethyl, t-butoxycarbonylmethyl, ethoxycarbonylethyl, dimethylaminomethyl, 2-cyanoethyl, 3-acetamidopropyl, 3-propionylaminopropyl, 3-benzenesulfonamidopropyl and 3-propanesulfonamidopropyl.

The aryl group represented by $R^{26}$ is preferably an aryl group having 6 to 22 carbon atoms. Examples thereof include phenyl, 2-methoxy-5-ethoxycarbonylphenyl, 4-di(ethoxycarbonylmethyl)aminocarbonylphenyl, 4-n-octyloxycarbonylphenyl, 4-hydroxyethoxycarbonylphenyl, 4-propanesulfonamidophenyl, 4-butanesulfonamidocarbonylphenyl, 4-methanesulfonamidocarbonylphenyl, 4-acetylsulfamoylphenyl and 4-methanesulfonamidophenyl.

The amino group represented by $R^{26}$ is preferably a dialkylamino group. Examples thereof include dimethylamino and diethylamino.

The alkyl group represented by $R^{27}$ and $R^{28}$ is preferably an alkyl group having 1 to 12 carbon atoms. Examples thereof include methyl, ethyl, octyl, dodecyl, cyclohexyl, ethoxycarbonylmethyl, ethoxycarbonylethyl, 2-hydroxyethyl, 2-ethoxyethyl, 2-methanesulfonamidoethyl, ethyl, cyanoethyl, 2,2,3,3-tetrafluoropropyl, chloroethyl, bromoethyl, acetoxyethyl and dimethylaminoethyl.

The aryl group represented by $R^{27}$ and $R^{28}$ is preferably an aryl group having 6 to 12 carbon atoms. Examples thereof include phenyl, 4-methoxyphenyl and 3-methylphenyl.

The compounds of formula (III) preferably do not have any of a sulfo group, sulfonate group and carboxylate group.

The compounds of formula (III) preferably have a dissociable group other than the above-described sulfo, sulfonate and carboxylate groups. Preferred examples of the dissociable group include a sulfonamido group, a sulfamoyl group, an acylsulfamoyl group, a sulfonylcarbamoyl group, a sulfonimido group, a carbamoylsulfamoyl group and carboxyl group.

Examples of the dyes for use in the present invention include, but are not limited to, the following compounds.

D-1

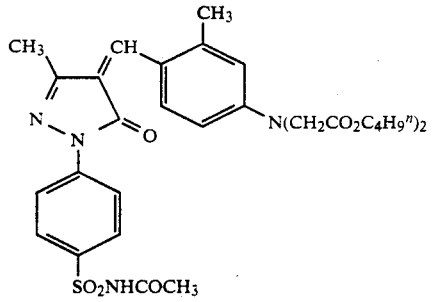

D-2

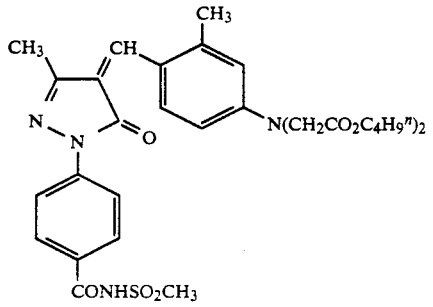

-continued
D-3
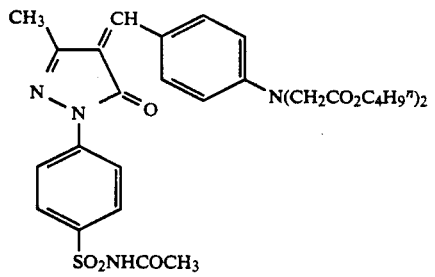
D-4
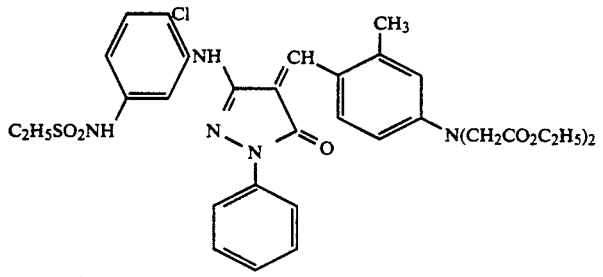
D-5
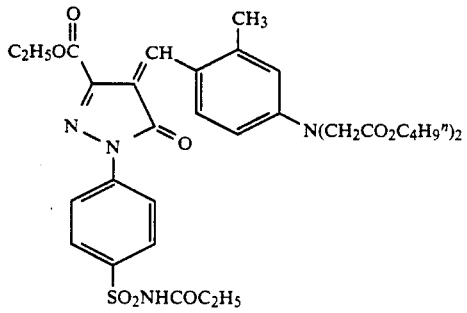
D-6
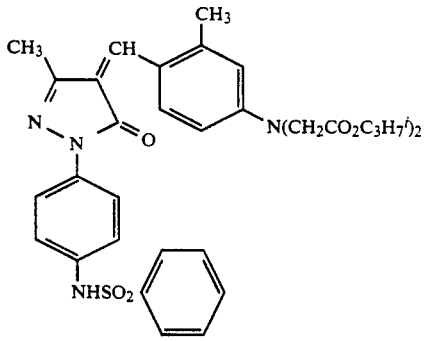
D-7
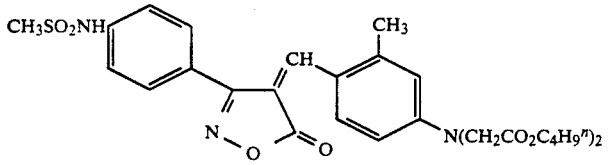
D-8
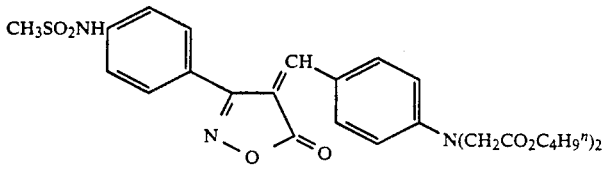

-continued
D-9
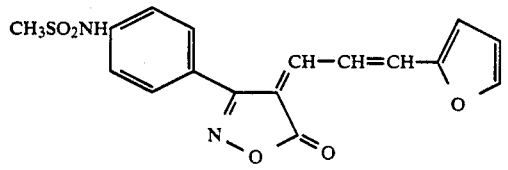
D-10
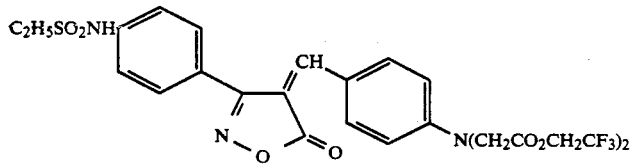
D-11
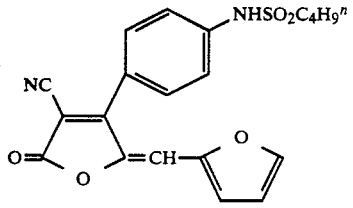
D-12
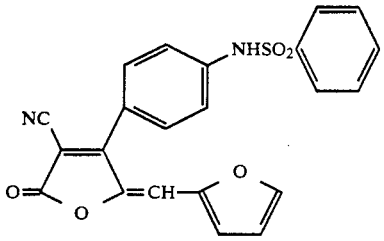
D-13
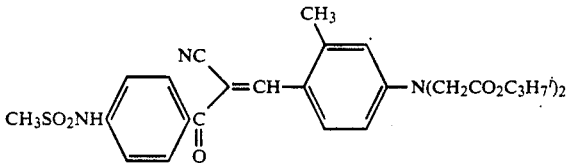
D-14
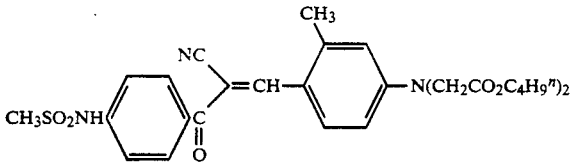
D-15
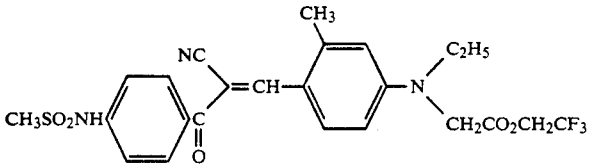
D-16
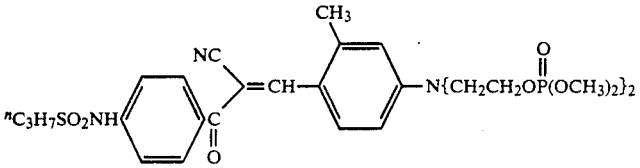

-continued
D-17
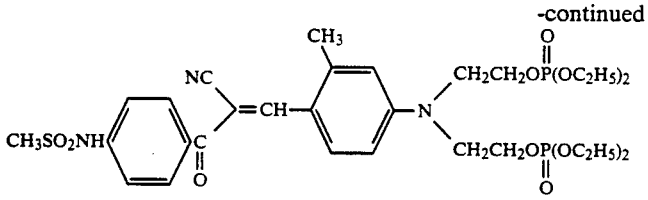
D-18
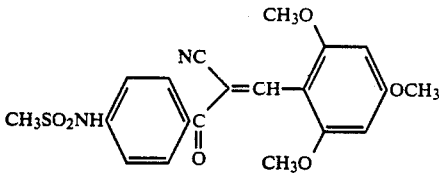
D-19
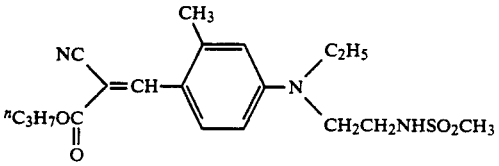
D-20
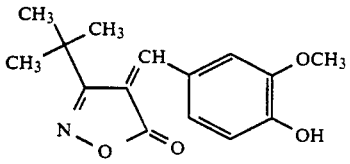
D-21
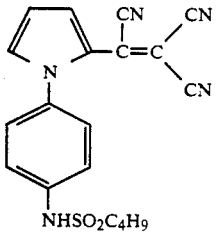
D-22
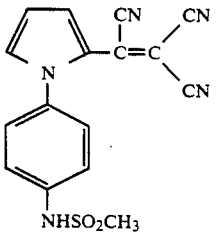
D-23
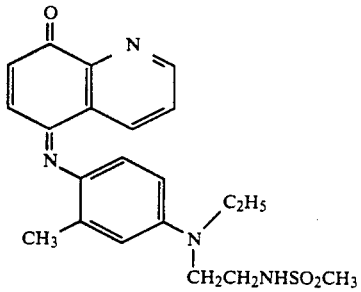
D-24
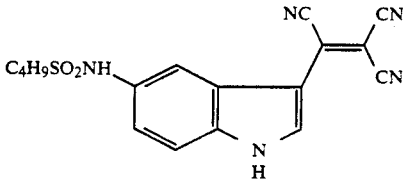

-continued
D-25
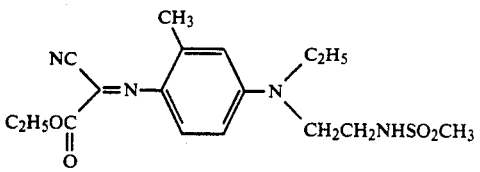
D-26
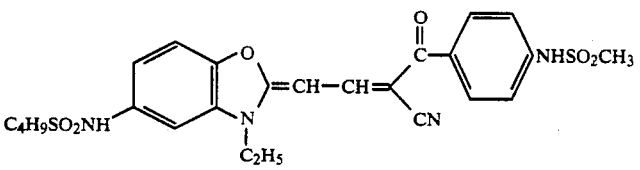
D-27
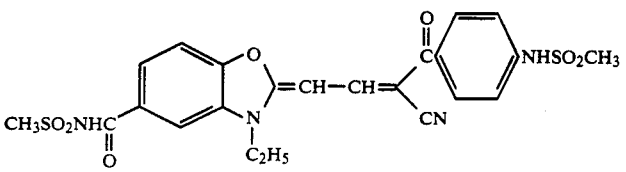
D-28
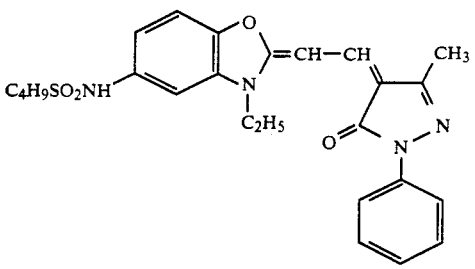
D-29
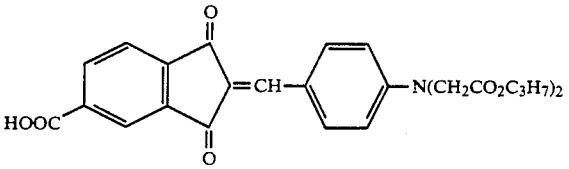
D-30
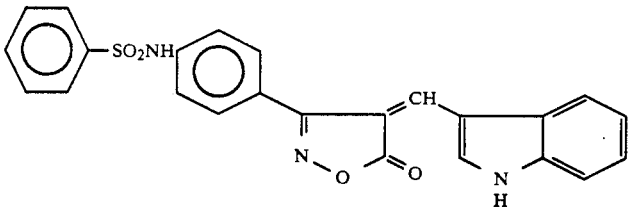
D-31
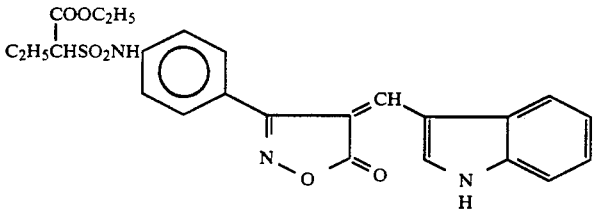
D-32
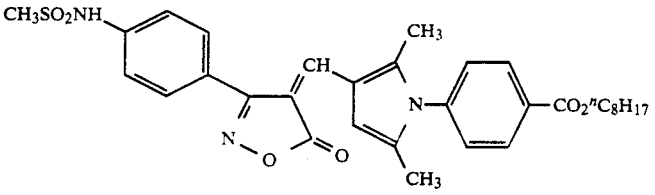

-continued
D-33
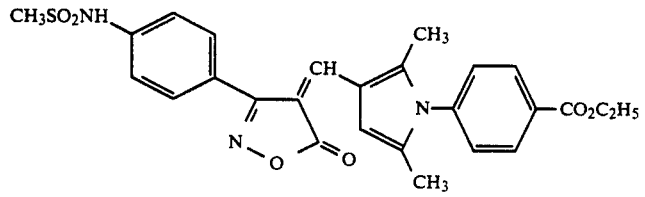
D-34
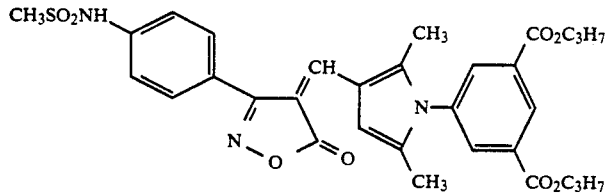
D-35
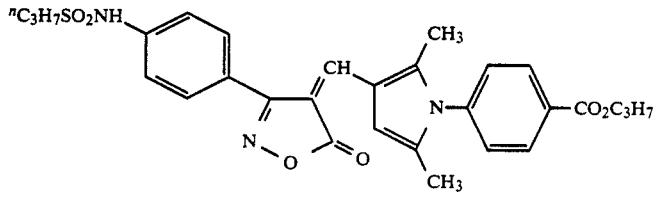
D-36
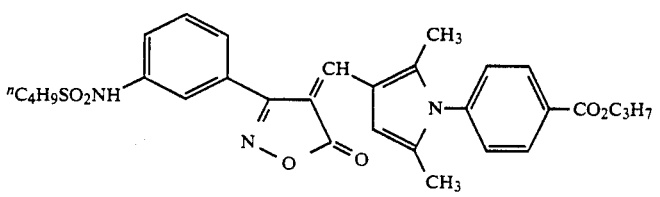
D-37
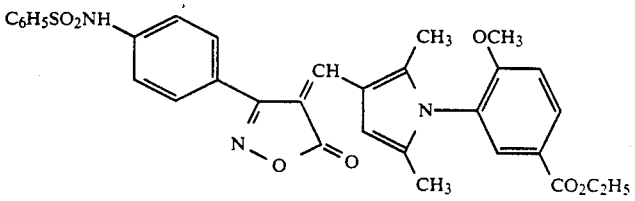
D-38
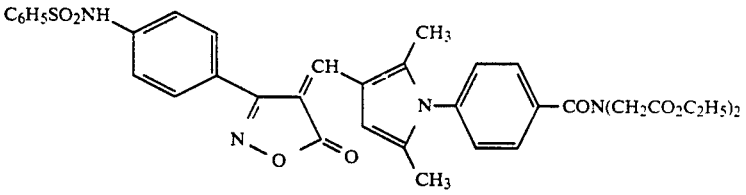
D-39
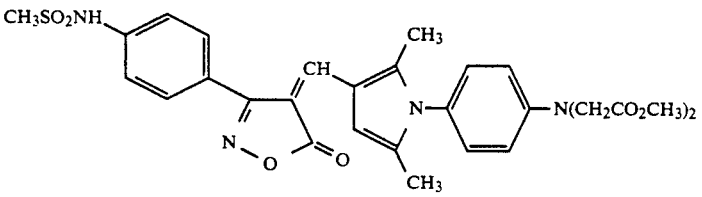
D-40
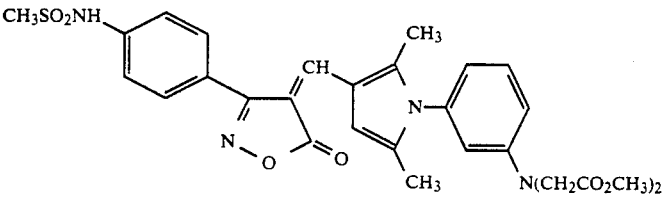

-continued
D-41
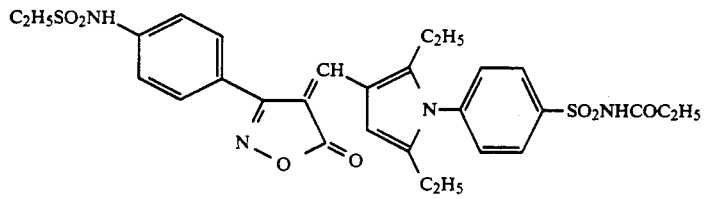
D-42
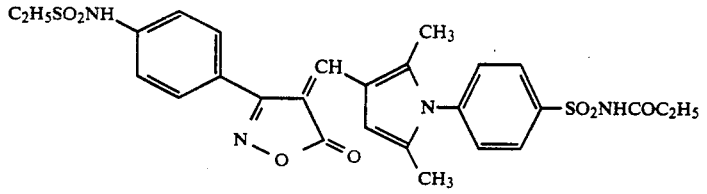
D-43
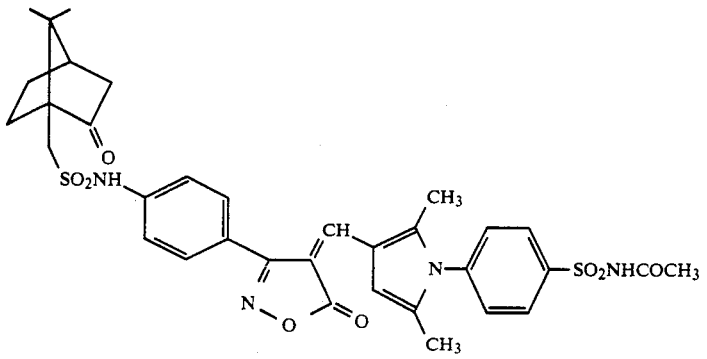
D-44
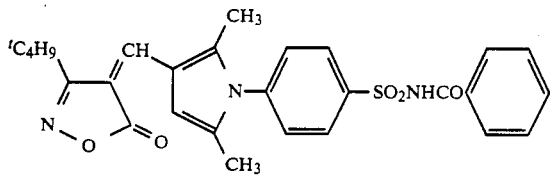
D-45
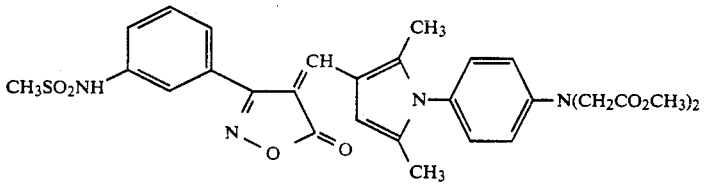
D-46
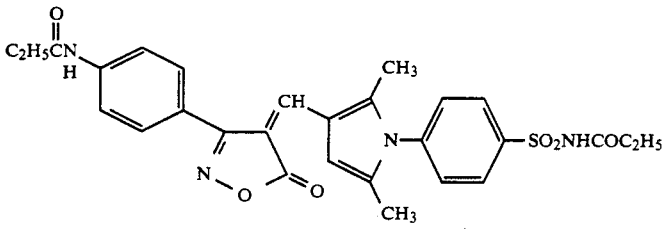
D-47
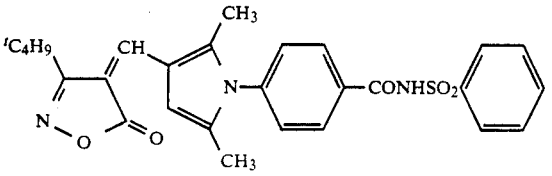

-continued
D-48
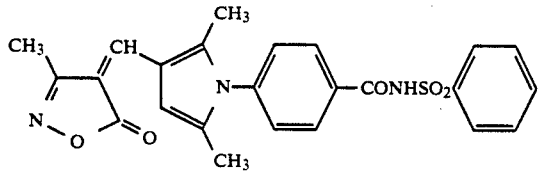
D-49
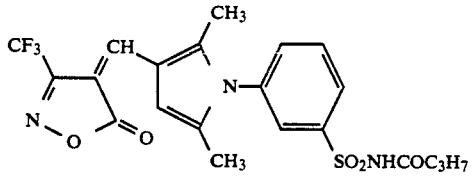
D-50
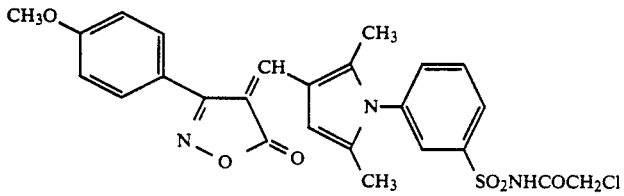
D-51
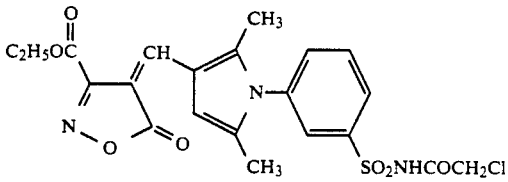
D-52
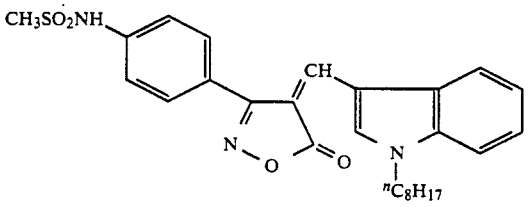
D-53
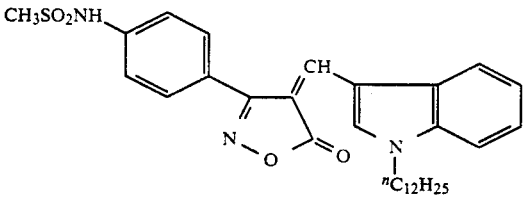
D-54
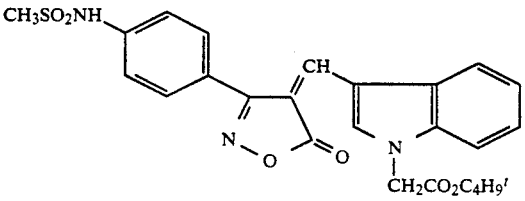
D-55
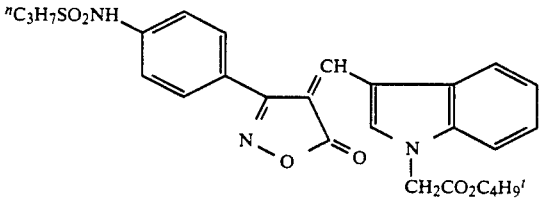

-continued
D-56
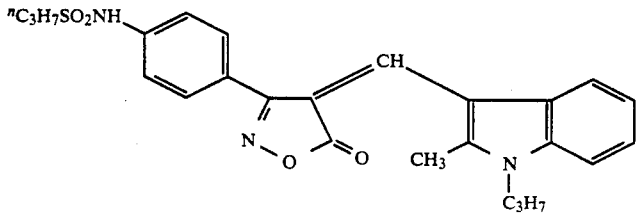
D-57
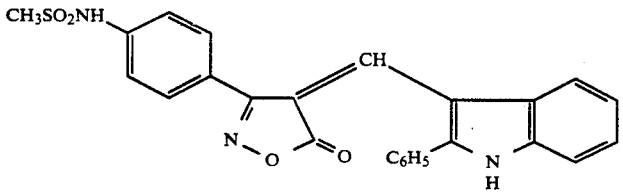
D-58
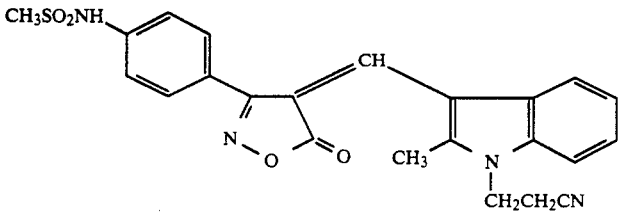
D-59
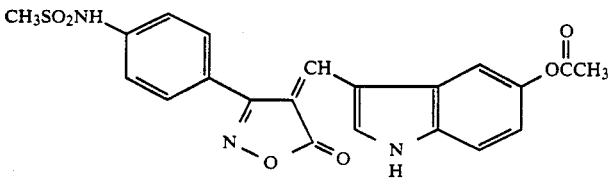
D-60
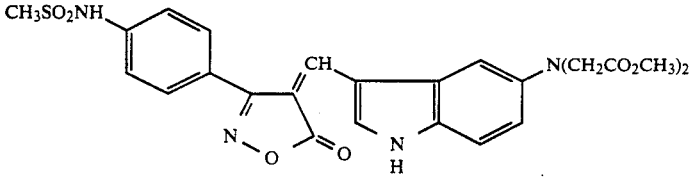
D-61
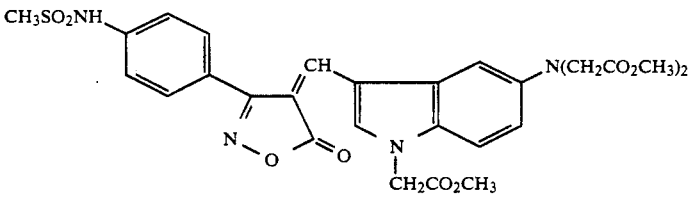
D-62
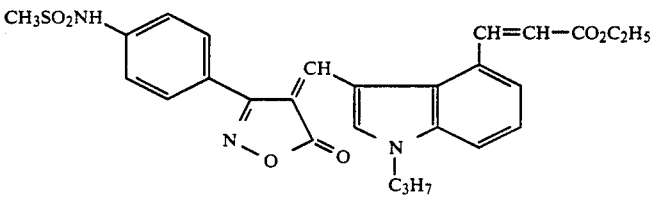
D-63
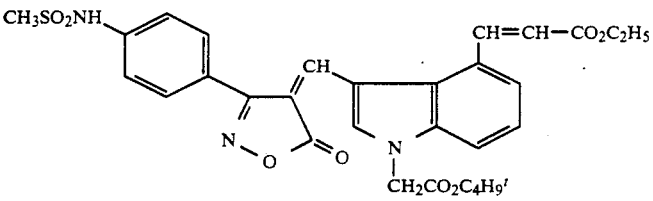

-continued
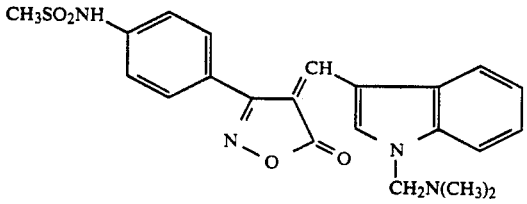
D-64
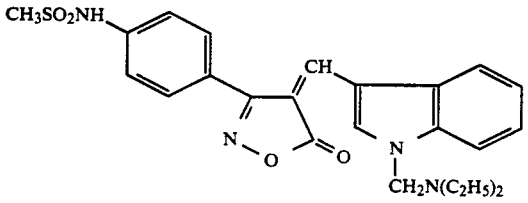
D-65
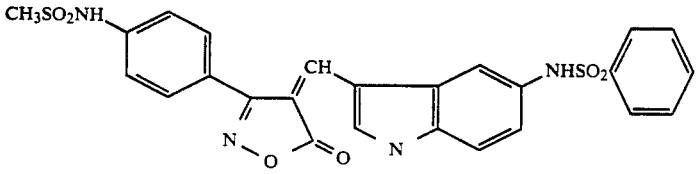
D-66
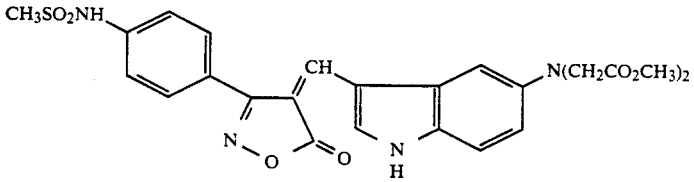
D-67
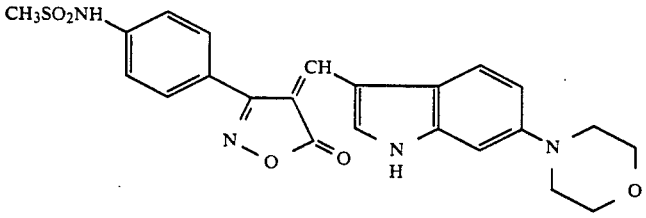
D-68
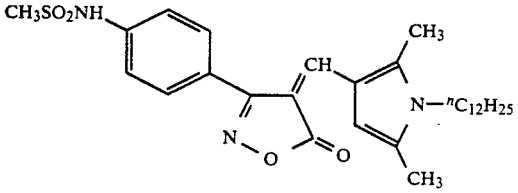
D-69
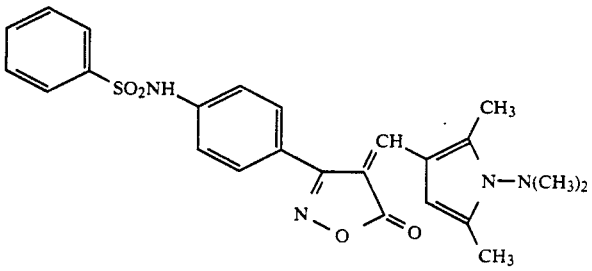
D-70

-continued
D-71
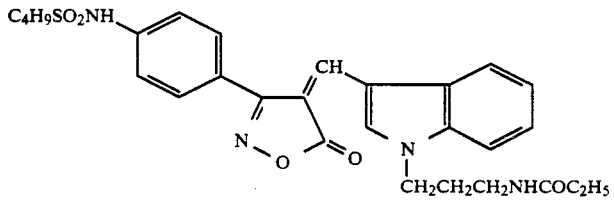
D-72
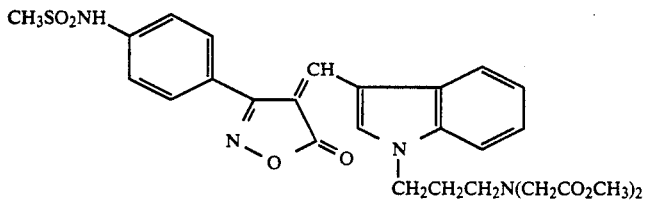
D-73
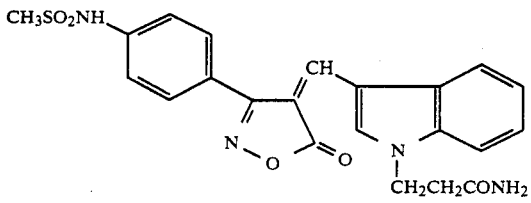
D-74
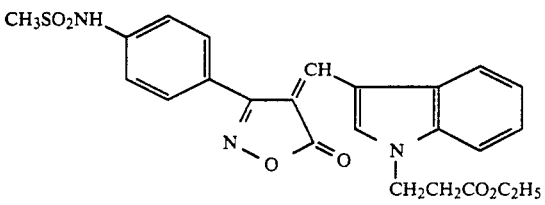
D-75
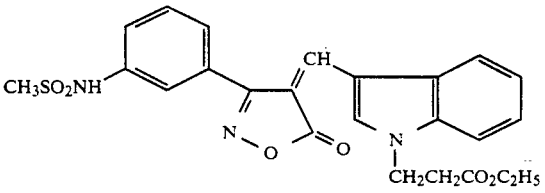
D-76
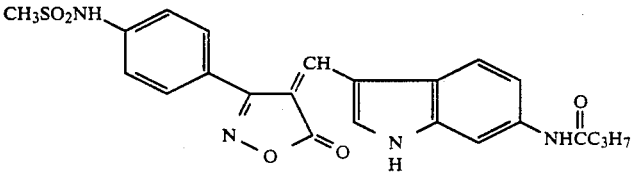
D-77
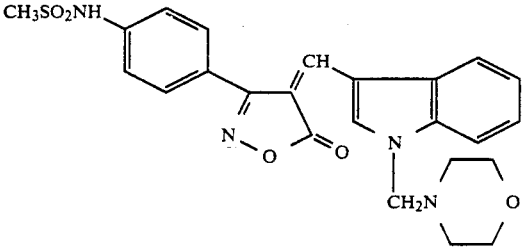

-continued
D-78
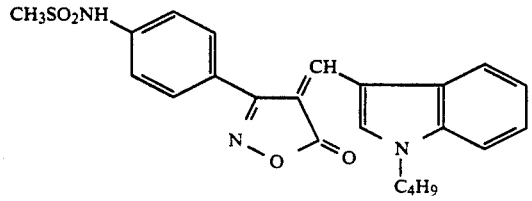
D-79
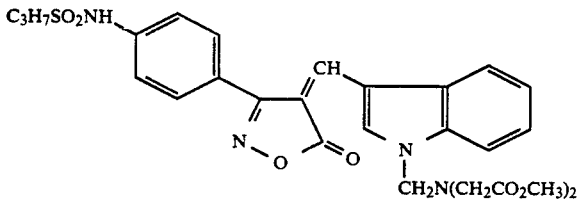
D-80
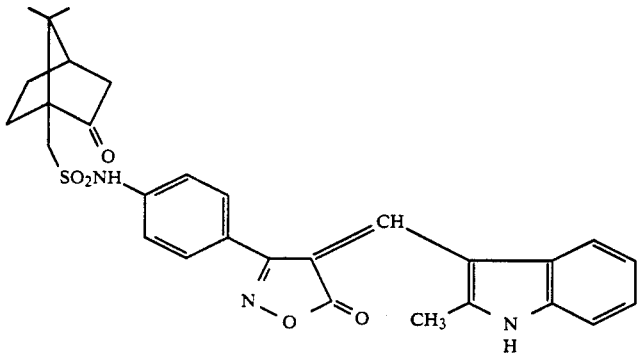
D-81
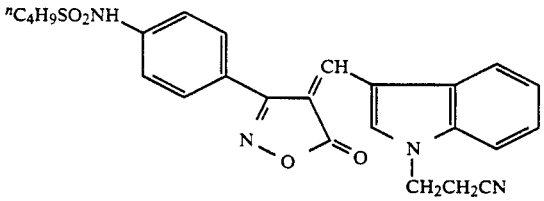
D-82
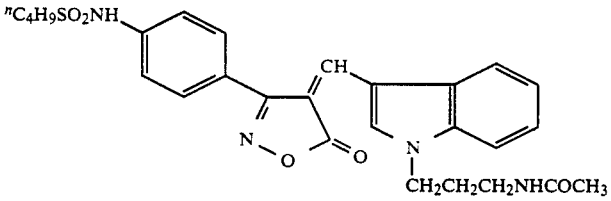
D-83
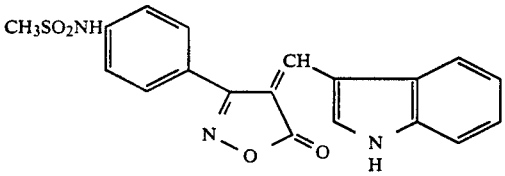
D-84
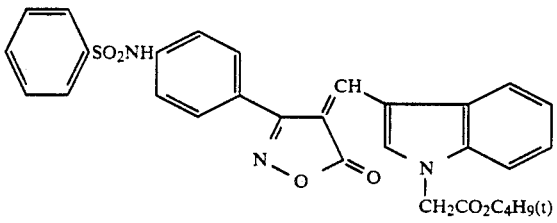

-continued
D-85
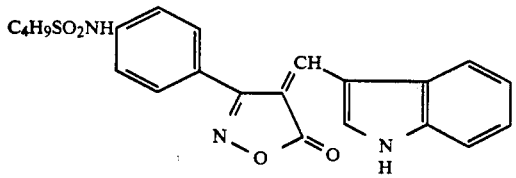
D-86
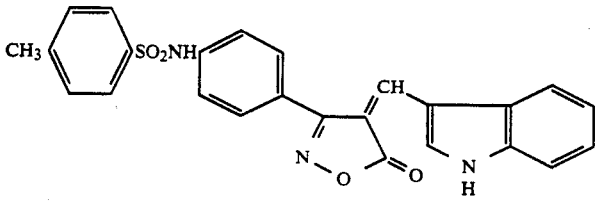
D-87
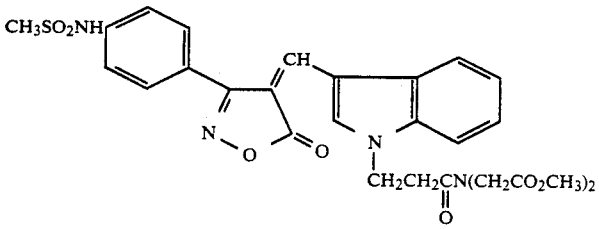
D-88
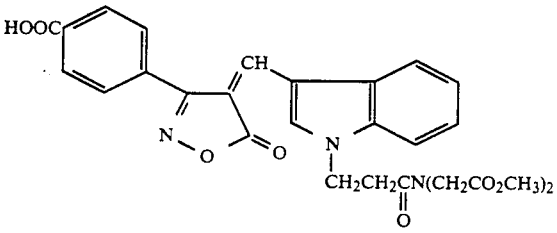
D-89
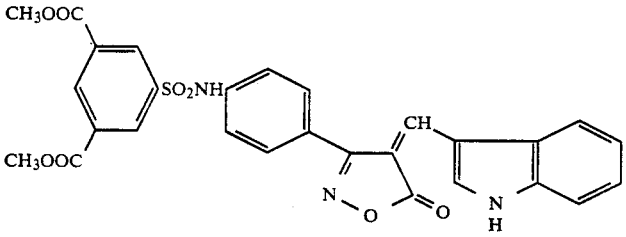
D-90
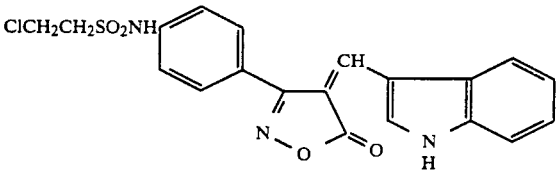
D-91
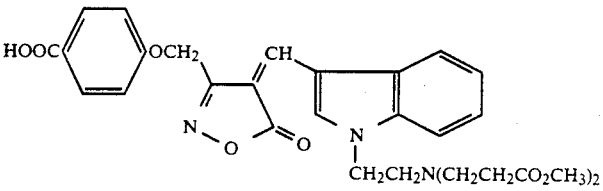

-continued

D-92

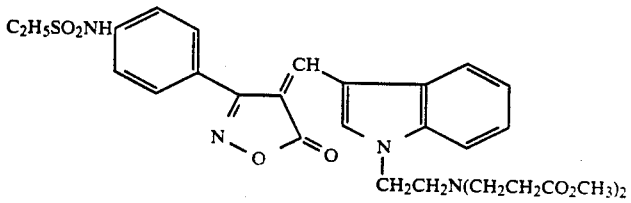

D-93

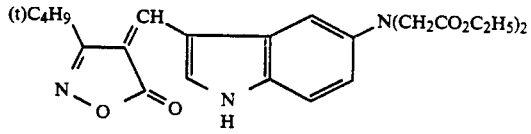

D-94

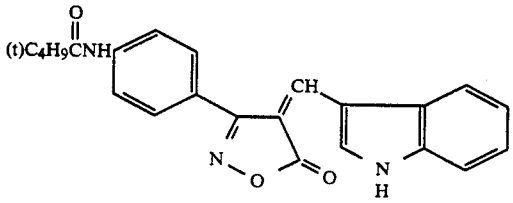

D-95

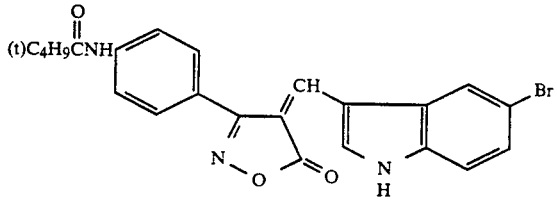

D-96

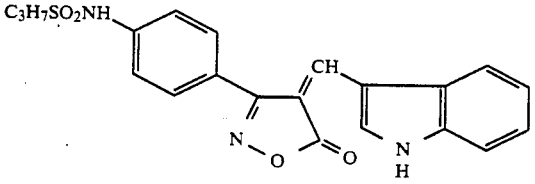

When the oil-soluble dyes are used as filter dyes or antihalation dyes, an amount effective for these purposes may be used, but it is generally preferred that the dyes are used in such an amount as to provide an optical density of the fifth layer or antihalation layer of 0.05 to 3.5. The dyes may be added at any stage before coating to obtain a coating liquid containing the dispersion of an oil-soluble dye and a water-insoluble, organic solvent soluble polymer of the present invention.

The coverage of the dye varies depending on the type of dye, dispersing polymer and dispersion method, but is generally in the range of preferably $10^{-3}$ to 3.0 g/m$^2$, particularly preferably $10^{-3}$ to 1.0 g/m$^2$ per a hydrophilic colloid layer containing the dye dispersion of the present invention.

The dye dispersion of the present invention may be incorporated in any hydrophilic colloid layer of the photographic material depending on the intended purpose. Namely, the dye dispersion may be added to an undercoat layer, an antihalation layer disposed between a silver halide emulsion layer and the support, a silver halide emulsion layer, a color forming layer, an interlayer, a protective layer, a back layer on the side of the support opposite to the silver halide emulsion layer, and a hydrophilic colloid in another auxiliary layer. If desired, the dye dispersion may be added to one layer or two or more layers. Two or more dispersions may be separately added to one layer or two or more layers, or a mixture thereof may be added to one layer or two or more layers.

The dispersion of the present invention may be optionally used in combination with other various water-soluble dyes, water-soluble dyes adsorbed onto mordants, fine particles of solid disperse dyes or disperse dyes prepared by other methods than the method of the present invention.

The dyes of the present invention are used as a dispersion in a water-insoluble, organic solvent-soluble polymer. The dispersion can be prepared in the following manner.

The dye of the present invention is dissolved in a solution of the polymer dissolved in a co-solvent (organic solvent), and then the resulting solution is emulsified and dispersed or, after being mixed with a hydrophilic colloid solution, is emulsified and dispersed. The latter method is preferred, that is, the dispersion of the present invention is preferably prepared by mixing a solution of the oil-soluble dye and the polymer with a hydrophilic colloid solution, followed by emulsifying and dispersing.

Examples of the co-solvent include acetates of a lower alcohol such as ethyl acetate and butyl acetate, ethyl propionate, secondary butyl alcohol, methylethylketone, methylisobutylketone, β-ethoxyethylacetate, methycellosolve acetate, methylcarbitol acetate, methylcarbitol propionate, and cyclohexanone.

If desire, an organic solvent which is miscible to water adequately, such as methyl alcohol, ethyl alcohol, acetone, and tetrahydrofuran, may be used in combination with the co-solvent.

These organic solvents may be used in combination of two or more.

The hydrophilic colloid used for the hydrophilic colloid solution is preferably gelatin but other hydrphilic colloids may be used. Examples of other hydrophilic colloids include proteins such as gelatin derivatives, graft polymers of gelatin with other polymers, albumin, and casein; cellulose derivatives such as hydroxyethyl cellulose, carboxymethyl cellulose, and cellulose sulfate; sugar derivatives such as sodium alginate and starch; synthetic hydrophilic high molecular substances such as homopolymers or copolymers polyvinyl alcohol, partial acetal containing polyvnyl alcohol, poly-N-vinylpyrrolidone, polyacrylic acid, polymethacrylic acid, polyacrylamide, polyvinylimidazole and polyvinylpyrazole.

Gelatin used for the hydrophilic colloid solution includes lime-treated gelatin, acid-treated gelatin, enzyme-treated gelatin as described in *Bull. Soc. Sci. Photo.*, Japan, No. 16, page 30 (1966), hydrolyzed gelatin and enzyme-decomposed gelatin.

The preferred concentration of the hydrophilic colloid in the hydrophilic colloid solution is approximately from 1 to 20 wt%.

If desired, a high-boiling organic solvent may be used in preparation of the dispersion to control dispersibility of the dye of the present invention, spectral absorption characteristics or coatability.

The ratio of the high-boiling organic solvent to the polymer varies depending on the intended purpose, but is preferably not higher than 2.0.

Examples of the high-boiling organic solvent are described in U.S. Pat. No. 2,322,027. Specific examples of the high-boiling organic solvent include alkyl phthalates (e.g., dibutyl phthalate, dioctyl phthalate), phosphoric ester (e.g., diphenyl phosphate, triphenyl phosphate, tricresyl phosphate, dioctyl butyl phosphate), citric esters (e.g., tributyl acetylcitrate), benzoic esters (e.g., octyl benzoate), alkylamides (e.g., diethyllaurylamide), fatty acid esters (e.g., dibutoxyethyl succinate, diethyl azelate) and trimesic acid esters (e.g., tributyl trimesate).

A typical example of the hydrophilic colloid is gelatin. However, any hydrophilic colloid conventionally used in the photographic field can be used.

The dye dispersion of the present invention can be applied to all types of photographic materials. Examples of the photographic materials include black-and-white light-sensitive materials such as black-and-white films, X-ray films, films for plate making, black-and-white photographic paper and microfilms and color light-sensitive materials such as negative color films, reversal color films, positive color films, color photographic paper and reversal color photographic paper.

Conventional sensitive materials can be used in the photographic materials containing light-sensitive silver halide emulsion layers in the present invention as mentioned above. Silver halide emulsions conventionally used in the photographic field can be applied to the present invention. For example, light-sensitive materials and silver halide emulsions described in JP-A-3-13936 and JP-A-3-13937 can be applied to the present invention. More specifically, silver halide emulsions found in the description "silver halide grains used in the present invention . . . " at line 8 of right lower column of page 8 to line 9 of left upper column of page of JP-A-3-13936, light-sensitive materials containing the same, supports, processing methods and exposure methods described therein can be applied to the present invention.

Preferred silver halide emulsions for use in the present invention are silver bromide, silver iodobromide, silver iodochlorobromide, silver chlorobromide and silver chloride.

The light-sensitive material of the present invention may comprise a support having thereon at least one each of a blue-sensitive, a green-sensitive, and a red-sensitive silver halide emulsion layer. There is no particular limitation with regard to the number of silver halide emulsion layers and non-sensitive layers and the order of the layers. A typical example thereof is a silver halide photographic material comprising a support having thereon at least one light-sensitive unit layer comprising a plurality of silver halide emulsion layers having substantially the same color sensitivity, but different light sensitivity. The unit light-sensitive layer has a color sensitivity to any one of blue light, green light and red light. In a multilayer silver halide color. photographic material, the arrangement from the support side is generally in the order of a red-sensitive layer, a green-sensitive layer and a blue-sensitive layer from the support side. However, the arrangement may be in the reverse order to that described above depending on the intended purpose. Between light-sensitive layers having the same color sensitivity may be provided a light-sensitive layer having a different color sensitivity.

Various non-sensitive layers such as interlayers may be interposed between the silver halide light-sensitive layers, or may be provided as the uppermost layer or the lowermost layer.

The interlayers may contain couplers and DIR compounds as described in JP-A-61-43748, JP-A-59-113438, JP-A-59-113440, JP-A-61-20037 and JP-A-61-20038, and may contain conventional color mixing inhibitors.

Each unit light-sensitive layer comprising a plurality of silver halide emulsion layers preferably has a two-layer structure composed of a high-sensitive emulsion layer and a low-sensitive emulsion layer as described in West German Patent 1,121,470 or U.K. Patent 923,045. The light-sensitive layers are preferably arranged such that the light sensitivity is progressively lowered toward the support. A non-sensitive layer may be provided between the silver halide emulsions layers. Furthermore, the low-sensitivity layer may be provided farther away from the support than the high-sensitivity emulsion layer as described in JP-A-57-112751, JP-A-62-200350, JP-A-62-206541 and JP-A-62-206543.

For example, the arrangement may be in the order of a low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), in the order of BH/BL/GL/GH/RH/RL or in order of BH/BL/GH/GL/RL/RH, where the first named layer is arranged farthest from the support.

Furthermore, the arrangement may be in the order of a blue-sensitive layer/GH/RH/GL/RL where BL is farthest away from the support as described in JP-B-55-34932, or the arrangement may be in the order of a blue-sensitive layer/GL/RL/GH/RH where BL is farthest away from the support as described in JP-A-56-25738 and JP-A-62-63936.

Furthermore, a three layer structure may be used composed of three layers having different light sensitivities, wherein the layers are arranged so that the light sensitivity thereof is lowered toward the support. Thus, the upper layer is a silver halide emulsion layer having the highest light sensitivity, the intermediate layer is a silver halide emulsion layer having light sensitivity lower than that of the upper layer, and the lower layer is a silver halide emulsion layer having light sensitivity lower than that of the intermediate layer as described in JP-B-49-15495. In the case of the three-layer structure composed of three layers having different light sensitivities, the arrangement of layers having the same color sensitivity may also be in the order of an intermediate-sensitivity emulsion layer/high-sensitivity emulsion layer/low-sensitivity emulsion layer, wherein the first named layer is farther away from the support as described in JP-A-59-202464.

Furthermore, the layers may be arranged in the order of high-sensitivity emulsion layer/low-sensitivity emulsion layer/intermediate-sensitivity emulsion layer or in order of low-sensitivity emulsion layer/intermediate-sensitivity emulsion layer/high-sensitivity emulsion layer. In the case of a four-layer or greater structure, various arrangements may be employed as described above.

A donor layer (CL) (as described in U.S. Pat. Nos. 4,663,271, 4,705,744 and 4,707,436, JP-A-62-160448 and JP-A-63-89850) having an interlayer effect and a spectral sensitivity distribution different from that of main light-sensitive layers such as BL, GL or RL is preferably provided adjacent to or in the vicinity of the main light-sensitive layers.

As described above, various layer structures and arrangements can be appropriately selected depending on the intended purpose of the light-sensitive material.

Preferred silver halides contained in the photographic emulsion layers of the photographic materials of the present invention are silver iodobromide, silver iodochloride and silver iodochlorobromide, each having a silver iodide content of not higher than about 30 mol%. Particularly preferred is silver iodobromide or silver iodochlorobromide having a silver iodide content of about 2 to about 10 mol%.

Silver halide grains in the photographic emulsions may have a regular crystal form such as a cubic, octahedral or tetradecahedral form, an irregular crystal form such as a spherical or platy form, a crystal form having a crystal defect such as a twinning plane, or a composite form of these crystal forms.

With regard to the grain size, the silver halide grains may range from fine grains having a grain size of not larger than about 0.2 μm to large-size grains having a projected area diameter of about 10 μm. Any of a polydisperse emulsion and monodisperse emulsion can be used.

The silver halide photographic emulsions of the present invention can be prepared, for example, by the methods described in *Research Disclosure* (RD) No. 17643 (December 1978), pages 22 to 23, "I. Emulsion Preparation and Types"; *Research Disclosure* No. 18716 (November 1979), page 648; *Research Disclosure* No. 307105 (November 1989), pages 863 to 865; P. Glafkides, *Chemie et Phisique Photographique*, (Paul Montel 1987); G. F. Duffin, *Photographic Emulsion Chemistry* (Focal Press 1966); and V. L. Zelikman et al., *Making and Coating Photographic Emulsion* (Focal Press 1964).

The monodisperse emulsions described in U.S. Pat. Nos. 3,574,628 and 3,655,394 and U. K. Patent 1,413,748 are preferably used.

Tabular grains having an aspect ratio of not lower than about 3 can also be used in the present invention. The tabular grains are easily prepared by the methods described in Gutoff, *Photographic Science and Engineering*, Vol. 14, pages 248 to 257 (1970), U.S. Pat. Nos. 4,434,226, 4,414,310, 4,433,048 and 4,439,520 and U. K. Patent 2,112,157.

The crystal structure of the individual grains may be uniform, or the individual grains may have a halogen composition which differs between the interior of the grain and the surface layer thereof, or may have a laminar structure. The grain may be bonded to a silver halide grain having a different composition by an epitaxial junction. The grain may be joined to compounds other than silver halide, such as silver rhodanide or lead oxide. A mixture of grains having various crystal forms may be used.

The above-described emulsions may be any of a surface latent image type wherein a latent image is predominantly formed on the surface of the grain, an internal latent image type wherein a latent image is predominantly formed in the interior of the grain, and a type wherein a latent image is formed on the surface of the grain as well as in the interior thereof. However, the emulsions must be a negative working type. The internal latent image type emulsions may be a core/shell type internal latent image type as described in JP-A-63-264740. A method for preparing the core/shell type internal latent image type emulsions is described in JP-A-59-133542. The thickness of the shell of the core/shell type grain varies depending on development conditions, but is preferably 3 to 40 nm, particularly preferably 5 to 20 nm.

The silver halide emulsions are usually subjected to chemical ripening, physical ripening and spectral sensitization. Additives for use in these stages are described in *Research Disclosure* No. 17643, ibid. No. 18716 and ibid. No. 307105, and specifically summarized in the Table described hereinafter.

A mixture of two or more sensitive silver halide emulsions differing in at least one of grain size, grain size distribution, silver halide composition, grain form and sensitivity, may be added to the same layer of the light-sensitive material of the present invention.

Silver halide grains wherein the surfaces of the grains are fogged as described in U.S. Pat. No. 4,082,553, silver halide grains wherein the interiors of the grains are fogged as described in U.S. Pat. No. 4,626,498 and JP-A-59-214852, and colloidal silver are preferably used in the light-sensitive silver halide emulsion layers and/or substantially non-sensitive hydrophilic colloid layers. The term "silver halide grains wherein the interiors or surfaces of the grains are fogged" as used herein refers to silver halide grains which can be uniformly (non-imagewise) developed independent of the unexposed area and exposed area of the light-sensitive material. Methods for preparing the silver halide grains wherein the interiors or surfaces of the grains are fogged are described in U.S. Pat. No. 4,626,498 and JP-A-59-214852.

Silver halides which form the internal nuclei of the core/shell type silver halide grains wherein the interiors of the grains are fogged, may have a halogen composition which is the same or different than that of the shells. Silver halide wherein the interiors or surfaces of the grains are fogged may be any of silver chloride, silver chlorobromide, silver iodobromide and silver chloroiodobromide. The average grain size of these fogged silver halide grains is preferably 0.01 to 0.75 μm, particularly preferably 0.05 to 0.6 μm, although there is no particular limitation with regard to the grain size of the silver halide grains. Furthermore, there is no particular limitation with regard to grain form. The grains may have a regular crystal form, and a polydisperse emulsion may be used. However, monodisperse emulsions (at least 95% (in terms of weight or the number of grains) of silver halide grains have a grain size of within ±40% of the mean grain size) are preferred.

Fine grains of non-sensitive silver halide are preferably used in the present invention. The term "fine grains of non-sensitive silver halide" as used herein refers to fine silver halide grains which are not sensitive to light during imagewise exposure for obtaining a dye image, and which grains are substantially not developed during development processing. The fine grains of non-sensitive silver halide preferably have not previously been fogged.

The fine silver halide grains have a silver bromide content of 0 to 100 mol% and may optionally contain silver chloride and/or silver iodide. Fine silver halide grains containing 0.5 to 10 mol% of silver iodide are preferred.

The fine silver halide grains have a mean grain size (the diameter of the grain is defined as the diameter of a circle having an area equal to the projected area of the grain, and the mean grain size is the mean value of the diameters of the grains) of preferably 0.01 to 0.5 μm, more preferably 0.02 to 0.2 μm.

The fine silver halide grains can be prepared by the methods used for preparing general light-sensitive silver halide. The surfaces of the fine silver halide grains need not be optically sensitized or subjected to spectral sensitization. However, a conventional stabilizer such as a triazole compound, an azaindene compound, a benzthiazolium compound, a mercapto compound or a zinc compound is preferably added thereto before coating.

The total coating weight of all of the emulsions coated on the light-sensitive material of the present invention is preferably not more than 6.0 g/m$^2$, most preferably not more than 4.5 g/m$^2$ in terms of silver.

Conventional photographic additives for use in the present invention are described in the aforesaid three Research Disclosure publications, and at the specific locations as indicated in the following Table.

| Type of Additive | RD17643 | RD18716 | RD307105 |
|---|---|---|---|
| 1. Chemical Sensitizers | Page 23 | Page 648, right hand column | Page 866 |
| 2. Sensitivity Increasing Agents | | Page 648, right hand column | |
| 3. Spectral Sensitizers, Super-Sensitizers | Pages 23–24 | Page 648 right hand column - page 649 right hand column | Pages 866–868 |
| 4. Brightening Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultraviolet absorbers | Pages 25–26 | Page 649, right hand column - page 650, left hand column | Page 873 |
| 7. Anti-staining Agents | Page 25, right hand column | Page 650, left hand column - right hand column | Page 872 |
| 8. Dye Image Stabilizers | Page 25 | page 650, left hand column | Page 872 |
| 9. Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating aids Surfactants | Pages 26–27 | Page 650, right hand column | Pages 875–876 |
| 13. Anti-static agents | Page 27 | Page 650, right hand column | Pages 876–877 |
| 14. Matting Agents | | | Pages 878–879 |

A compound capable of reacting with formaldehyde to fix the same as described in U.S. Pat. Nos.4,411,987 and 4,435,503 is preferably added to the light-sensitive material to prevent deterioration in photographic performance due to formaldehyde gas.

Also, the light-sensitive material of the present invention preferably contains mercapto compounds described in U.S. Pat. Nos. 4,740,454 and 4,788,102, JP-A-62-18539 and JP-A-1-283551.

Furthermore, the light-sensitive material of the present invention preferably contains compounds capable of releasing fogging agents, development accelerators and solvents for silver halide or precursors thereof as described in JP-A-1-106052 independent of the amount of developed silver formed by development.

Various color couplers can be used in the present invention. Examples thereof are described in patent specifications cited in the aforesaid *Research Disclosure* No. 17643, VII-C to G and ibid. No. 307105, VII-C to G.

Preferred yellow couplers include those described in U.S. Pat. Nos. 3,933,501, 4,022,620, 4,326,024, 4,401,752 and 4,248,961, JP-B-58-10739, U.S. Pat. Nos. 1,425,020 and 1,476,760, U.S. Pat. Nos. 3,973,968, 4,314,023 and 4,511,649 and European Patent 249,473A.

5-Pyrazolone compounds and pyrazoloazole compounds are preferred as magenta couplers. Examples of particularly preferred magenta couplers for use in the present invention include those described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-60-185951, U.S. Pat. Nos. 4,500,630, 4,540,654 and 4,556,630 and PCT WO 88/04795.

Useful cyan couplers include phenol couplers and naphthol couplers. Examples of preferred cyan couplers include those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658. Furthermore, the pyraxoloazole couplers described in JP-A-64-553, JP-A-64-554, JP-A-64-555 and JP-A-64-556 and imidazole couplers described in U.S. Pat. No. 4,818,672 can also be used.

Typical examples of dye forming polymer couplers are described in U.S. Pat. Nos. 3,451,820, 4,080,211, 4,367,282, 4,409,320 and 4,576,910, U. K. Patent 2,102,137 and European Patent 341,188A.

Preferred examples of couplers the developed dye of which has an appropriate diffusibility are described in U.S. Pat. No. 4,366,237, U. K. Patent 2,125,570, European Patent 96,570 and West German Patent Laid-Open No. 3,234,533.

Preferred examples of colored couplers for correcting the unwanted side absorption of developed dyes are described in *Research Disclosure* No. 17643, VII-G, ibid. No. 307105, VII-G, U.S. Pat. No. 4,163,670, JP-B-57-39413, U.S. Pat. Nos. 4,004,929 and 4,138,258 and U. K. Patent 1,146,368. Furthermore, couplers for correcting the unwanted side absorption of developed dyes by release of a fluorescent dye during coupling as described in U.S. Pat. No. 4,774,181 and couplers having, as an eliminable group, a dye precursor group capable of forming a dye by reacting with a developing agent as described in U.S. Pat. No. 4,777,120, may also be used.

Compounds capable of releasing photographically useful residues upon coupling are preferably used in the present invention. Preferred examples of DIR couplers which release a restrainer are described in the patent specifications cited in the aforesaid *RD* No. 17643, VII-F and *RD* No. 307105, VII-F, JP-A-57-151944, JP-A-57-154234, JP-A-60-184248, JP-A-63-37346 and JP-A-63-37350 and U.S. Pat. Nos. 4,248,962 and 4,782,012.

Couplers, which release a bleaching accelerator as described in *RD* No. 11449, *RD* No. 24241 and JP-A-61-20124, are effective in shortening the processing time of a processing stage having a bleaching ability. Particularly, the effect thereof is remarkable when used in the processing of a light-sensitive material containing the aforesaid tabular silver halide grains. Preferred examples of couplers which imagewise release a nucleating agent or a development accelerator during development are described in U. K. Patents 2,097,140 and 2,131,188, JP-A-59-157638 and JP-A-59-170840. Furthermore, compounds which release a fogging agent, a development accelerator, a solvent for silver halide by a redox reaction with the oxidant of a developing agent as described in JP-A-60-107029, JP-A-60-252340, JP-A-1-44940 and JP-A-1-45687 are preferred.

Other compounds for use in the light-sensitive material of the present invention include competitive couplers described in U.S. Pat. No. 4,130,427; multi-equivalent type couplers described in U.S. Pat. Nos. 4,283,472, 4,338,393 and 4,310,618; DIR redox compound-releasing couplers, DIR coupler-releasing couplers, DIR coupler-releasing redox compounds or DIR redox-releasing redox compounds described in JP-A-60-185950 and JP-A-62-24252; couplers which release a dye whose color is restored after elimination as described in European Patents 173,302A and 313,308A; ligand-releasing couplers described in U.S. Pat. No. 4,555,477; leuco dye-releasing couplers described in JP-A-63-75747; and fluorescent dye-releasing couplers described in U.S. Pat. No. 4,774,181.

The couplers for use in the present invention can be introduced into the light-sensitive materials by various conventional dispersion methods.

Examples of high-boiling solvents for use in oil-in-water dispersion methods are described in U.S. Pat. No. 2,322,0217. Specific examples of high-boiling organic solvents which have a boiling point of not lower than 175° C. under atmospheric pressure and can be used in oil-in-water dispersion methods include phthalic esters (e.g., dibutyl phthalate, dicyclohexyl phthalate, di-2ethylhexyl phthalate, decyl phthalate, bis(2,4-di-t-amylphenyl) phthalate, bis(1,1-diethylpropyl) phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphate), benzoic esters (e.g., 2-ethylhexyl benzoate, dodecyl benzoate, 2-ethylhexyl p-hydroxybenzoate), amides (e.g., N,N-diethyldodecaneamide, N,N-diethyllaurylamide, N-tetradecylpyrrolidone), alcohols or phenols (e.g., isostearyl alcohol, 2,4-di-t-amylalcohol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-tert-octylaniline) and hydrocarbons (e.g., paraffins, dodecylbenzene, diisopropylnaphthalene). Organic solvents having a boiling point of not lower than about 30° C., preferably not lower than 50° C., but not higher than 160° C. can be used as auxiliary solvents. Typical examples thereof include ethyl acetate, butyl acetate, ethyl propionate, methyl ethyl ketone, cyclohexanone, 2-ethyoxyethyl acetate and dimethylformamide.

The processes and effects of latex dispersion methods and examples of impregnating latexes are described in U.S. Pat. No. 4,199,363 and West German Patent Application (OLS) Nos. 2,541,274 and 2,541,230.

Various antiseptics or antifungal agents such as phenetyl alcohol or 1,2-benzisothiazoline-3-one, n-butyl p-hydroxybenzoate, phenol, 4-choloro-3,5-dimethylphenol, 2-phenoxyethanol and 2-(4-thiazolyl)benzimidazole described in JP-A-63-257747, JP-A-62-272248 and JP-A-1-80941 are preferably added to the color light-sensitive material of the present invention.

Suitable supports for use in the present invention are described in the aforesaid *RD* No. 17643 (page 28), *RD* No. 18716 (from right column of page 647 to left column of page 648) and *RD* No. 307105 (page 879).

The sum total of the layer thicknesses of all of the hydrophilic colloid layers on the photographic emulsion layer side of the color light-sensitive material of the present invention is preferably not more than 28 μm, more preferably not more than 23 μm, still more preferably not more than 18 μm, particularly preferably more than 16 μm. The layer-swelling rate $T_{\frac{1}{2}}$ is preferably not more than 30 seconds, more preferably not more than 20 seconds. The layer thickness is obtained by measuring the thickness after storing under conditioning at 25° C. and 55% RH for 2 days. The layer swelling rate $T_{\frac{1}{2}}$ can be measured by a method known in the art. For example, the layer swelling rate can be measured by using a swellometer of a type described in A Green, *Photogr. Sci. Eng.*, Vol. 19, No. 2, pp. 124 to 129. $T_{\frac{1}{2}}$ is defined as the time elapsed until the layer thickness reaches ½ of the saturated layer thickness, wherein 90% of the maximum swollen layer thickness attainable by processing a film with a color developing solution at 30° C. for 3¼ minutes is referred to as the saturated layer thickness.

The layer swelling rate $T_{\frac{1}{2}}$ can be controlled by adding a hardening agent to gelatin as a binder, or by changing the storage conditions after coating. Furthermore, the swelling ratio is preferably 150 to 400%. The swelling ratio can be calculated from the maximum swollen layer thickness obtained under the above-described conditions by the following formula.

Swelling ratio = (maximum swollen layer thickness—layer thickness)/layer thickness The light-sensitive material of the present invention is preferably provided with a hydrophilic layer (called a back layer) having a total dry thickness of 2 to 20 μm on the side of the support opposite the photographic emulsion layer side. The back layer also preferably contains the aforesaid light absorber, filter dye, ultraviolet light absorber, antistatic agent, hardening agent, binder, plasticizer, lubricant, coating aid, surfactant, etc. The swelling ratio of the back layer is preferably.150 to 500%.

The color photographic materials of the present invention can be developed according to the methods described in the aforesaid *RD* No. 17643 (pages 28 to 29), *RD* No. 18716 (left column to right column of page 651) and *RD* No. 307105 (pages 880 to 881).

The color developing solutions for use in processing the light-sensitive material of the present invention are preferably aqueous alkaline solutions mainly composed of an aromatic primary amine color developing agent. Aminophenol compounds are useful as the color developing agent, and p-phenylenediamine compounds are preferred as the color developing agent. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate. Among them, 3-methyl-4-amino-N-ethyl-N-β-hydroxyethylaniline sulfate is particularly preferred. These compounds may be used in a combination of two or more thereof depending on the intended purpose.

Generally, the color developing solution contains pH buffering agents such as alkali metal carbonates, borates and phosphates, development restrainers such as chlorides, bromides, iodides, benzimidazoles, benzothiazoles and mercapto compounds, and anti-fogging agents. If desired, the color developing solution may optionally contain preservatives such as hydroxylamine, diethylhydroxylamine, sulfites, hydrazines such as N,N-biscarboxymethylhydrazine, phenylsemicarbazides, triethanolamine, and catecholsulfonic acids; organic solvents such as ethylene glycol and diethylene glycol; development accelerators such as benzyl alcohol, polyethylene glycol, quaternary ammonium salts and amines; color forming couplers; competitive couplers; auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development is first carried out followed by color development. The black-and-white developing solution may contain conventional black-and-white developing agents such as dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in a combination of two or more thereof.

The pH of the color developing solution and the black-and-white developing solution is generally in the range of from 9 to 12. The replenishment rate of these developing solutions varies depending on the type of the color photographic material to be processed, but is usually not more than 3 l per $m^2$ of the photographic material. The replenishment rate can be reduced to 500 ml or less when the concentration of bromide ion in the replenisher is reduced. When the replenishment is reduced, the contact area of the solution with air in the processing tank is desirably reduced to prevent the solution from evaporation or oxidation by air.

The contact area of the photographic processing solution with air in the processing tank can be represented by an opening ratio defined below.

$$\text{Opening ratio} = \frac{[\text{Contact area (cm}^2\text{) of processing solution with air}]}{[\text{Capacity (cm}^3\text{) of processing solution}]}$$

The opening ratio is preferably not higher than 0.1, more preferably 0.001 to 0.05. Methods for reducing the opening ratio include providing a cover such as a floating cover on the surface of the photographic processing solution in the processing tank; providing a movable cover as described in JP-A-1-82033; and conducting slit development as described in JP-A-63-216050. Reduction of the opening ratio is preferably applied to not only both the color development stage and the black-and-white development stage, but also to all subsequent stages such as bleaching, bleaching-fixing, fixing, rinsing and stabilization stages. Furthermore, the replenishment rate can be reduced by using means for inhibiting the accumulation of bromide ion in the developing solution.

The color development time is generally set between 2 and 5 minutes. However, the processing time can be shortened by using the color developing agents at a higher concentration, and/or under higher temperature and pH conditions.

After color development, the photographic emulsion layer is usually bleached. Bleaching may be carried out simultaneously with fixing (bleaching-fixing treatment), or these steps may be carried out separately. After bleaching, a bleaching-fixing treatment may be conducted to expedite processing. The treatment may be conducted by using a bleaching-fixing bath composed of two consecutive baths. Fixing may be conducted before the bleaching-fixing treatment. After the bleaching-fixing treatment, bleaching may be conducted depending on the intended purpose. Examples of bleaching agents include compounds of polyvalent metals such as iron(III), peracids, quinones and nitro compounds. Typical examples of the bleaching agents include organic complex salts of iron(III) such as complex salts of aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.) citric acid, tartaric acid, malic acid, etc. Among them, iron(III) complex salts of aminopolycarboxylic acids such as (ethylenediaminetetraacetato)iron(III) complex and (1,3-diaminopropanetetraacetato)iron(III) complex are preferred for purposes of rapid processing and prevention of environmental pollution. Furthermore, iron(III) complex salts of aminopolycarboxylic acids are useful for bleaching solutions and bleaching-fixing solutions. The pH of the bleaching solutions containing the iron-(III) complex salts of the aminopolycarboxylic acids and the bleaching-fixing solutions containing said iron-(III) complex salts is generally in the range of 4.0 to 8. A lower pH may be used to expedite processing.

If desired, the bleaching solution, the bleaching-fixing solution and the prebath thereof may contain bleaching accelerators. Examples of useful bleaching accelerators include compounds having a mercapto group or disulfide group described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ion. Among them, the compounds having a mercapto group or disulfide group are preferred for providing a high accelerating effect. Particularly, the compounds described in U.S. Pat. No 3,893,858, West German Patent 1,290,812 and JP-A-53-95630 are preferred. Furthermore, the compounds described in U.S. Pat. No. 4,552,834 are preferred. These bleaching accelerators may also be incorporated into the photographic materials. These bleaching accelerators are particularly effective for bleaching-fixing of color photographic materials for photographing.

The bleaching solution and the bleaching-fixing solution preferably contain organic acids in addition to the above-described compounds to prevent the formation of bleaching stain. Particularly preferred organic acids are compounds having an acid dissociation constant (pKa) of 2 to 5. Preferred examples of the organic acids include acetic acid, propionic acid and hydroxyacetic acid.

Examples of useful fixing agents include thiosulfates, thiocyanates, thioether compounds, thioureas and various iodides. Thiosulfates are widely used as a fixing agent. Particularly, ammonium thiosulfate is most widely used. The combination of a thiosulfate with a thiocyanate, a thioether compound or a thiourea is also preferred. Sulfites, bisulfites, carbonyl/bisulfite adducts or sulfinic acid compounds described in European Patent 294,769A are preferred as preservatives for the fixing solution and the bleaching-fixing solution. Furthermore, various aminopolycarboxylic acids or organic phosphonic acids are preferably added to the fixing solution or the bleaching-fixing solution to stabilize the solution.

Compounds having a pKa of 6.0 to 9.0, preferably imidazoles such as imidazole, 1-methylimidazole, 1-ethylimidazole and 2-methylimidazole in an amount of 0.1 to 10 mol/l are preferably added to the fixing solution or the bleaching-fixing solution to adjust the pH of the solution.

A shorter total desilverization time is preferred, so long as desilverization failure does not occur. The desilverization time is preferably 1 to 3 minutes, more preferably 1 to 2 minutes. The processing temperature is from 25° to 50° C., preferably from 35° to 45° C. The desilverization rate is improved and staining after processing is effectively prevented when the processing is carried out in the preferred temperature range.

The processing solution for the desilverization stage is preferably agitated to the extent possible. Specific examples of methods for vigorous agitation include jetting a stream of the processing solution with the emulsion layer surface of the light-sensitive material as described in JP-A-62-183460; improving the agitation effect using a rotary means as described in JP-A-62-183461; bringing a wiper blade provided in the solution into contact with the emulsion layer surface while moving the light-sensitive material in a transverse direction, to thereby generate a turbulent flow and increase agitation; and increasing the circulating flow rate of the processing solution as a whole. These agitation-improving means are also effective in any of the bleaching solution, the bleaching-fixing solution and the fixing solution. It is considered that an improvement in agitation expedites supply of the bleaching agent and the fixing agent to the emulsion layers and as a result, the desilverization rate is increased. Furthermore, the above-described agitation-improving means are more effective when a bleaching accelerator is used. Such agitation means remarkably increase the accelerating effect and can eliminate the fixation-inhibiting effect of the bleaching accelerator.

An automatic processor for processing the light-sensitive material of the present invention is preferably provided with a light-sensitive material-conveying means as described in JP-A-60-191257, JP-A-60-191258 and JP-A-60-191259. The conveying means greatly reduces the amount of processing solution carried over from a prebath to a subsequent bath, to thereby prevent deterioration of photographic performance of the processing solution. This method is particularly effective in shortening the processing time in each stage and in reducing the replenishment rates of the respective processing solutions.

Usually, the silver halide color photographic material of the present invention is subjected to washing and/or a stabilization stage after desilverization. The amount of rinsing water used in the washing stage widely varies depending on the characteristics (e.g., constituent components such as couplers) of the photographic material, use, the temperature of the rinsing water, the number of rinsing tanks (the number of stages), the type of replenishing system (countercurrent, direct flow) and other conditions. The relationship between the amount of water and the number of rinsing tanks in a multi-stage countercurrent system can be determined by the method described in *Journal of the Society of Motion Picture and Television Engineers*, Vol. 64, p. 248 to 253 (May 1955).

According to the multi-stage countercurrent system described in the above literature reference, the amount of rinsing water can be greatly reduced. However, the residence time of water in the tanks is prolonged and as a result, bacteria proliferate and the resulting suspended matter is deposited on the photographic material. A method for reducing calcium ion and magnesium ion described in JP-A-62-288,838 can be effectively used in processing of the color photographic material of the present invention to solve this problem. Furthermore, isothiazolone compounds, thiabendazole compounds, chlorine-containing germicides such as sodium chlorinated isocyanurate and benztriazole described in JP-A-57-8542 and germicides described in *Chemistry of Germicidal Antifungal Agent*, written by Hiroshi Horiguchi (1986), *Sterilization, Disinfection, Antifungal Technique*, edited by Sanitary Technique Society (1982) and *Antibacterial and Antifungal Encyclopedia*, edited by Nippon Antibacterial Antifungal Society (1986), can be used.

The pH of rinsing water in the treatment of the photographic material of the present invention is in the range of 4 to 9, preferably 5 to 9. The temperature of the rinsing water and washing time vary depending on the characteristics of the photographic materials, use, etc., but the temperature and time of washing are generally 15° to 45° C. for 20 seconds to 10 minutes, preferably 25° to 40° C. for 30 seconds to 5 minutes. The photographic material of the present invention may be processed directly with a stabilizing solution in place of rinsing water. Such stabilizing treatment can be carried out by conventional methods described in JP-A-57-8543, JP-A-58-14834 and JP-A-60-220345.

A stabilizing treatment subsequent to the rinsing may be conducted. The stabilizing treatment may be used as the final bath for a color photographic material for photographing. An example thereof is a stabilizing bath containing a dye stabilizer and a surfactant. Examples of the dye stabilizer include aldehydes such as formalin and glutaraldehyde, N-methyl-ol compounds, hexamethylenetetramine and aldehydesulfite adducts. The stabilizing bath may contain various chelating agents and antifungal agents.

The overflow solution from replenishment of the rinsing water and/or the stabilizing solution can be reused in other stages such as the desilverization stage.

When each processing solution is concentrated by evaporation in the processing the photographic material in an automatic processor, water is preferably added to thereby correct the concentration of each processing solution.

A color developing agent may be incorporated in the silver halide color photographic material of the present invention to simplify and expedite processing. A precursor of the color developing agent is preferably used for incorporation into the photographic material. Examples of useful precursors include indoaniline compounds described in U.S. Pat. No. 3,342,597; Schiff base silver compounds described in U.S. Pat. No. 3,342,599; *Research Disclosure* No. 14850 and ibid., No. 15159; aldol compounds described in *Research Disclosure* No. 13924; metal complex salts described in U.S. Pat. No. 3,719,492; and urethane compounds described in JP-A-53-135628.

If desired, 1-phenyl-3-pyrazolidones may be incorporated in the silver halide color photographic material of the present invention for accelerating color development. Typical examples of such compounds include those described in JP-A-56-64339, JP-A-57-144547 and JP-A-115438.

In the present invention, the various processing solutions are used at a temperature of 10° to 50° C. Generally, a temperature of 33° to 38° C. is used. However, a higher temperature may be used to accelerate processing and to shorten processing time, while a lower temperature may be used to improve image quality and to improve the stability of the processing solution.

The dye dispersion of the present invention can be applied to the heat-developing light-sensitive materials described in U.S. Pat. No. 4,500,626, JP-A-60-13349, JP-A-b 59-218443, JP-A-61-23805 and European Patent 210,660A2.

The present invention is now illustrated in greater detail by reference to the following examples which, however, are not to be construed as limiting the present invention in any way.

EXAMPLE 1

Preparation of Dispersion A

Thirty grams of compound D-14 were dissolved in a mixed solvent of 30 cc of tricresyl phosphate and 120 ml of ethyl acetate with heating. The resulting solution was emulsified and dispersed in 800 g of a 10 wt% aqueous solution of ossein gelatin containing 3 g of sodium dodecylbenzenesulfonate using a household mixer to prepare a dispersion a.

Preparation of Dispersion B

In 60 ml of acetone were dissolved 1.9 g of compound D-14, and the resulting solution was added to 38 g of latex (methyl acrylate-2-acrylamido-2-methylpropanesulfonic acid (sodium salt) copolymer, copolymerization ratio=95:5, 20 wt%) with stirring. Subsequently, while the mixture was heated to 50° C., the acetone was removed under reduced pressure using a rotary evaporator. The resulting mixture was filtered and dispersed in 75 g of a 10 wt% aqueous solution of ossein gelatin to prepare dispersion b.

When the amount of latex was 9.5 g (latex/dye ratio=1), impregnation was insufficient and the dispersion was not usable.

Preparation of Dispersion C 22 ml of water, 3 ml of a 5 wt% aqueous solution of sodium p-octylphenoxyethoxyethanesulfonate and 0.5 g of p-octylphenoxypolyoxyethylene ether were placed in a 70 ml ball mill container for dispersion, and 1.0 g of compound D-14 and 50 ml zirconium oxide beads (diameter:1 mm) were added thereto. The contents were dispersed for 3 hours, removed from the container, recovered by filtration and then dispersed in 40 g of a 10 wt% aqueous solution of gelatin to obtain dispersion c.

Preparation of Dispersion D

A dispersion d was prepared in the same manner as dispersion a, except that 35 g of the polymer P-15 of the present invention was used in place of tricresyl phosphate.

Preparation of Sample

The following layers having the following compositions were coated onto an undercoated cellulose triacetate film support to prepare samples 101 to 104 as indicated in Table 1. In coating the second layer (dye layer), the dispersions prepared as described above were used, together with a surfactant for coating. Furthermore, an aqueous gelatin solution was added so as to make the dry thickness of each sample uniform.

| Sample 101 | |
|---|---|
| First layer: undercoated gelatin layer | |
| Gelatin | 1.5 g/m$^2$ |

-continued

| Sample 101 | |
|---|---|
| Tricresyl phosphate | 0.3 g/m$^2$ |
| second layer: dye layer | |
| Gelatin | 1.5 g/m$^2$ |
| Compound D-14 | 0.21 g/m$^2$ |
| Tricresyl phosphate | 0.25 g/m$^2$ |
| Third layer: protective layer | |
| Gelatin | 1.5 g/m$^2$ |
| Sodium salt of 6-hydroxy-2,4-dichloro-s-triazine | 0.18 g/m$^2$ |

TABLE 4

| | Average AgI content (%) | Mean grain size (μm) | Coefficient of variation in grain size (%) | Ratio of diameter/thickness | Ratio of amount of silver [core/intermediate/shell] (AgI content) | Grain structure/form |
|---|---|---|---|---|---|---|
| Emulsion | | | | | | |
| A | 4.0 | 0.45 | 27 | 1 | [1/3] (13/1) | double structural octahedral grains |
| B | 8.9 | 0.70 | 14 | 1 | [3/7] (25/2) | double structural octahedral grains |
| C | 2.0 | 0.55 | 25 | 7 | — | uniform structural tabular grains |
| D | 9.0 | 0.65 | 25 | 6 | [12/59/29] (0/11/8) | triple structural tabular grains |
| E | 9.0 | 0.85 | 23 | 5 | [8/59/33] (0/11/8) | triple structural tabular grains |
| F | 14.5 | 1.25 | 25 | 3 | [37/63] (34/3) | double structural platy grains |
| G | 1.0 | 0.07 | 15 | 1 | — | uniform structural fine grains |

The absorption spectrum of each of the resulting samples was measured, and the half width and long wave edge absorption characteristics (the ratio absorption value at λmax+50 nm/absorption value at λmax) were determined.

The strength of the coated layer was evaluated in the following manner.

A load of 0 to 100 g was applied to a sapphire needle of 0.1 ϕ to scratch the coated film. The strength of the coated layer is given as the load under which the layer was first broken.

The results are shown in Table 1.

It is clearly seen from Table 1 that sample 104 of the present invention exhibited excellent absorption characteristics as well as strength of the coated layer.

TABLE 1

| Sample | Dispersion | Absorption characteristics: half width/mm | Absorption characteristics: A(λmax + 50/A(λmax) | Strength of layer (layer breaking load, g) |
|---|---|---|---|---|
| 101 Comp. Ex. | oil dispersion | 88 | 0.26 | 20 |
| 102 Comp. Ex. | latex impregnation | 95 | 0.35 | 40 |
| 103 Comp. Ex. | solid dispersion | 115 | 0.48 | not broken |
| 104 Invention | polymer dispersion | 90 | 0.26 | not broken |

EXAMPLE 2

Samples 105 to 109 were prepared in the same manner as sample 104, except that the dye/polymer combinations and the ratio by weight (given in parenthesis) were changed to D-2/P-11 (1), D-5/P-3 (1), D-7/P-16 (0.7), D-11/P-133 (2) and D-38/P-13 (1), respectively.

The samples were evaluated in the same manner as in Example 1. It was found that the samples exhibited excellent absorption characteristics as well as mechanical strength similar to sample 104.

The samples 101 and 104 to 109 were evaluated with respect to decolorizability of the dyes. T he treatment for the test was carried out as follows.

| Stage | Treating time | Treating temperature |
|---|---|---|
| Alkaline buffer solution | 2 min | 38° C. |
| Rinsing | 30 sec | 38° C. |
| Drying | | |

The alkaline buffer solution had the following composition.

| | |
|---|---|
| Sodium sulfite | 2.0 g |
| Sodium carbonate | 25.4 g |
| Sodium hydrogencarbonate | 13.4 g |
| Add water to make | 2 l |
| pH | adjusted to 10.0 |

The ratio ($D^o_B/D_B$) of yellow density ($D_B$) after treatment to yellow density ($D^o_B$) before treatment was determined as the degree of decolorizability. The results are shown in Table 2.

It is clearly seen from Table 2 that the degree of residual color in the samples of the present invention was very low. Thus, the samples of the present invention provided excellent decolorizability.

TABLE 2

| Sample | Decolorizability |
|---|---|
| 101 (Comp. Ex.) | 0.32 |
| 104 (Invention) | 0.01 |
| 105 (Invention) | 0.01 |
| 106 (Invention) | 0.02 |
| 107 (Invention) | 0.00 |
| 108 (Invention) | 0.04 |
| 109 (Invention) | 0.02 |

EXAMPLE 3

Preparation Methods A to E of Dispersion

Preparation Method A

A solution of one gram of dye (compound A) dissolved in 20 ml of distilled water was mixed with 50 ml of an aqueous solution containing 10 g of mordant (compound B-1) with stirring, and 50 ml of a 10 wt% gelatin solution was then added thereto.

Preparation Method B

One gram of dye (compound D-30), water and a surfactant (Alkanol XC, alkylnaphthalenesulfonate, manufactured by E. I. du Pont) were placed in a ball mill container, and zirconium beads were then placed in the container. The container was closed, and dispersion was carried in the ball mill for 4 days.

Subsequently, 50 ml of a 10 wt% gelatin solution were added thereto, and the beads were removed to obtain a dispersion.

Preparation Method C

A solution of one gram of dye (D-30) dissolved in 40 ml of acetone was gradually added dropwise to 30 ml of an aqueous latex solution containing 5 g of a latex polymer (B-2) described below with stirring to thereby effect impregnation. Acetone was removed from the aqueous latex solution using a rotary evaporator, and 50 ml of a 10 wt% aqueous gelatin solution were added thereto to obtain a dispersion.

Preparation Method D

One gram of dye (D-30) and 3 g of tricresyl phosphate were dissolved in 20 ml of ethyl acetate. The resulting solution was mixed with 50 ml of a 10 wt% gelatin solution containing 0.2 g of sodium dodecylbenzenesulfonate, and emulsifying dispersion was conducted in a colloid mill.

Preparation Method E

One gram of dye (D-30), 1.5 g of the polymer of the present invention and 1.5 g of tricresyl phosphate were dissolved in 20 ml of ethyl acetate. The resulting solution was mixed with 50 ml of a 10 wt% gelatin solution containing 0.2 g of sodium dodecylbenzenesulfonate, and emulsifying dispersion was conducted in a colloid mill. In this method, the polymers P-36, P-3 and P-147 were used.

Compound A

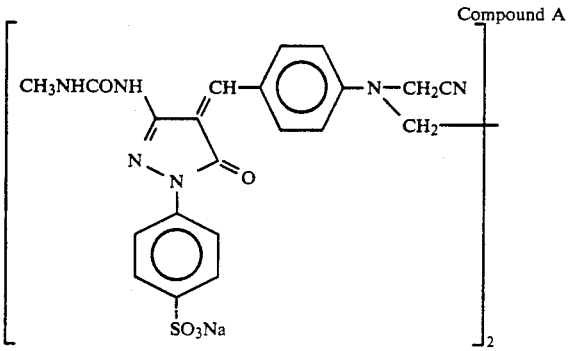

B-1

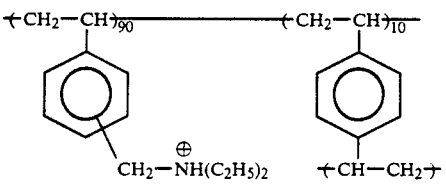

-continued

B-2

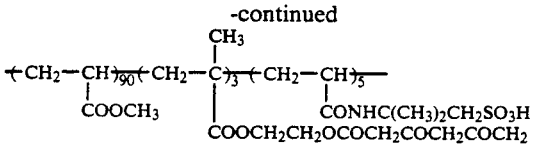

Preparation of Samples 201 to 207

Each of the dispersions obtained in the above preparation methods A to E was coated on a cellulose triacetate base in a coating weight of 0.20 g/m² in terms of the dye to prepare each of samples 201 to 207.

| | |
|---|---|
| First layer | |
| Dye | 0.20 g/m² |
| Gelatin (in addition to the dispersion) | 3.00 g/m² |
| Second layer | |
| H-1 | 0.10 g/m² |
| B-1 (diameter: 1.7 μm) | 0.05 g/m² |
| B-2 (diameter: 1.7 μm) | 0.10 g/m² |
| Gelatin | 2.00 g/m² |

The color tone was evaluated by measuring the absorbance at λmax and the half width ((width at ½ of peak at λmax)÷absorbance). Decolorization performance (the ratio of the concentration of undecolorized dye remaining after treatment to the concentration of the dye before treatment) was determined using the following treating solution A. Furthermore, the absorption at λmax of untreated samples and of treated samples immersed in the treating solution A for 30 seconds and dried, was measured.

Treating solution A

A solution prepared by adding one liter of water to 3 g of sodium sulfite and adjusting the pH of the solution with potassium carbonate to 10.

Furthermore, the adhesion performance of the layers of the samples was evaluated in the following manner.

An adhesive tape having a high bonding power was affixed to the sample, the tape was rubbed 10 times against the sample and the sample was then stored at room temperature for one day. Subsequently, the tape was peeled off to evaluate the strength of adhesion. The results are shown in Table 3.

The evaluation was made by the following criterion. Mark A: very good, B: fair, C: poor.

It is clearly seen from Table 3 that the samples of the present invention exhibited excellent absorption characteristics, decolorization performance of the dyes and mechanical strength of the layers in comparison with other dispersion methods.

Furthermore, it is clearly seen that sample 207 using a hydrophobic acid polymer provided enhanced absorption characteristics and decolorizability of the dye in comparison with the samples 205 and 206 among various samples of the present invention.

TABLE 3

| Sample | Preparation method | Absorbance | Half width (nm) ÷ Absorbance (Ab) | Ratio (%) of residual color after treatment A | Adhesion |
|---|---|---|---|---|---|
| 201 (Comp. Ex.) | A | 0.40 | 200 | 30% | B |
| 202 | B | 0.50 | 190 | 6% | A |

TABLE 3-continued

| Sample | Preparation method | Absorbance | Half width (nm) ÷ Absorbance (Ab) | Ratio (%) of residual color after treatment A | Adhesion |
|---|---|---|---|---|---|
| (Comp. Ex.) 203 | C | 0.70 | 130 | 10% | A |
| (Comp. Ex.) 204 | D | 0.90 | 110 | 8% | C |
| (Comp. Ex.) 205 | E*) | 0.90 | 110 | 12% | A |
| (Invention) 206 | E**) | 0.80 | 120 | 8% | A |
| (Invention) 207 | E***) | 0.90 | 110 | 7% | A |
| (Invention) | | | | | |

*)Polymer P-36 was used
**)Polymer P-3 was used
***)Polymer P-147 was used

EXAMPLE 3

The layers described below having the following compositions were coated on an undercoated cellulose triacetate film support to prepare a multi-layer color light-sensitive material designated as sample 301.

The numerals to the right represent the coating amounts in g/m$^2$ of the indicated components. The amounts of the silver halides are represented by their coating amounts in terms of silver. The amounts of the sensitizing dyes are represented by their coating amounts in moles per one mole of silver halide in the same layer.

| Sample 301 | |
|---|---|
| First layer (antihalation layer) | |
| Black colloidal silver (in terms of silver) | 0.18 |
| Gelatin | 1.40 |
| Second layer (interlayer) | |
| 2,5-Di-t-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (first red-sensitive emulsion layer) | |
| Emulsion A (in terms of silver) | 0.25 |
| Emulsion B (in terms of silver) | 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth layer (second red-sensitive emulsion layer) | |
| Emulsion D (in terms of silver) | 0.90 |
| Sensitizing dye I | $3.5 \times 10^{-4}$ |
| Sensitizing dye II | $1.6 \times 10^{-5}$ |
| Sensitizing dye III | $5.1 \times 10^{-4}$ |
| EX-2 | 0.20 |
| EX-3 | 0.050 |
| EX-10 | 0.015 |
| EX-14 | 0.20 |
| EX-15 | 0.050 |

-continued

| Sample 301 | |
|---|---|
| U-1 | 0.070 |
| U-2 | 0.050 |
| U-3 | 0.070 |
| Gelatin | 1.30 |
| Fifth layer (third red-sensitive emulsion layer) | |
| Emulsion E (in terms of silver) | 1.50 |
| Sensitizing dye I | $2.4 \times 10^{-4}$ |
| Sensitizing dye II | $1.0 \times 10^{-4}$ |
| Sensitizing dye III | $3.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (interlayer) | |
| EX-5 | 0.040 |
| HBS-1 | 0.020 |
| Gelatin | 0.80 |
| Seventh layer (first green-sensitive emulsion layer) | |
| Emulsion C (in terms of silver) | 0.35 |
| Sensitizing dye IV | $2.6 \times 10^{-5}$ |
| Sensitizing dye V | $1.8 \times 10^{-4}$ |
| Sensitizing dye VI | $6.9 \times 10^{-4}$ |
| EX-1 | 0.015 |
| EX-6 | 0.13 |
| EX-7 | 0.020 |
| EX-8 | 0.025 |
| EX-16 | 0.015 |
| HBS-1 | 0.10 |
| HBS-3 | 0.010 |
| Gelatin | 0.63 |
| Eighth layer (second green-sensitive emulsion layer) | |
| Emulsion D (in terms of silver) | 0.60 |
| Sensitizing dye IV | $2.1 \times 10^{-5}$ |
| Sensitizing dye V | $1.5 \times 10^{-4}$ |
| Sensitizing dye VI | $5.8 \times 10^{-4}$ |
| EX-6 | 0.047 |
| EX-7 | 0.018 |
| EX-8 | 0.018 |
| EX-16 | 0.054 |
| HBS-1 | 0.16 |
| HBS-3 | $8.0 \times 10^{-3}$ |
| Gelatin | 0.50 |
| Ninth layer (third green-sensitive emulsion layer) | |
| Emulsion E (in terms of silver) | 1.10 |
| Sensitizing dye IV | $4.6 \times 10^{-5}$ |
| Sensitizing dye V | $1.0 \times 10^{-4}$ |
| Sensitizing dye VI | $4.0 \times 10^{-4}$ |
| EX-1 | 0.013 |
| EX-11 | 0.060 |
| EX-13 | 0.025 |
| HBS-1 | 0.15 |
| HBS-2 | 0.05 |
| Gelatin | 1.25 |
| Tenth layer (yellow filter layer) | |
| Yellow colloidal silver (in terms of silver) | 0.055 |
| EX-5 | 0.12 |
| HBS-1 | 0.08 |
| Gelatin | 0.60 |
| Eleventh layer (first blue-sensitive emulsion layer) | |
| Emulsion C (in terms of silver) | 0.18 |
| Sensitizing dye VII | $8.6 \times 10^{-4}$ |
| EX-8 | 0.042 |
| EX-9 | 0.72 |
| HBS-1 | 0.28 |
| Gelatin | 1.10 |
| Twelfth layer (second blue-sensitive emulsion layer) | |
| Emulsion D (in terms of silver) | 0.45 |
| Sensitizing dye VII | $7.4 \times 10^{-4}$ |
| EX-9 | 0.15 |
| EX-10 | $7.0 \times 10^{-3}$ |
| HBS-1 | 0.050 |
| Gelatin | 0.78 |
| Thirteenth layer (third blue-sensitive emulsion layer) | |
| Emulsion F (in terms of silver) | 0.80 |
| Sensitizing dye VII | $2.8 \times 10^{-4}$ |

-continued

| Sample 301 | |
|---|---|
| EX-9 | 0.20 |
| HBS-1 | 0.070 |
| Gelatin | 0.69 |

| Fourteenth layer (first protective layer) | |
|---|---|
| Emulsion G (in terms of silver) | 0.20 |
| U-4 | 0.11 |
| U-5 | 0.17 |
| HBS-1 | $5.0 \times 10^{-2}$ |
| Gelatin | 1.00 |
| Fifteenth layer (second protective layer) | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

Furthermore, all layers contained W-1, W-2, W-3, B-4, B-5, B-6, F-1, F-2, F-3, F-4, F-5, F-6, F-7, F-8, F-9, F-10, F-11, F-12, F-13, F-14, F-15, F-16, iron salt, lead salt, gold salt, platinum salt, iridium salt and rhodium salt to improve preservability, processability, pressure resistance, antifungal antibacterial properties, antistatic properties and coatability.

The above-described emulsions A to G, which all are silver iodobromide emulsions, are indicated in Table 4.

TABLE 4

| | Average AgI content (%) | Mean grain size (μm) | Coefficient of variation in grain size (%) | Ratio of diameter/ thickness | Ratio of amount of silver [core/ intermediate/shell] (AgI content) | Grain structure/form |
|---|---|---|---|---|---|---|
| Emulsion A | 4.0 | 0.45 | 27 | 1 | [1/3] (13/1) | double structural octahedral grains |
| B | 8.9 | 0.70 | 14 | 1 | [3/7] (25/2) | double structural octahedral grains |
| C | 2.0 | 0.55 | 25 | 7 | — | uniform structural tabular grains |
| D | 9.0 | 0.65 | 25 | 6 | [12/59/29] (0/11/8) | triple structural tabular grains |
| E | 9.0 | 0.85 | 23 | 5 | [8/59/33] (0/11/8) | triple structural tabular grains |
| F | 14.5 | 1.25 | 25 | 3 | [37/63] (34/3) | double structural platy grains |
| G | 1.0 | 0.07 | 15 | 1 | — | uniform structural fine grains |

(1) Emulsions C, D, E and F were subjected to reduction sensitization using thiourea dioxide and thiosulfinic acid during the preparation of the grains according to the Examples of JP-A-2-191938.

(2) Emulsions C, D, E and F were subjected to gold sensitization, sulfur sensitization and selenium sensitization in the presence of sodium thiocyanate and the spectral sensitizing dyes indicated for each light-sensitive layer according to the Examples of JP-A-3-237450.

(3) Low-molecular weight gelatin was used in the preparation of tabular grains according to Examples described in JP-A-1-158426.

(4) In the tabular grains and normal crystalline grains having a grain structure, a dislocation line described in JP-A-3-237450 was observed using a high-pressure electron microscope

EX-1

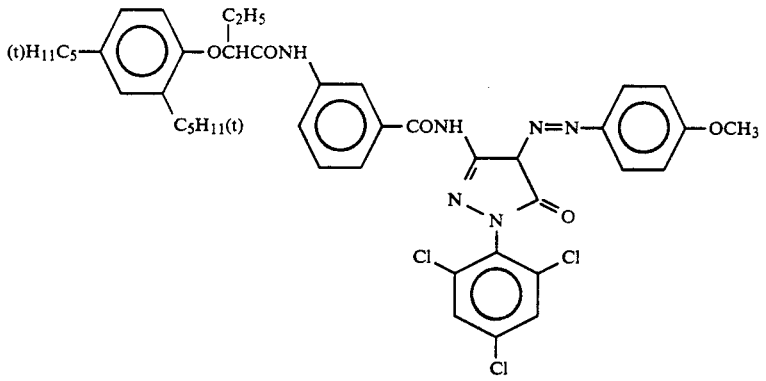

EX-2

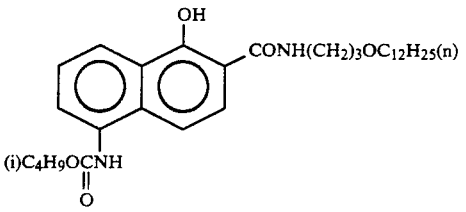

-continued
EX-3
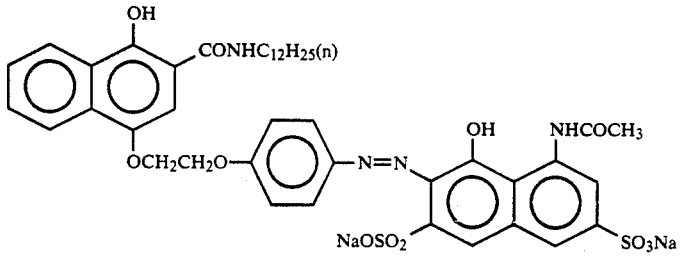
EX-4
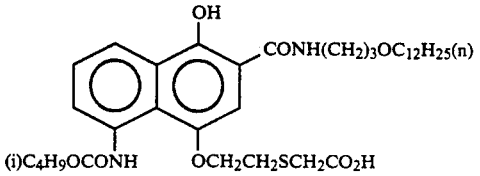
EX-5
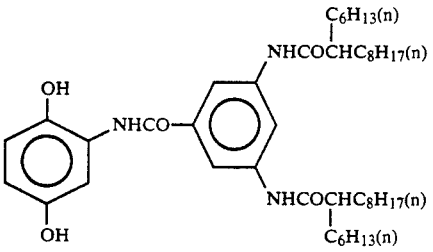
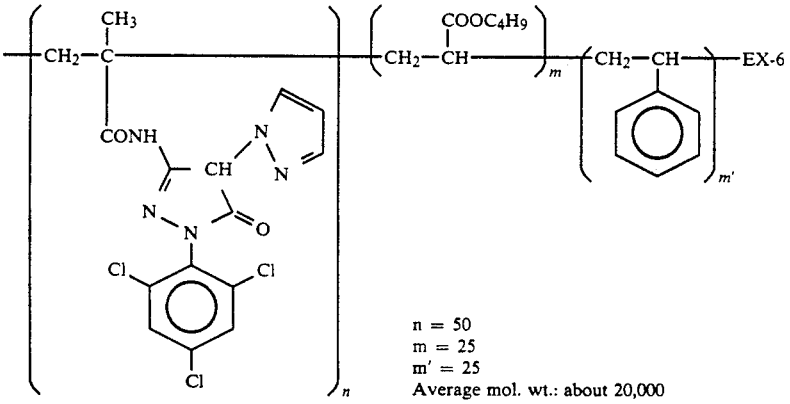
EX-7
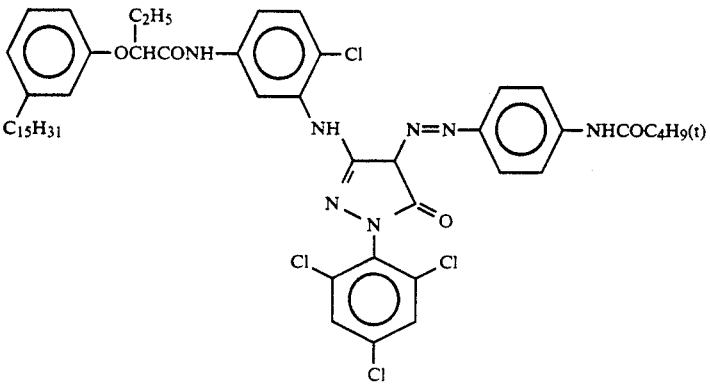

-continued
EX-8
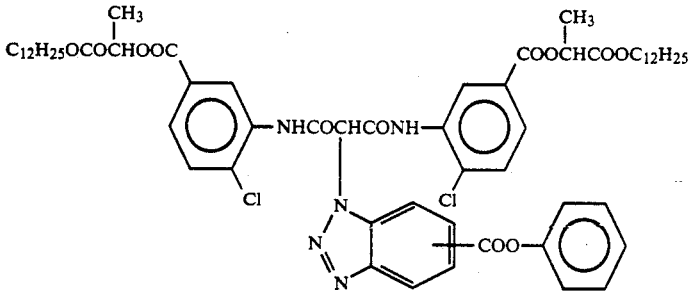
EX-9
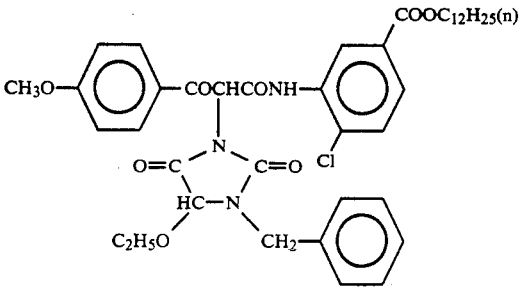
EX-10
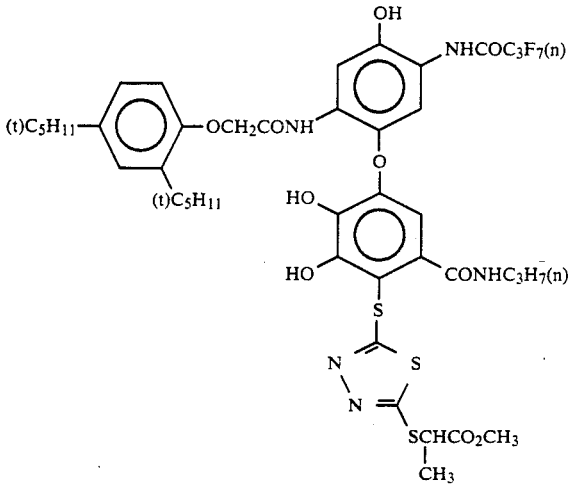
EX-11
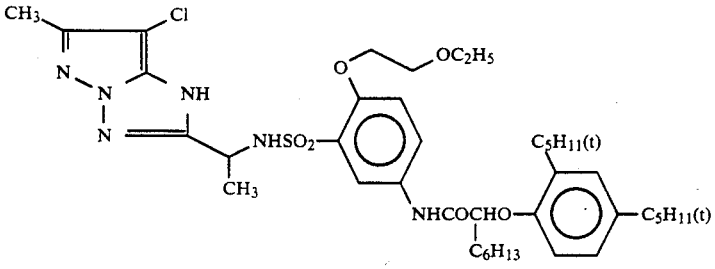
EX-12
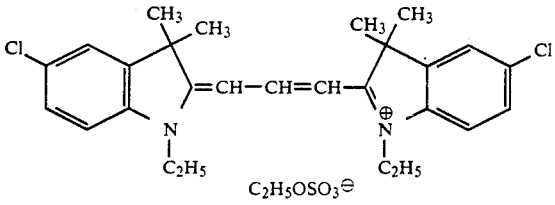

-continued
EX-13
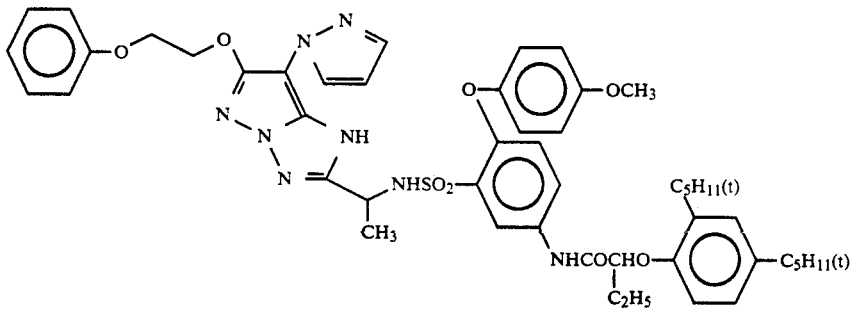
EX-14
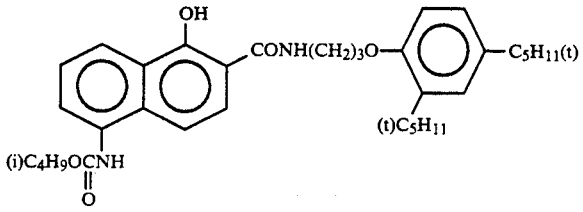
EX-15
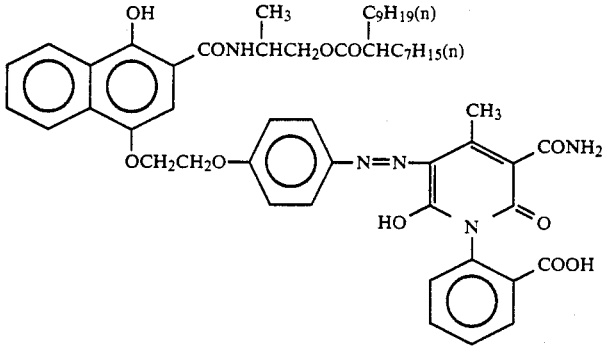
EX-16
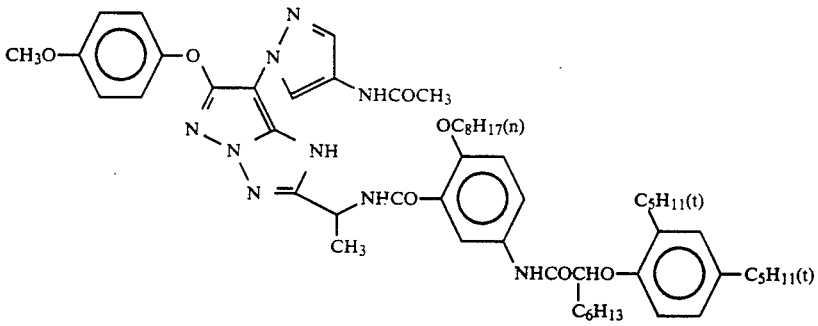
U-1
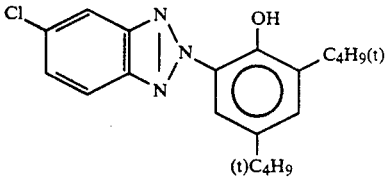
U-2
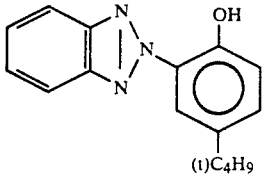

-continued
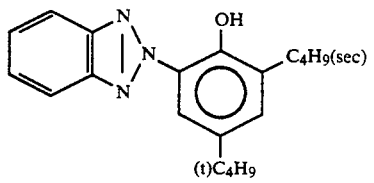
U-3
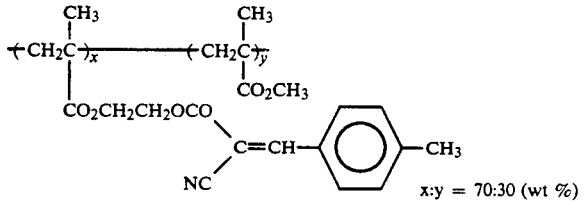
U-4
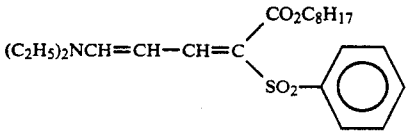
U-5
Tricresyl phosphate — HBS-1
Di-n-butyl phthalate — HBS-2
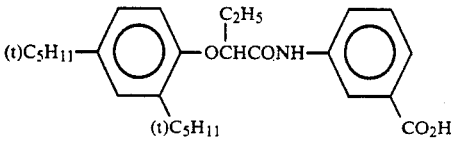
HBS-3
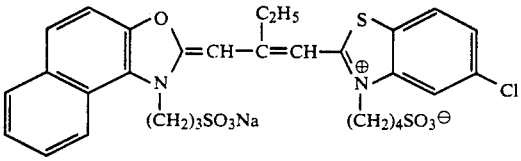
Sensitizing dye I
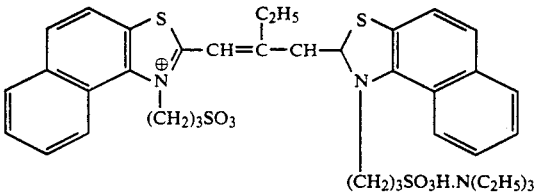
Sensitizing dye II
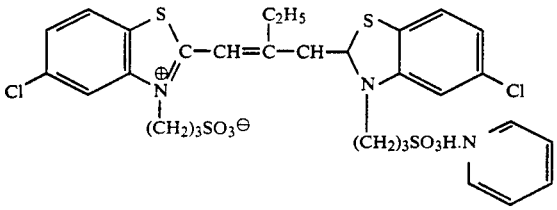
Sensitizing dye III
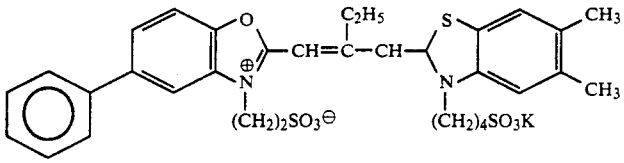
Sensitizing dye IV -continued
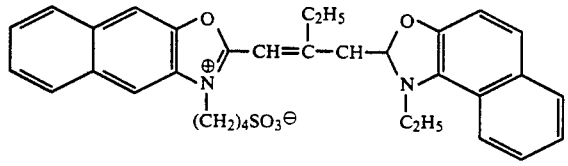
Sensitizing dye V
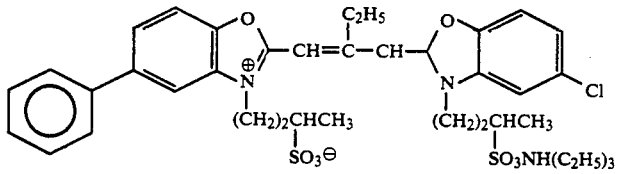
Sensitizing dye VI
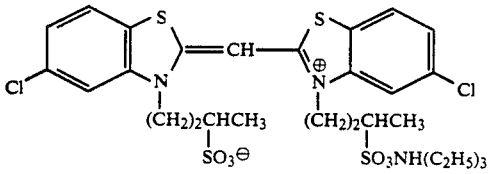
Sensitizing dye VII
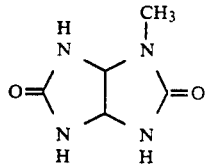
S-1
$CH_2{=}CH{-}SO_2{-}CH_2{-}CONH{-}CH_3$
$CH_2{=}CH{-}SO_2{-}CH_2{-}CONH{-}CH_2$
H-1
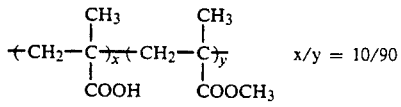
x/y = 10/90
B-1
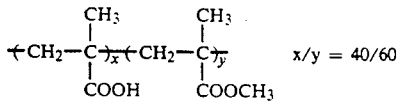
x/y = 40/60
B-2
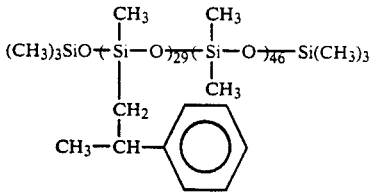
B-3
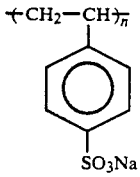
B-4
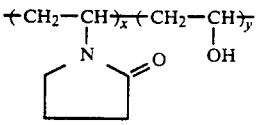
x/y = 70/30
B-5

-continued
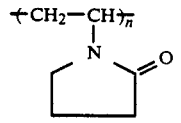
Average mol. wt.: about 10,000 B-6
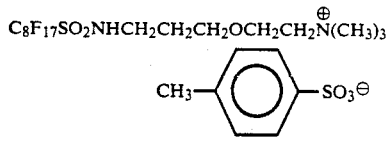
W-1
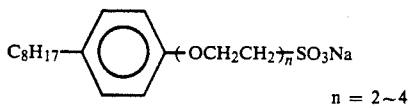
n = 2~4 W-2
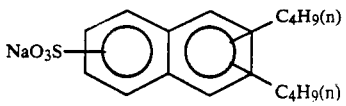
W-3
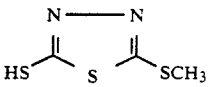
F-1
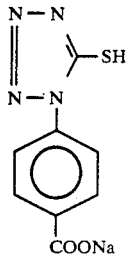
F-2
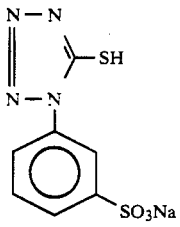
F-3
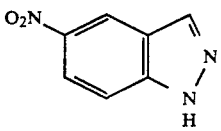
F-4
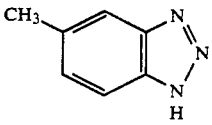
F-5
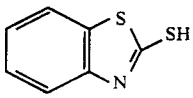
F-6

-continued

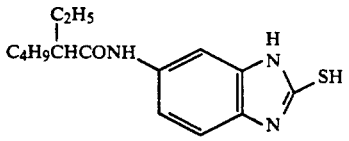

F-7

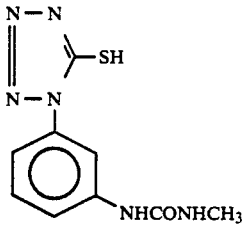

F-8

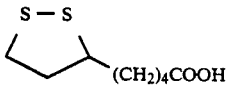

F-9

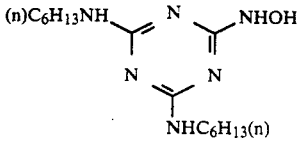

F-10

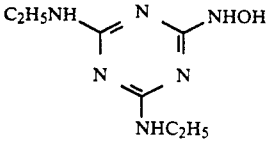

F-11

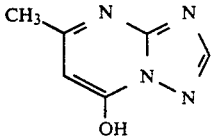

F-12

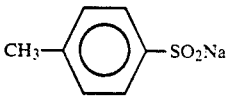

F-13

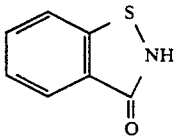

F-14

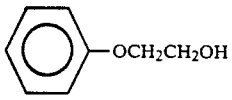

F-15

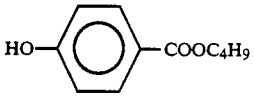

F-16

Sample 302 was prepared in the same manner as sample 301, except that the dispersion d of Example 1 was used in place of the yellow colloidal silver of the tenth layer and the dispersion was coated to provide a coating weight of compound 14 of 0.25 g.

The thus-obtained samples were exposed to white light through an optical wedge and processed in an automatic processor in the following manner. The samples were evaluated when the accumulated replenishment of the color developer solution reached three times the tank capacity of the mother solution.

| Processing Method (A) | | | | |
|---|---|---|---|---|
| Stage | Processing Time | Processing Temp. | Replenishment Rate | Tank Capacity |
| Color Development | 3 min 15 sec | 38° C. | 33 ml | 20 l |
| Bleaching | 6 min 30 sec | 38° C. | 25 ml | 40 l |
| Rinse | 2 min 10 sec | 24° C. | 1200 ml | 20 l |
| Fixing | 4 min 20 sec | 38° C. | 25 ml | 30 l |
| Rinse (1) | 1 min 05 sec | 24° C. | countercurrent piping system from (2) to (1) | 10 l |
| Rinse (2) | 1 min 00 sec | 24° C. | 1200 ml | 10 l |
| Stabilization | 1 min 05 sec | 38° C. | 25 ml | 10 l |
| Drying | 4 min 20 sec | 55° C. | | |

Replenishment rate per 1 m long by 35 mm wide strip processed.

Each processing solution had the following composition.

| | Mother Solution (g) | Replenisher (g) |
|---|---|---|
| Color developing solution | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-β-hydroxyethylamino]-2-methylaniline sulfate | 4.5 | 5.5 |
| Water to make | 1.0 liter | 1.0 liter |
| pH | 10.05 | 10.10 |
| Bleaching solution | | |
| Sodium ethylenediaminetetraacetato ferrate trihydrate | 100.0 | 120.0 |
| Disodium ethylenediaminetetraacetate | 10.0 | 10.0 |
| Ammonium bromide | 140.0 | 160.0 |
| Ammonium nitrate | 30.0 | 35.0 |
| Ammonia water (27 wt %) | 6.5 ml | 6.5 ml |
| Water to make | 1.0 liter | 1.0 liter |
| pH | 6.0 | 5.7 |
| Fixing solution | | |
| Disodium ethylenediaminetetraacetate | 0.5 | 0.7 |
| Sodium sulfite | 7.0 | 8.0 |
| Sodium bisulfite | 5.0 | 5.5 |
| Aqueous solution of ammonium thiosulfate (70 wt %) | 170.0 ml | 200.0 ml |
| Water to make | 1.0 liter | 1.0 liter |
| pH | 6.7 | 6.6 |
| Stabilizing solution | | |
| Formalin (37 wt %) | 2.0 ml | 3.0 ml |
| Polyoxyethylene p-monononylphenyl ether (average degree of polymerization: 10) | 0.3 | 0.45 |
| Disodium ethylenediaminetetraacetate | 0.05 | 0.08 |
| Water to make | 1.0 liter | 1.0 liter |
| pH | 5.0–8.0 | 5.0–8.0 |

After processing, the density of each sample was measured. The density [$D_B$(min)] of the fogged area of the blue-sensitive layer was calculated relative] to that of the sample 301 to evaluate the decolorizability of the dye.

The sensitivity of the green-sensitive layer was represented by the logarithmic value of the reciprocal of an exposure amount providing a density of (Fog+0.2), and evaluated relative to that of the sample 301 ($\Delta S_{0.2}$) The resulting values of sample 302 were such that $\Delta D_B(\text{min})=0.0$ and $\Delta S_{0.2}=0.07$.

The sample of the present invention provided $D_B$(min) equal to that of the sample 301. Namely, the sample of the present invention is excellent in decolorizability. Furthermore, the sample of the present invention exhibited greatly enhanced sensitivity of the green-sensitive layer. Thus, the dye dispersion of the present invention provides excellent absorption characteristics.

Samples 303 to 307 were prepared in the same manner as sample 302, except that the same dye/polymer combinations (weight ratio) as those prepared in Example 2, namely, D-2/P-11 (1), D-5/P-3 (1), D-7/P-16 (0.7), D-11/P-133 (2), D-27/P-13 (1) were used in place of compound D-14 and polymer P-14 of the tenth layer of sample 302. The resulting samples were evaluated in the same manner as described above. Each of the samples provided good results substantially equal to those of the sample 302.

EXAMPLE 5

Preparation of Sample 402

Sample 402 was prepared in the same manner as sample 301, except that the water-soluble dye (compound A) of Example 3 was used in place of the yellow colloidal silver of the tenth layer, and coated in a coating weight of 0.20 g/m$^2$.

Preparation of Samples 403 to 409

Samples 403 to 409 were prepared in the same manner as sample 402, except that the dye indicated in Table 5 was used in an equimolar amount of that of the water-soluble dye of sample 402, and the dispersions prepared in the above described dispersion methods A to E were used as indicated in Table 5.

Preparation of Samples 410 to 412

Samples 410 to 412 were prepared in the same manner as sample 409, except that an equimolar amount of the dye D-11, D-15 or D-31 was used in place of the dye D-30 of the tenth layer of sample 409.

Preparation of Samples 413 to 415

Samples 413 to 415 were prepared in the same manner as sample 409, except that an equal amount by weight of the polymer 154, 157 or 161 of the present invention was used in place of polymer P-147 of the present invention for dispersion of the dye in the tenth layer.

The thus-obtained samples were exposed to white light through an optical wedge and processed in an automatic processor according to the processing method A described in Example 4. The samples were evaluated when the accumulated replenishment of the developer solution reached three times the tank capacity of the mother solution.

After processing, the density of each sample was measured. The density [$D_B$(min)] of the fogged area of the blue-sensitive layer was calculated relative] to that of sample 301 to evaluate the decolorizability of the dye.

The sensitivity of the green-sensitive layer was represented by the logarithmic value of the reciprocal of an exposure amount providing a density of (Fog+0.2) and evaluated relative to that of sample 301.

Furthermore, adhesion of the coated layer was evaluated in the same manner as in Example 3.

The results are shown in Table 5.

TABLE 5

| Sample No. | Dye used in tenth layer | Dispersion method of dye | Relative value of fog density of blue-sensitive layer ($\Delta D_B$ (min)) | Relative sensitivity of green-sensitive layer | Adhesion |
|---|---|---|---|---|---|
| 301 (Comp. Ex.) | — | — | ± | ± | A |
| 402 (Comp. Ex.) | Compound A | aqueous solution | +0.01 | −0.04 | A |
| 403 (Comp. Ex.) | Compound A | dispersion method A | +0.07 | −0.03 | C |
| 404 (Comp. Ex.) | D-30 | dispersion method B | +0.01 | −0.02 | A |
| 405 (Comp. Ex.) | D-30 | dispersion method C | +0.04 | +0.02 | A |
| 406 (Comp. Ex.) | D-30 | dispersion method D | +0.06 | +0.08 | C |
| 407 (Invention) | D-30 | dispersion method E (P-36) | +0.06 | +0.08 | A |
| 408 (Invention) | D-30 | dispersion method E (P-3) | +0.02 | +0.02 | A |
| 409 (Invention) | D-30 | dispersion method E (P-147) | +0.01 | +0.10 | A |
| 410 (Invention) | D-11 | dispersion method E (P-147) | +0.02 | +0.08 | A |
| 411 (Invention) | D-15 | dispersion method E | +0.01 | +0.08 | A |
| 412 (Invention) | D-31 | dispersion method E | +0.01 | +0.09 | A |
| 413 (Invention) | D-30 | dispersion method E (P-154) | +0.02 | +0.08 | A |
| 414 (Invention) | D-30 | dispersion method E (P-154) | +0.01 | +0.09 | A |
| 415 (Invention) | D-30 | dispersion method E (P-161) | +0.01 | +0.08 | A |

It is clearly seen from Table 5 that all of the samples of the present invention were superior in mechanical strength of the dye layer to comparative samples 403 and 406. Samples 402, 404 and 405 which had good mechanical strength were disadvantageous in that either the sensitivity of the green-sensitive layer was lowered, or the fog density of the blue-sensitive layer was greatly increased. Samples 407 and 408 of the present invention were superior in terms of fog density as well as sensitivity as compared to the comparative samples, but were not on a sufficient level with regard to the dispersion of the dye D-30. It is also clear that in the samples 409 to 415 obtained using polymers prepared from hydrophobic acid monomers, decolorization performance as well as sensitivity was further improved independent of the type of dye employed.

The samples were also treated with the processing method B. The samples of the present invention exhibited excellent decolorization performance as well as improved sensitivity of the lower green-sensitive layer in the same manner as treatment with the processing method A.

| | Processing Method B | | | |
|---|---|---|---|---|
| Stage | Processing Time | Processing Temp. | Replenishment Rate* | Tank Capacity |
| Color Development | 3 min 15 sec | 37.8° C. | 25 ml | 10 l |
| Bleaching | 45 sec | 38° C. | 5 ml | 4 l |
| Bleaching-Fixing (1) | 45 sec | 38° C. | 30 ml | 4 l |
| Bleaching-Fixing (2) | 45 sec | 38° C. | — | 4 l |
| Rinse (1) | 20 sec | 38° C. | — | 2 l |
| Rinse (2) | 20 sec | 38° C. | 30 ml | 2 l |
| Stabilization | 20 sec | 38° C. | 20 ml | 2 l |
| Drying | 1 min | 55° C. | | |

*Replenishment rate per 1 m long by 35 mm wide strip processed.

In the bleaching-fixing stage and the rinsing stage, a countercurrent system of from (2) to (1) was used. The entire overflow solution of the bleaching solution was introduced into the bleaching-fixing stage (2).

The amount of the bleaching-fixing solution carried over from the bleaching-fixing stage to the rinsing stage in the above processing was 2 ml per one meter long strip of a 35 mm wide light-sensitive material processed.

| | Mother Solution (g) | Replenisher (g) |
|---|---|---|
| Color developing solution | | |
| Diethylenetriaminepentaacetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-ethyl-N-β-hydroxyethylamino]-2-methylaniline sulfate | 4.7 | 6.2 |
| Water to make | 1.0 liter | 1.0 liter |

-continued

| | Mother Solution (g) | Replenisher (g) |
|---|---|---|
| pH | 10.0 | 10.15 |
| Bleaching solution | | |
| Ammonium 1,3-diamino-propanetetracetato ferrate monohydrate | 144.0 | 206.0 |
| 1,3-Diaminopropanetetraacetic acid | 2.8 | 4.0 |
| Ammonium bromide | 84.0 | 120.0 |
| Ammonium nitrate | 17.5 | 25.0 |
| Ammonia water (27 wt %) | 10.0 | 1.8 |
| Acetic acid (98 wt %) | 51.1 | 73.0 |
| Water to make | 1.0 liter | 1.0 liter |
| pH | 4.3 | 3.4 |
| Bleaching-fixing solution | | |
| Ammonium ethylenediamine-tetraacetato ferrate dihydrate | 50.0 | — |
| Disodium ethylenediamine-tetraacetate | 5.0 | 25.0 |
| Ammonium sulfite | 12.0 | 20.0 |
| Aqueous solution of ammonium thiosulfate (700 g/l) | 290.0 ml | 320.0 ml |
| Ammonia water (27 wt %) | 6.0 ml | 15.0 ml |
| Water to make | 1.0 liter | 1.0 liter |
| pH | 6.8 | 8.0 |

Rinsing Water

The mother solution and replenisher had the same composition.

Tap water was passed through a mixed bed column packed with an H type strongly acidic cation exchange resin (Amberlite IR-120B, manufactured by Rohm & Haas Co.) and an OH type strongly basic anion exchange resin (Amberlite IRA-400) to reduce the concentration of each of calcium ion and magnesium ion to not higher than 3 mg/l. Subsequently, sodium dichlorinated isocyanurate (20 mg/l) and sodium sulfate (150 mg/l) were added thereto. The pH of the resulting solution was in the range of from 6.5 to 7.5.

Stabilizing Solution

Mother solution and replenisher being the same.

| | |
|---|---|
| Formalin (37 wt%) | 1.2 ml |
| Surfactant $[C_{10}H_{21}—O—(CH_2CH_2O)_{10}—H]$ | 0.4 g |
| Ethylene glycol | 1.0 g |
| Water to make | 1.0 liter |
| pH | 5.0 to 7.0 |

EXAMPLE 6

Preparation of Sample 501

The layers described below having the following compositions were coated on an undercoated cellulose triacetate film support having a thickness of 127 μ to prepare a multi-layer color light-sensitive material as sample 501.

The numerals to the right represent the coating weight per $m^2$ of the photographic material. The effects of the compounds added are not limited to those described below.

| | |
|---|---|
| First layer (antihalation layer) | |
| Black colloidal silver | 0.20 g |
| Gelatin | 1.9 g |
| Ultraviolet light absorber U-1 | 0.1 g |
| Ultraviolet light absorber U-3 | 0.04 g |
| Ultraviolet light absorber U-4 | 0.1 g |
| High-boiling organic solvent Oil-1 | 0.1 g |
| Second layer (interlayer) | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| Third layer (interlayer) | |
| Fine silver iodobromide grain emulsion wherein the surfaces and interiors of the grains were fogged (mean grain size: 0.06 μm, coefficient of variation: 18%, AgI content: 1 mol %) (in terms of silver) | 0.05 g |
| Gelatin | 0.4 g |
| Fourth layer (low-sensitivity red-sensitive emulsion layer) | |
| Emulsion A (in terms of silver) | 0.1 g |
| Emulsion B (in terms of silver) | 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| Fifth layer (intermediate-sensitivity red-sensitive emulsion layer) | |
| Emulsion B (in terms of silver) | 0.2 g |
| Emulsion C (in terms of silver) | 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| Sixth layer (high-sensitivity red-sensitive emulsion layer) | |
| Emulsion D (in terms of silver) | 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer (interlayer) | |
| Gelatin | 0.6 g |
| Additive M-1 | 0.3 g |
| Color mixing inhibitor Cpd-1 | 2.6 mg |
| Ultraviolet light absorber U-1 | 0.01 g |
| Ultraviolet light absorber U-2 | 0.002 g |
| Ultraviolet light absorber U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| Eighth layer (interlayer) | |
| Silver iodobromide emulsion wherein the surfaces and interiors of the grains were fogged (mean grain size: 0.06 μm, coefficient of variation: 16%, AgI content: 0.3 mol %) (in terms of silver) | 0.02 g |
| Gelatin | 1.0 g |
| Additive P-1 | 0.2 g |
| Color mixing inhibitor Cpd-A | 0.1 g |
| Ninth layer (low-sensitivity green-sensitive emulsion layer) | |
| Emulsion E (in terms of silver) | 0.1 g |
| Emulsion F (in terms of silver) | 0.2 g |
| Emulsion G (in terms of silver) | 0.2 g |
| Gelatin | 0.5 g |
| Coupler C-4 | 0.1 g |

-continued

| | |
|---|---|
| Coupler C-7 | 0.05 g |
| Coupler C-8 | 0.20 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| Tenth layer (intermediate-sensitivity green-sensitive emulsion layer) | |
| Emulsion G (in terms of silver) | 0.3 g |
| Emulsion H (in terms of silver) | 0.1 g |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High-boiling organic solvent Oil-2 | 0.01 g |
| Eleventh layer (high-sensitivity green-sensitive emulsion layer) | |
| Emulsion I (in terms of silver) | 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| Twelfth layer (interlayer) | |
| Gelatin | 0.6 g |
| Thirteenth layer (yellow filter layer) | |
| Yellow colloidal silver (in terms of silver) | 0.07 g |
| Gelatin | 1.1 g |
| Color mixing inhibitor Cpd-A | 0.01 g |
| High-boiling organic solvent Oil-1 | 0.01 g |
| Fourteenth layer (interlayer) | |
| Gelatin | 0.6 g |
| Fifteen layer (low-sensitivity blue-sensitive emulsion layer) | |
| Emulsion J (in terms of silver) | 0.2 g |
| Emulsion K (in terms of silver) | 0.3 g |
| Emulsion L (in terms of silver) | 0.1 g |
| Gelatin | 0.8 g |

-continued

| | |
|---|---|
| Coupler C-5 | 0.2 g |
| Coupler C-6 | 0.1 g |
| Coupler C-10 | 0.4 g |
| Sixteenth layer (intermediate-sensitivity blue-sensitive emulsion layer) | |
| Emulsion L (in terms of silver) | 0.1 g |
| Emulsion M (in terms of silver) | 0.4 g |
| Gelatin | 0.9 g |
| Coupler C-5 | 0.3 g |
| Coupler C-6 | 0.1 g |
| Coupler C-10 | 0.1 g |
| Seventeenth layer (high-sensitivity blue-sensitive emulsion layer) | |
| Emulsion N (in terms of silver) | 0.4 g |
| Gelatin | 1.2 g |
| Coupler C-5 | 0.3 g |
| Coupler C-6 | 0.6 g |
| Coupler C-10 | 0.1 g |
| Eighteenth layer (first protective layer) | |
| Gelatin | 0.7 g |
| Ultraviolet light absorber U-1 | 0.2 g |
| Ultraviolet light absorber U-2 | 0.05 g |
| Ultraviolet light absorber U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth layer (second protective layer) | |
| Colloidal silver (in terms of silver) | 0.1 mg |
| Fine silver iodobromide grain emulsion (mean grain size: 0.06 μm, AgI content: 1 mol %) (in terms of silver) | 0.1 g |
| Gelatin | 0.4 g |
| Twentieth layer (third protective layer) | |
| Gelatin | 0.4 g |
| Polymethyl methacrylate (average particle size: 1.5μ) | 0.1 g |
| Methyl methacrylate-acrylic acid (4:6) copolymer (average particle/size: 1.5 μm) | 0.1 g |
| Silicone oil | 0.03 g |
| Surfactant W-1 | 3.0 mg |
| Surfactant W-2 | 0.03 g |

Additives F-1 to F-8 in addition to the above-described ingredients were added to each of the silver halide emulsion layers. Further, hardening agent H-1 for gelatin and surfactants W-3, W-4, W-5 and W-6 for coating and emulsifying in addition to the above-described ingredients were added to each layer.

Furthermore, phenol, 1,2-benzisothiazoline-3-one, 2-phenoxyethanol, phenethyl alcohol and butyl p-benzoate as antiseptic and antifungal agents were added to the photographic material.

TABLE 6

The following silver iodobromide emulsions were used in sample 501.

| Emulsion | Grains | Mean grain size in terms of diameter of a sphere (μm) | Coefficient of variation (%) | AgI content (%) |
|---|---|---|---|---|
| A | Monodisperse tetradecahedral grains | 0.28 | 16 | 3.7 |
| B | Monodisperse cubic internal latent image type grains | 0.30 | 10 | 3.3 |
| C | Monodisperse tabular grains, average aspect ratio: 4.0 | 0.38 | 18 | 5.0 |
| D | Tabular grains, average aspect ratio: 8.0 | 0.68 | 25 | 2.0 |
| E | Monodisperse cubic grains | 0.20 | 17 | 4.0 |
| F | Monodisperse cubic grains | 0.23 | 16 | 4.0 |
| G | Monodisperse cubic internal latent image type grains | 0.28 | 11 | 3.5 |
| H | Monodisperse cubic internal latent image type grains | 0.32 | 9 | 3.5 |
| I | Tabular grains, average aspect ratio: 9.0 | 0.80 | 28 | 1.5 |
| J | Monodisperse tetradecahedral grains | 0.30 | 18 | 4.0 |
| K | Monodisperse tabular grains, average aspect ratio: 7.0 | 0.45 | 17 | 4.0 |
| L | Monodisperse cubic internal latent image type grains | 0.46 | 14 | 3.5 |
| M | Monodisperse tabular grains, average aspect ratio: 10.0 | 0.55 | 13 | 4.0 |

TABLE 6-continued

The following silver iodobromide emulsions were used in sample 501.

| Emulsion | Grains | Mean grain size in terms of diameter of a sphere (μm) | Coefficient of variation (%) | AgI content (%) |
|---|---|---|---|---|
| N | Tabular grains, average aspect ratio: 12.0 | 1.00 | 33 | 1.3 |

TABLE 7

Spectral sensitizing dye used in the emulsions A to N

| Emulsion | Sensitizing dye added | Amount of sensitizing dye added per mol of silver halide (g) |
|---|---|---|
| A | S-1 | 0.025 |
| | S-2 | 0.25 |
| | S-7 | 0.01 |
| B | S-1 | 0.01 |
| | S-2 | 0.25 |
| | S-7 | 0.01 |
| C | S-1 | 0.02 |
| | S-2 | 0.25 |
| | S-7 | 0.01 |
| D | S-1 | 0.01 |
| | S-2 | 0.10 |
| | S-7 | 0.01 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.05 |
| H | S-3 | 0.2 |
| | S-4 | 0.06 |
| | S-8 | 0.05 |

TABLE 7-continued

Spectral sensitizing dye used in the emulsions A to N

| Emulsion | Sensitizing dye added | Amount of sensitizing dye added per mol of silver halide (g) |
|---|---|---|
| I | S-3 | 0.3 |
| | S-4 | 0.07 |
| | S-8 | 0.1 |
| J | S-6 | 0.2 |
| | S-5 | 0.05 |

TABLE 8

Spectral sensitizing dye used in the emulsions K to N

| Emulsion | Sensitizing dye added | Amount of sensitizing dye added per mol of silver halide (g) |
|---|---|---|
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

C-1

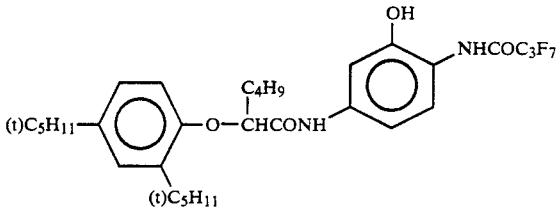

C-2

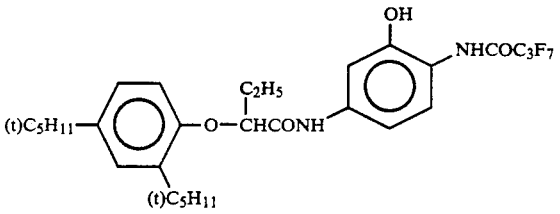

C-3

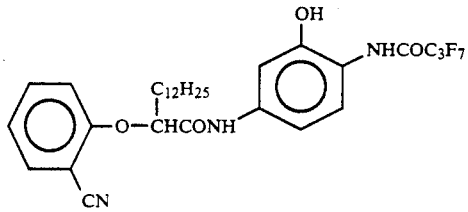

-continued
C-4
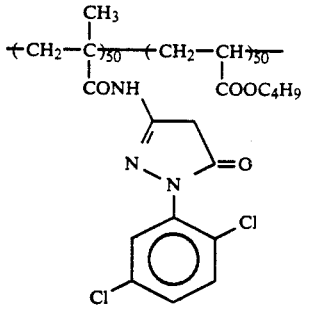
Numeral represents wt %
Average Mol. Wt.: about 25,000
C-5
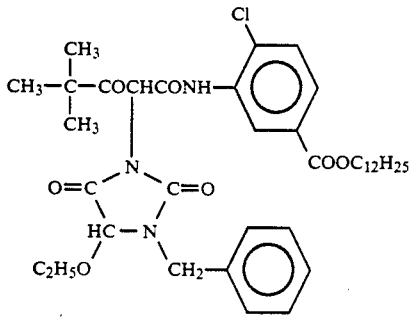
C-6
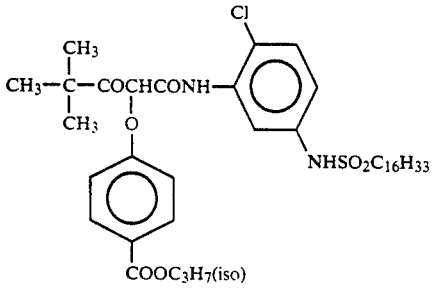
C-7
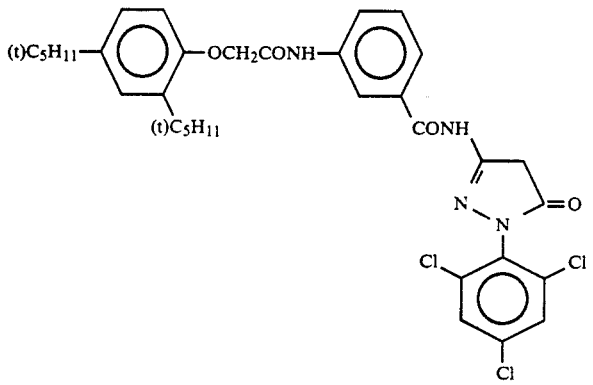

-continued
C-8
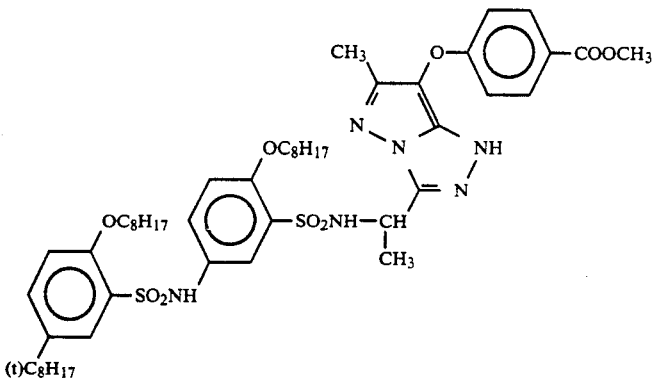
C-9
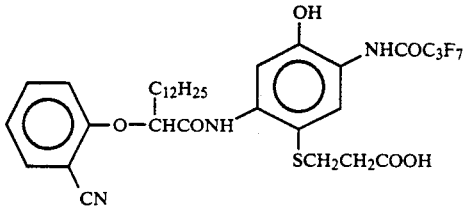
C-10
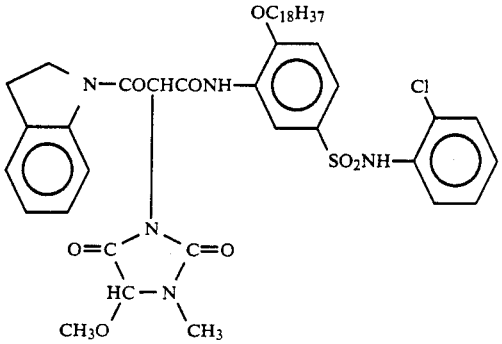
Dibutyl phthalate — Oil-1
Tricresyl phosphate — Oil-2
Oil-3
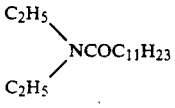
Cpd-A
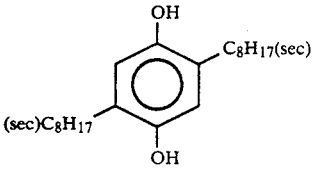
Cpd-B
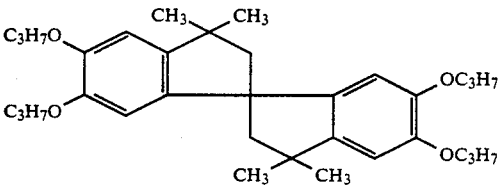
Cpd-C
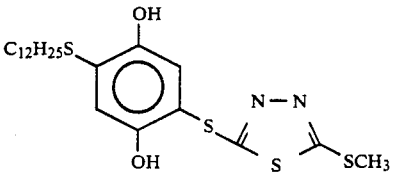

-continued
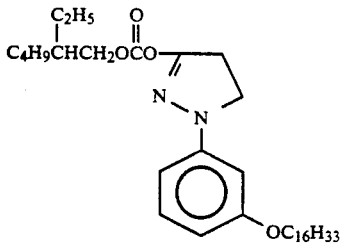
Cpd-D
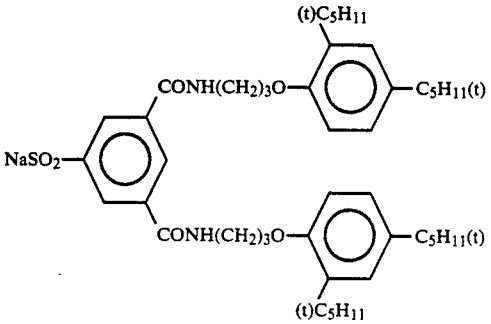
Cpd-E
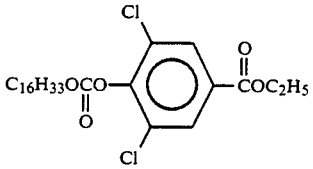
Cpd-F
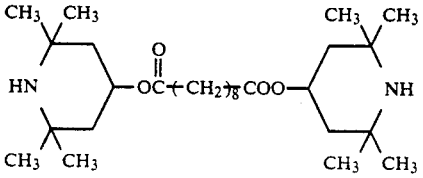
Cpd-G
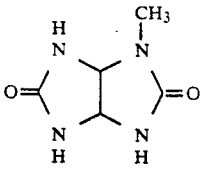
Cpd-H
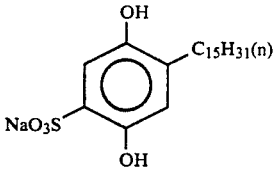
Cpd-I
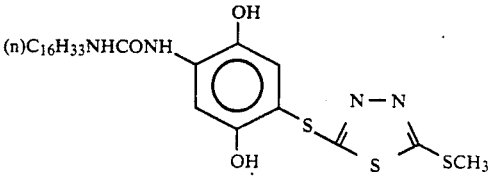
Cpd-J -continued
Cpd-K
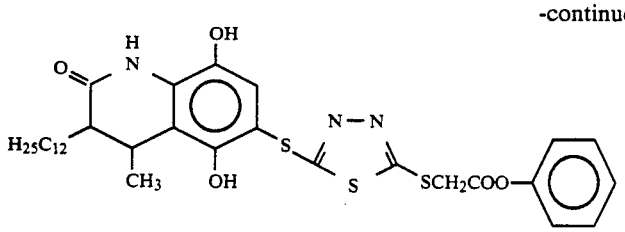
U-1
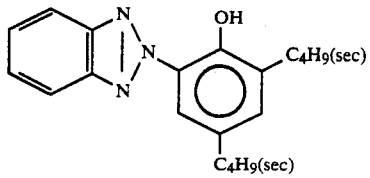
U-2
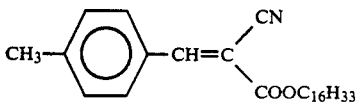
U-3
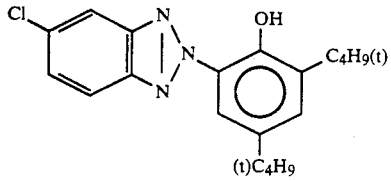
U-4
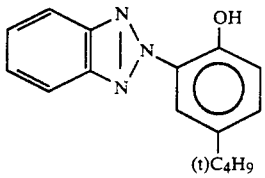
U-5
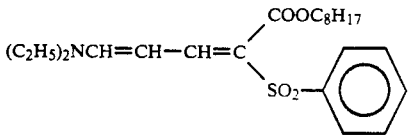
S-1
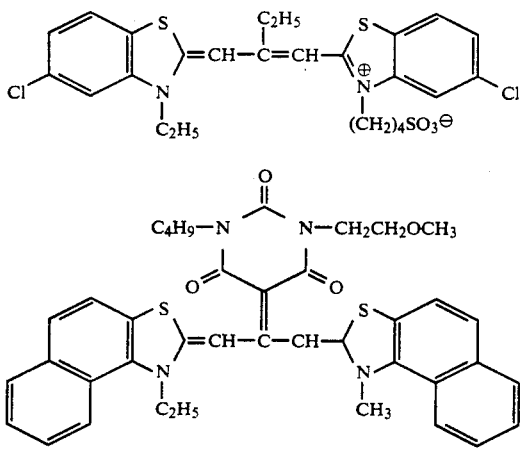
S-2
S-3
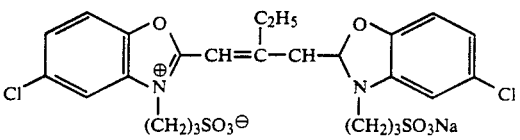

-continued
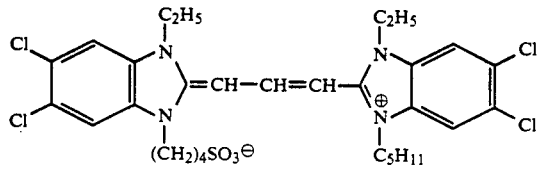
S-4
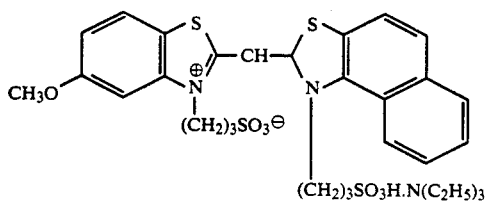
S-5
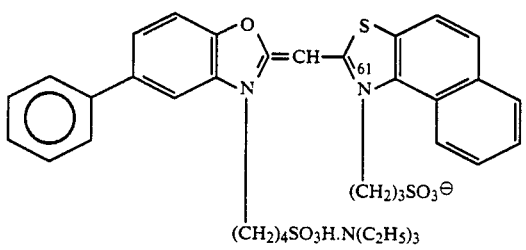
S-6
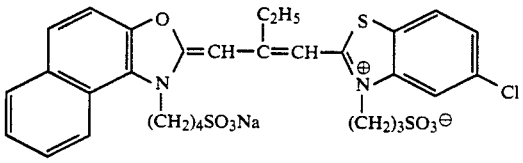
S-7
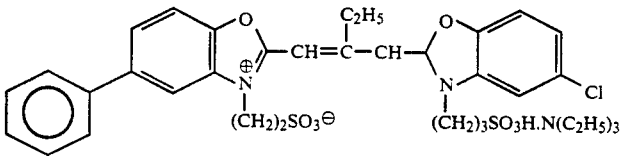
S-8
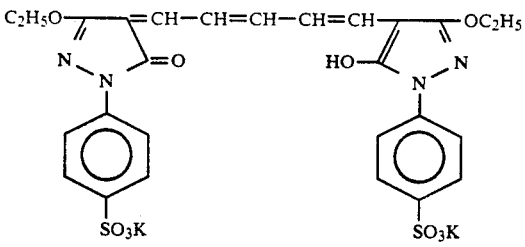
D-1
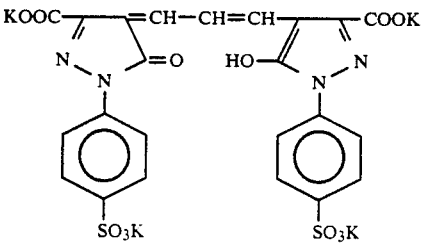
D-2

-continued
D-3
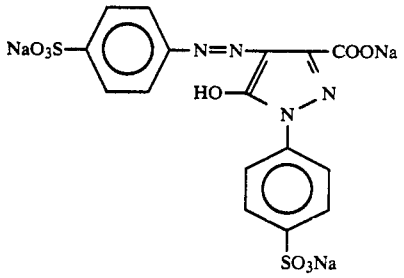
D-4
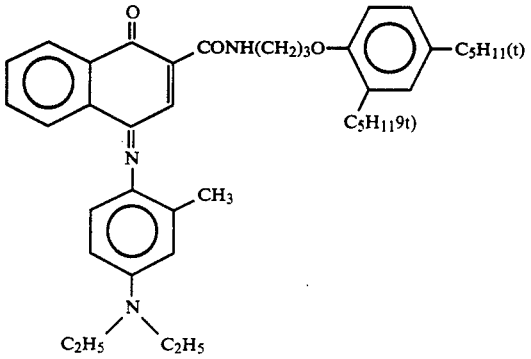
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_17SO_2NHCH_2CH_2CH_2OCH_2CH_2\overset{\oplus}{N}(CH_3)_3$
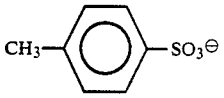
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
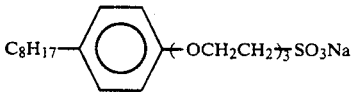
W-5
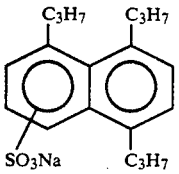
W-6
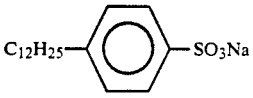
P-1
$\left(CH_2{-}CH(CONHC_4H_9(t))\right)_n$
M-1
$\left(CH_2{-}CH(COOC_4H_9)\right)_n$ -continued

F-1

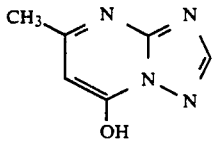

F-2

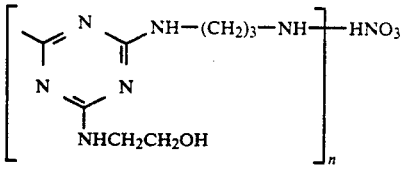

F-3

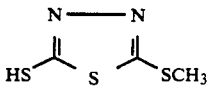

F-4

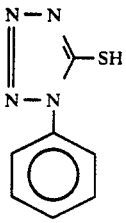

F-5

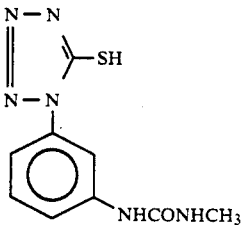

F-6

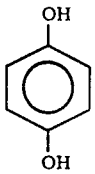

F-7

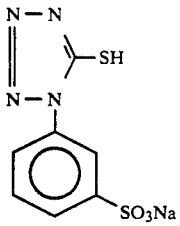

F-8

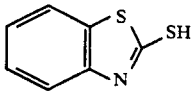

Preparation of Sample 502

Sample 502 was prepared in the same manner as sample 501, except that the dye (compound A) used in sample 402 of Example 5 was used in place of the yellow colloidal silver of the thirteenth layer of sample 501. The dye was coated in a coating weight of 0.26/m$^2$.

Preparation of Samples 503 to 508

Samples 503 to 508 were prepared in the same manner as sample 502, except that an equimolar amount of the oil-soluble dye D-30 of the present invention was used in place of the dye A of the thirteenth layer of the sample 502. Dispersions of the oil-soluble dye D-30 were prepared in accordance with the dispersion methods A to E.

Preparation of Samples 509 to 511

Samples 509 to 511 were prepared in the same manner as sample 508, except that an equimolar amount of D-11, D-15 or D-31 was used in place of D-30 in sample 508.

Preparation of Samples 512 to 514

Samples 512 to 514 were prepared in the same manner as sample 508, except that an equal amount by weight of polymer P-154, P-157 or P-161 of the present invention was used in place of polymer P-147 of the present invention in preparing the dispersion of the dye of the thirteenth layer of sample 508.

The thus-obtained samples 501 to 514 were exposed to white light through an optical wedge and processed in an automatic processor using the following methods C and D.

Results similar to those of Example 5 were obtained in processing of these samples. Samples 508 to 514 exhibited a higher sensitivity of the green-sensitive layer in comparison with samples 503 to 506, and Dmin was substantially equal to that of sample 501. Furthermore, when the samples of the present invention were stored under high-temperature conditions, the degree of desensitization was very low, and reduction in the maximum density was very small.

| Processing method C | | | | |
|---|---|---|---|---|
| Processing Stage | Time | Temp. | Tank capacity | Replenishment rate |
| First development | 6 min | 38° C. | 12 l | 2200 ml/m$^2$ |
| First rinse | 2 min | 38° C. | 4 l | 7500 ml/m$^2$ |
| Reversal | 2 min | 38° C. | 4 l | 1100 ml/m$^2$ |
| Color development | 6 min | 38° C. | 12 l | 2200 ml/m$^2$ |
| Compensating | 2 min | 38° C. | 4 l | 1100 ml/m$^2$ |
| Bleaching | 6 min | 38° C. | 12 l | 220 ml/m$^2$ |
| Fixing | 4 min | 38° C. | 8 l | 1100 ml/m$^2$ |
| Second rinse | 4 min | 38° C. | 8 l | 7500 ml/m$^2$ |
| Stabilization | 1 min | 25° C. | 2 l | 1100 ml/m$^2$ |

Each processing solution had the following composition.

| First developing solution | | |
|---|---|---|
| | Tank Solution | Replenisher |
| Pentasodium nitrilo-N,N,N-trimethylenephosphonate | 1.5 g | 1.5 g |
| Pentasodium diethylenetriaminepentaacetate | 2.0 g | 2.0 g |
| Sodium sulfite | 30 g | 30 g |
| Potassium hydroquinone-monosulfonate | 20 g | 20 g |
| Potassium carbonate | 15 g | 20 g |
| Sodium bisulfite | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1000 ml | 1000 ml |
| pH | 9.60 | 9.60 |

The pH was adjusted with hydrochloric acid or potassium hydroxide.

Reversal Developer

The composition of replenisher being the same as that of tank solution.

| | Tank Solution |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH | 6.0 |

The pH was adjusted with hydrochloric acid or sodium hydroxide.

| Color developing solution | | |
|---|---|---|
| | Tank Solution | Replenisher |
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methanesulfonamidoethyl)-3-methyl-4-aminoaniline 3/2 sulfate monohydrate | 11 g | 11 g |
| 3,6-Dithiaoctane-1,8-diol | 1.0 g | 1.0 g |
| Water to make | 1000 ml | 1000 ml |
| pH | 11.80 | 12.00 |

The pH was adjusted with hydrochloric acid or potassium hydroxide.

| Compensating solution | | |
|---|---|---|
| | Tank Solution | Replenisher |
| Disodium ethylenediaminetetraacetate dihydrate | 8.0 g | 8.0 g |
| Sodium sulfite | 12 g | 12 g |
| 1-Thioglycerol | 0.4 g | 0.4 g |
| Formaldehyde-sodium bisulfite adduct | 30 g | 30 g |
| Water to make | 1000 ml | 1000 ml |
| pH | 6.30 | 6.10 |

The pH was adjusted with hydrochloric acid or sodium hydroxide.

| Bleaching solution | | |
|---|---|---|
| | Tank Solution | Replenisher |
| Disodium ethylenediaminetetraacetate dihydrate | 2.0 g | 4.0 g |
| Ammonium ethylenediaminetetraacetato Fe(III) dihydrate | 120 g | 240 g |
| Potassium bromide | 100 g | 200 g |
| Ammonium nitrate | 10 g | 20 g |
| Water to make | 1000 ml | 1000 ml |
| pH | 5.70 | 5.50 |

The pH was adjusted with hydrochloric acid or sodium hydroxide.

Fixing Solution

The composition of replenisher was the same as that of the tank solution.

| | Tank solution |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was adjusted with hydrochloric acid or ammonia water.

| Stabilizing solution | Tank Solution | Replenisher |
|---|---|---|
| Benzisothiazoline-3-one | 0.02 g | 0.03 g |
| Polyoxyethylene p-monononyl-phenyl ether (average degree of polymerization: 10) | 0.3 g | 0.3 g |
| Water to make | 1000 ml | 1000 ml |
| pH | 7.0 | 7.0 |

Processing method D

| Processing Stage | Time | Temp. | Tank capacity | Replenishment rate |
|---|---|---|---|---|
| First development | 6 min | 38° C. | 12 l | 2200 ml/m$^2$ |
| First rinse | 45 sec | 38° C. | 2 l | 2200 ml/m$^2$ |
| Reversal | 45 sec | 38° C. | 2 l | 1100 ml/m$^2$ |
| Color development | 6 min | 38° C. | 12 l | 2200 ml/m$^2$ |
| Bleaching | 2 min | 38° C. | 4 l | 860 ml/m$^2$ |
| Bleaching-Fixing | 4 min | 38° C. | 8 l | 1100 ml/m$^2$ |
| Second rinse (1) | 1 min | 38° C. | 2 l | — |
| Second rinse (2) | 1 min | 38° C. | 2 l | 1100 ml/m$^2$ |
| Stabilization | 1 min | 25° C. | 2 l | 1100 ml/m$^2$ |
| Drying | 1 min | 65° C. | | |

Replenishment to the second rinse stage was carried out by a countercurrent replenishment system, wherein a replenisher was introduced into the second rinse stage (2), and the overflow solution from the second rinse stage (2) was introduced into the seccnd rinse stage (1).

Each processing solution had the following composition.

| First developing solution | Tank Solution | Replenisher |
|---|---|---|
| Pentasodium nitrilo-N,N,N-trimethylenephosphonate | 2.0 g | 2.0 g |
| Sodium sulfite | 30 g | 30 g |
| Potassium hydroquinone-monosulfonate | 20 g | 20 g |
| Potassium carbonate | 33 g | 33 g |
| 1-Phenyl-4-methyl-4-hydroxy-methyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1000 ml | 1000 ml |
| pH | 9.60 | 9.60 |

The pH was adjusted with hydrochloric acid or potassium hydroxide.

First Rinsing Solution

The composition of replenisher was the same as that of the tank solution.

| | Tank solution |
|---|---|
| Ethylenediaminetetramethylene-phosphonic acid | 2.0 g |
| Disodium phosphonate | 5.0 g |
| Water to make | 1000 ml |
| pH | 7.00 |

The pH was adjusted with hydrochloric acid or sodium hydroxide.

Reversal Developer

The composition of replenisher was the same as that of the tank solution.

| | Tank solution |
|---|---|
| Pentasodium nitrilo-N,N,N-trimethylene-phosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH | 6.00 |

The pH was adjusted with hydrochloric acid or sodium hydroxide.

| Color developing solution | Tank Solution | Replenisher |
|---|---|---|
| Pentasodium nitrilo-N,N,N-trimethylene phosphonate | 2.0 g | 2.0 g |
| Sodium sulfite | 7.0 g | 7.0 g |
| Trisodium phosphate decahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methane-sulfonamidoethyl)-3-methyl-4-aminoaniline 3/2 sulfate monohydrate | 11 g | 11 g |
| 3,6-Dithiaoctane-1,8-diol | 1.0 g | 1.0 g |
| Water to make | 1000 ml | 1000 ml |
| pH | 11.80 | 12.00 |

The pH was adjusted with hydrochloric acid or potassium hydroxide.

Bleaching Developer

The composition of replenisher was the same as that of the tank solution.

| | Tank solution |
|---|---|
| Disodium ethylenediaminetetraacetate dihydrate | 10.0 g |
| Ammonium ethylenediaminetetraacetato Fe(III) dihydrate | 120 g |
| Potassium bromide | 100 g |
| Ammonium nitrate | 10 g |
| Bleaching accelerator $(CH_3)_2N—CH_2—CH_2—S—S—CH_2—CH_2—N(CH_3)_2.2HCl$ | 0.005 mol |
| Water to make | 1000 ml |

-continued

| | Tank solution |
|---|---|
| pH | 6.30 |

The pH was adjusted with hydrochloric acid or ammonia water.

Bleaching-Fixing Solution

The composition of replenisher was the same as that of the tank solution.

| | Tank solution |
|---|---|
| Disodium ethylenediaminetetraacetate dihydrate | 5.0 g |
| Ammonium ethylenediaminetetraacetato Fe(III) dihydrate | 50 g |
| Ammonium thiosulfate | 80 g |
| Sodium sulfite | 12.0 g |
| Water to make | 1000 ml |
| pH | 6.60 |

The pH was adjusted with hydrochloric acid or ammonia water.

Second Rinsing Solution

The Tank solution and replenisher had the same composition.

Tap water was passed through a mixed bed column packed with an H type strongly acidic cation exchange resin (Amberlite IR-120B, manufactured by Rohm & Haas Co.) and an OH type anion exchange resin (Amberlite IR-400) t reduce the concentration of each of calcium ion and magnesium ion to not higher than 3 mg/l. Subsequently, sodium dichlorinated isocyanurate (20 mg/l) and sodium sulfate (1.5 g/l) were added thereto. The pH of the solution was in the range of from 6.5 to 7.5.

Stabilizing Solution

The composition of the replenisher was the same as that of the tank solution.

| | Tank solution |
|---|---|
| Formalin (37%) | 0.5 ml |
| Polyoxyethylene p-monononyl-phenyl ether (average degree of polymerization: 10) | 0.3 g |
| Triazole | 1.7 g |
| Piperazine hexahydrate | 0.6 g |
| Water to make | 1000 ml |
| pH | not adjusted |

EXAMPLE 7

Preparation of Emulsion

A solution I having the following formulation was mixed with a solution II having the following formulation. The mixture was stirred and dispersed (4 times, each time for 2 minutes) at 40° C. in a homogenizer at 15,000 rpm. Subsequently, water was added thereto to adjust the total weight, thus obtaining an emulsion.

| | |
|---|---|
| Solution I | |
| Deashed gelatin | 20 g |
| Proxel (3.5 wt %) | 2 ml |

-continued

| | |
|---|---|
| Water | 180 ml |
| Solution II | |
| Dye (D-14) | 10 g |
| Polymer indicated in Table 9 | 10 g |
| Ethyl acetate | 60 ml |
| Methanol | 5 ml |
| Sodium dodecylbenzenesulfonate (72 wt %) | 4 g |
| Add water after emulsification | up to 400 g |

Preparation of Single Layer-Coated Film

Gelatin, water and 2 wt% (based on the total amount of gelatin) of 1,2-bis(vinylsulfonylacetamido)ethane were added to each of the above emulsions. The resulting emulsion was coated on a gelatin-undercoated polyethylene terephthalate support having a thickness of 180 μm to form a coating layer mainly having the following composition.

| | |
|---|---|
| Gelatin | 4 g/m$^2$ |
| Dye | 140 mg/m$^2$ |
| Polymer | 140 mg/m$^2$ |

Measurement of Spectral Absorption Spectrum

The coated film was measured with a Hitachi 320 type spectrophotometer to determine the maximum absorption wavelength (λmax), half width (HBW) and absorbance (Abs) at the maximum absorption wavelength. The results together with the polymers used are shown in Table 9.

Test of Decolorizability

A solution of sodium sulfite (10 g/l) dissolved in a phosphate buffer solution having a pH of 10 was kept at 35° C. The film was immersed in the solution with stirring in a nitrogen gas stream for 45 seconds, washed for 30 seconds with running water and dried. Three of the films were placed in layers, and the density of the laminate of the three films was measured with a Macbeth densitometer to evaluate residual color (the density of the base was deducted in this measurement).

TABLE 9

| Coating No. | Dispersion No. | Polymer | λmax | Abs | HBW | Residual color |
|---|---|---|---|---|---|---|
| 1-1 | 1 | P-21 | 431 | 0.665 | 86 | 0.30 |
| 1-2 | 2 | P-3 | 430 | 0.564 | 90 | 0.04 |
| 1-3 | 3 | P-157 | 429 | 0.671 | 84 | 0.03 |
| 1-4 | 4 | P-158 | 430 | 0.664 | 83 | 0.02 |
| 1-5 | 5 | P-146 | 430 | 0.713 | 82 | 0.02 |
| 1-6 | 6 | P-147 | 431 | 0.712 | 82 | 0.02 |
| 1-7 | 7 | P-155 | 430 | 0.661 | 85 | 0.03 |

It is seen from Table 9 that when polymethyl methacrylate homopolymer (P-21) was used, the residual value was high and decolorizability was poor. On the other hand, when the acrylic acid copolymer (P-3) was used, decolorizability was improved, but the absorption characteristic was deteriorated. When polymers having a hydrophobic acid group were used, absorption wavelength, absorbance and half width were somewhat smaller and sharp and the value of residual color was low, to thereby obtain an improvement in decolorizability.

EXAMPLE 8

Emulsion A

An aqueous solution of 2.9 M silver nitrate and an aqueous halide solution containing 3.0 M sodium chloride and $5.0\times10^{-4}$ M ammonium hexachlororhodate (III) were added to an aqueous gelatin solution containing sodium chloride and having a pH of 2.0. The mixture was stirred at 38° C. over a period of 4 minutes while keeping a constant potential of 100 mV to carry out nucleation. After one minute, an aqueous solution of 2.9 M silver nitrate and an aqueous halide solution containing 3.0 M sodium chloride were added thereto at a rate of ½ of the above addition rate during nucleation. The addition was carried out at 38° C. over a period of 8 minutes while keeping a constant potential of 100 mV. The resulting emulsion was washed with water by a conventional flocculation method. Gelatin was added thereto, the pH was adjusted to 5.7 and the pAg was adjusted to 7.4. Subsequently, $5.0\times10^{-3}$ mol of 5,6-trimethylene-7-hydroxy-s-triazolo[2,3-a]pyrimidine, as a stabilizer, per mol of silver was added thereto. The resulting grains were cubic silver chloride grains containing $7.5\times10^{-5}$ mol of Rh per mol of silver and having a mean grain size of 0.13 μm (coefficient of variation: 11%).

Emulsion B

An aqueous solution of 2.9 M silver nitrate and an aqueous halide solution containing 3.0 M sodium chloride and $1.1\times10^{-4}$ M ammonium hexachlororhodate (III) were added to an aqueous gelatin solution containing sodium chloride and having a pH of 2.0. The mixture was stirred at 40° C. over a period of 4 minutes while keeping a constant potential of 85 mV to carry out nucleation. After one minute, an aqueous solution of 2.9 M silver nitrate and an aqueous halide solution containing 3.0 M sodium chloride and $3.4\times10^{-4}$ M ammonium hexachlororhodate (III) were added thereto at a rate of ½ of the above addition rate during nucleation. The addition was carried out at 40° C. over a period of 8 minutes while keeping a constant potential of 85 mV. Subsequently, the resulting emulsion was washed with water by a conventional flocculation method. Gelatin was added thereto, the pH was adjusted to 5.7 and the pAg was adjusted to 7.4. Furthermore, $3.0\times10^{-3}$ mol of 6-methyl-4-hydroxy-1,3,3a,7-tetrazaindene, as a stabilizer, per mol of silver was added thereto. The resulting grains were cubic silver chloride grains containing $7.5\times10^{-5}$ mol of Rh per mol silver and having a mean grain size of 0.16 μm (coefficient of variation: 12%).

Subsequently, 1-phenyl-5-mercaptotetrazole (2.5 mg/m²) and ethyl acrylate latex (average particle size: 0.05 μm, 770 mg/m²) were added to each of the emulsions A and B. Furthermore, 2-bis(vinylsulfonylacetamido)ethane (126 mg/m²) as a hardening agent was added thereto. The resulting emulsion A or B as indicated in Table 10 below was coated on a polyester support in a coating weight of 3.1 g/m² in terms of silver. The coating weight of gelatin was 1.5 g/m².

A lower protective layer comprising gelatin (0.8 g/m²), lipoic acid (8 g/m²) and ethyl acrylate latex (average particle size: 0.05 μm, 230 mg/m²) was coated thereon. Furthermore, an upper protective layer comprising gelatin (3.2 g/m²) and the comparative water-soluble dye D or the polymer dispersion of the dye of the invention (each as described in Example 7) were coated on the lower protective layer in the amounts as indicated in Table 10 below. A matting agent (silicon dioxide having an average particle size of 3.5 μm, 55 mg/m²), methanol silica having an average particle size of 0.02 μm (135 mg/m²) and sodium dodecylbenzenesulfonate (25 mg/m²), sodium salt of poly(degree of polymerization: 5)oxyethylene nonylphenyl ether sulfate (20 mg/m²) and potassium salt of N-perfluorooctanesulfonyl-N-propylglycine (3 mg/m²) as coating aids were coated simultaneously with the above coating to prepare the various samples.

The base used in this Example had a back layer having the following composition and a back protective layer having the following composition (the swelling ratio of the back side was 110%).

| | |
|---|---|
| Back layer | |
| Gelatin | 170 mg/m² |
| Sodium dodecylbenzenesulfonate | 32 mg/m² |
| Sodium dihexyl α-sulfosuccinate | 35 mg/m² |
| $SnO_2$/Sb (9/1 by weight, average particle size: 0.25 μm) | 318 mg/m² |
| Back protective layer | |
| Gelatin | 2.7 g |
| Matting agent (silicon dioxide having an average particle size: 3.5 μm) | 26 mg/m² |
| Sodium dihexyl α-sulfosuccinate | 20 mg/m² |
| Sodium dodecylbenzenesulfonate | 67 mg/m² |
| $C_8F_{17}SO_2N(C_3H_7)$—$(CH_2CH_2O)_n(CH_2)_4$—$SO_3Li$ | 5 mg/m² |
| Dye A | 190 mg/m² |
| Dye B | 32 mg/m² |
| Dye C | 59 mg/m² |
| Ethyl acrylate latex (average particle size: 0.05 μm) | 260 mg/m² |
| 1,3-Divinylsulfonyl-2-propanol | 149 mg/m² |

The above-described Dyes A, B and C and water-soluble dye D have the following structure.

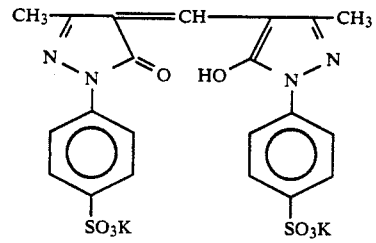

Dye A

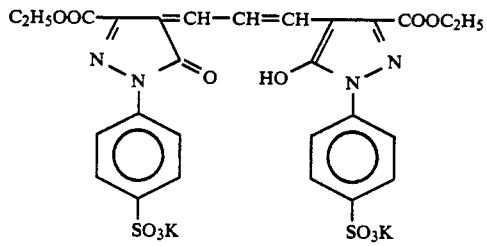

Dye B

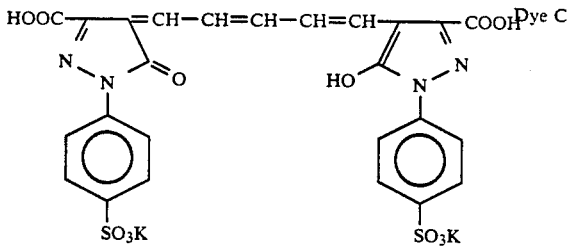

Dye C

-continued

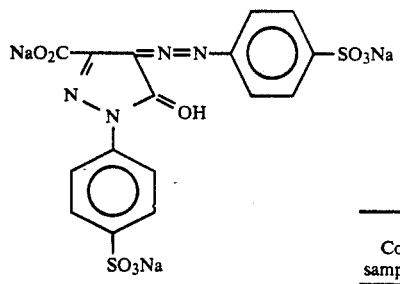

Comparative dye D above. The rankings 4 to 2 between the rankings 1 and 5 are assigned by organoleptic evaluation. A ranking of 3 or higher is a practically usable level.

(3)Residual Color

A: No residual color

B: A little residual color but it does not cause any problem in practical use

The results are shown in Table 10.

TABLE 10

| Coated sample No. | Emulsion | Dye | Coating weight of dye (mg/m²) | Relative sensitivity | γ | Letter image quality | Residual color |
|---|---|---|---|---|---|---|---|
| 2-1 | A | comparison D | 10 | 100 | 7.5 | 1.5 | A |
| 2-2 | " | dispersion 1 (invention) (P-21/D-14) | 40 | 99 | 8.1 | 3.5 | B |
| 2-3 | " | dispersion 5 (invention) (P-146/D-14) | 40 | 99 | 8.2 | 3.5 | A |
| 2-4 | B | comparison D | 15 | 100 | 5.5 | 1.5 | A |
| 2-5 | " | dispersion 1 (invention) (P-21/D-14) | 60 | 99 | 5.9 | 3.5 | B |
| 2-6 | " | dispersion 5 (invention) (P-146/D-14) | 60 | 99 | 6.0 | 3.5 | A |

Photographic Performance

The thus-obtained samples were exposed to light through an optical wedge using a P-627 FM (manufactured by Dainippon Screen KK), developed at 38° C. for 20 seconds using the developing solution LD-835 (manufactured by Fuji Photo Film Co., Ltd.), fixed, washed with water and dried (using an automatic processor, FG-800RA manufactured by Fuji Photo Film Co., Ltd.). The samples were evaluated with respect to the following items.

(1) Relative sensitivity

The reciprocal of an exposure amount providing a density of 1.5 relative to the sensitivity of sample 2-1 taken as 100.

(2) γ : (3.0−0.1)/−{log (exposure amount providing a density of 0.1)−log (exposure amount providing a density of 3.0)}

Furthermore, letter image quality was evaluated. The light-sensitive material, the originals and a clear base were placed in layers in the following manner, and exposure was carried out through the original.

(a) A transparent or semitransparent clear base (b) The line original (black areas represent the line subject)

(c) A transparent or semitransparent clear base (d) The halftone original (black areas represent halftone dots)

(e) A light-sensitive material for dot to dot work.

A ranking 5 of the letter image quality indicates a very good letter image quality, such that a 30 μm width letter can be reproduced with the correct exposure (i.e., a dot percent of 50% gives a dot percent of 50% on the light-sensitive material for dot to dot work). On the other hand, a ranking 1 of the superimposed letter image quality indicates poor superimposed letter image quality, such that only a 150 μm wide or wider letter can be reproduced with the correct exposure as described It is clearly seen from Table 10 that in the coated samples containing the water-soluble dye, the gradation γ is small and the superimposed letter image quality is inferior, but is remarkably improved when using the polymer dispersion of the present invention. With regard to residual color, the coated samples 2-2 and 2-5 were somewhat inferior. On the other hand, the coated samples 2-3 and 2-6 obtained using a polymer prepared by copolymerizing a monomer having a hydrophobic acid group provided improved results without deteriorating the image quality.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon one or more hydrophilic colloid layers, at least one layer of which is a light-sensitive silver halide emulsion layer, at least one hydrophilic colloid layer containing a dispersion obtained by emulsifying and dispersing a solution containing at least one oil-soluble dye which is decolorized or eluted from the photographic material upon photographic processing and at least one water-insoluble, organic solvent-soluble polymer having a repeating unit derived from a monomer having an anionic functional group.

2. A silver halide photographic material as in claim 1, wherein said polymer having a repeating unit derived from a monomer having an anionic functional group is a compound represented by the following formula $$\leftarrow A \rightarrow_x \leftarrow B \rightarrow_y \quad \text{(I)}$$

wherein A represents a repeating unit derived from an ethylenically unsaturated monomer having at least one acid group, and which monomer is insoluble in water at pH≦6, but soluble in water at pH≧10; B represents a repeating unit derived from other ethylenically unsaturated monomer; and x and y each represents the percentage by weight of each component and x is 1 to 100, y is 0 to 99, and $x+y=100$.

3. A silver halide photographic material as in claim 1, wherein said oil-soluble dye is a compound represented by the following formula (II):

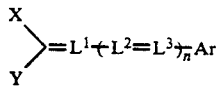

(II)

wherein X and Y each represents an electron attractive group, or X and Y are combined together to form an acid nucleus; Ar represents a phenyl group or a heterocyclic group; $L^1$, $L^2$ and $L^3$ each represents a methine group; and n represents 0, 1 or 2.

4. A silver halide photographic material as in claim 3, wherein said oil-soluble dye is a compound represented by the following formula (III):

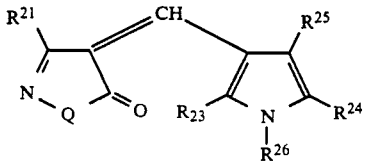

(III)

wherein $R^{21}$ represents a hydrogen atom, an alkyl group, an aryl group, $-COOR^{27}$, $-COR^{27}$, $-CONR^{27}R^{28}$, $-CN$, $-OR^{27}$, $-NR^{27}R^{28}$ or $-N(R^{27})COR^{28}$; Q represents an oxygen atom or $N-R^{22}$; $R^{22}$ represents a hydrogen atom, an alkyl group, an aryl group or a heterocyclic group; $R^{23}$, $R^{24}$ and $R^{25}$ each represents a hydrogen atom, an alkyl group or an aryl group or $R^{24}$ and $R^{25}$ may be combined together to form a six-membered ring; $R^{26}$ represents a hydrogen atom, an alkyl group, an aryl group or an amino group; and $R^{27}$ and $R^{28}$ each represents a hydrogen atom, an alkyl group or an aryl group.

5. A silver halide photographic material as in claim 2, wherein the acid group is selected from the group consisting of a carboxyl group, a phenolic hydroxyl group, a sulfonamido group and an activated methylene group.

6. A silver halide photographic material as in claim 2, wherein x is 3 to 80 and y is 20 to 97.

7. A silver halide photographic material as in claim 2, wherein x is 5 to 70 and y is 30 to 95.

8. A silver halide photographic material as in claim 1, wherein the ratio of polymer to dye in the dispersion is in the range of from 1:20 to 20:1 by weight.

9. A silver halide photographic material as in claim 1, wherein the oil-soluble dye is contained in the at least one hydrophilic colloid layer in an amount of from $10^{-3}$ to 3.0 g/m$^2$.

10. A silver halide photographic material as in claim 1, wherein the anionic functional group of the polymer having a repeating unit derived from a monomer having an anionic functional group is selected from the group consisting of a carboxyl group, a sulfonic acid group, a mono-substituted sulfuric acid group, a mono-substituted phosphoric acid group, a di-substituted phosphoric acid group, an active methylene group and a disulfonimide group.

11. A silver halide photographic material as in claim 1, wherein said at least one oil-soluble dye is decolorized upon photographic processing.

* * * * *